US011585621B2

(12) United States Patent
Galie et al.

(10) Patent No.: US 11,585,621 B2
(45) **Date of Patent: *Feb. 21, 2023**

(54) FAST ACTION SHOCK INVARIANT MAGNETIC ACTUATOR

(71) Applicant: Sturm, Ruger & Company, Inc., Southport, CT (US)

(72) Inventors: Louis M. Galie, Leander, TX (US); Rob Gilliom, Conway, AR (US); John Klebes, New Franken, WI (US); John M. French, Meridian, ID (US); Gary Hamilton, Enfield, CT (US)

(73) Assignee: Sturm, Ruger & Company, Inc.

( * ) Notice: Subject to any disclaimer, the term of this patent is extended or adjusted under 35 U.S.C. 154(b) by 54 days.

This patent is subject to a terminal disclaimer.

(21) Appl. No.: 17/201,141

(22) Filed: Mar. 15, 2021

(65) Prior Publication Data

US 2022/0018621 A1 Jan. 20, 2022

Related U.S. Application Data

(63) Continuation of application No. 15/930,405, filed on May 12, 2020, now Pat. No. 10,969,186, which is a (Continued)

(51) Int. Cl.
*F41A 19/59* (2006.01)
*F41A 19/16* (2006.01)

(52) U.S. Cl.
CPC ..... *F41A 19/59* (2013.01); *F41A 19/16* (2013.01)

(58) Field of Classification Search
CPC ..... F41A 19/59
See application file for complete search history.

(56) References Cited

U.S. PATENT DOCUMENTS 1,875,941 A 9/1932 Schwartz
2,424,247 A 7/1947 Mccaslin
(Continued)

FOREIGN PATENT DOCUMENTS

BR PI0701574 1/2009
BR PI0925319 B1 10/2019
(Continued)

OTHER PUBLICATIONS

International Search Report and Written Opinion PCT/US2021/030831; dated Oct. 5, 2021.
(Continued)

*Primary Examiner* — Reginald S Tillman, Jr.
(74) *Attorney, Agent, or Firm* — The Belles Group, P.C.

(57) ABSTRACT

An electromagnetic actuator includes characteristics of very fast actuation, shock invariant design, and compact size. The actuator may be controlled via a small low voltage power source such as a battery and simple switching logic. Such characteristics are ideally suited for incorporating the actuator into the firing mechanism of a firearm, which are subjected to drop tests to confirm the firearm will not discharge in the absence of trigger pull. Very fast snap-like action is attained by balancing the magnetic forces of two opposing permanent magnets around a stationary yoke and rotating member to create three circulating magnetic flux circuits. A central electromagnet coil amplifies the magnetic flux of one side of the rotating member or the other depending on the power source actuation polarity, thereby creating two possible snap-like actuation positions. The actuator is usable in firing mechanism release or enabling/disabling applications, and interfacing with other type mechanical linkages.

30 Claims, 55 Drawing Sheets

Related U.S. Application Data continuation-in-part of application No. 16/504,594, filed on Jul. 8, 2019, now Pat. No. 10,663,244, which is a continuation of application No. 16/265,077, filed on Feb. 1, 2019, now Pat. No. 10,378,848, which is a continuation of application No. 15/908,874, filed on Mar. 1, 2018, now Pat. No. 10,240,881.

(60) Provisional application No. 62/468,679, filed on Mar. 8, 2017.

(56) References Cited

U.S. PATENT DOCUMENTS

| | | | |
|---|---|---|---|
| 2,702,841 | A | 2/1955 | Bernstein |
| 2,780,882 | A | 2/1957 | Temple |
| 2,978,825 | A | 4/1961 | Tichenor |
| 3,065,560 | A | 11/1962 | Bumiller |
| 3,184,651 | A | 5/1965 | Albosta |
| 4,009,536 | A | 3/1977 | Sportwaffenfabrik |
| 4,231,632 | A | 11/1980 | Zimmimopoulos |
| 4,236,132 | A | 11/1980 | Zissimopoulos |
| 4,682,435 | A | 7/1987 | Heltzel |
| 5,619,817 | A | 4/1997 | Jones et al. |
| 5,713,150 | A | 2/1998 | Ealovega |
| 6,293,039 | B1 | 9/2001 | Fuchs |
| 6,442,880 | B1 | 9/2002 | Allan |
| 6,732,464 | B2 | 5/2004 | Kurvinen |
| 6,760,992 | B2 | 7/2004 | Brosow |
| 6,843,014 | B1 | 1/2005 | Aponte et al. |
| 7,049,915 | B2 | 5/2006 | Delamare et al. |
| 7,886,471 | B2 | 2/2011 | Glock |
| 8,234,969 | B2 | 8/2012 | Beckmann |
| 8,418,391 | B2 | 4/2013 | Kemmerer et al. |
| 8,461,951 | B2 | 6/2013 | Gassmann et al. |
| 8,522,466 | B2 | 9/2013 | Arduini |
| 8,677,665 | B1 | 3/2014 | Huber |
| 8,692,636 | B2 | 4/2014 | Reuber |
| 9,190,234 | B2 | 11/2015 | Reuber |
| 9,222,743 | B1 | 12/2015 | Shah et al. |
| 9,250,030 | B2 | 2/2016 | David |
| 9,261,315 | B2 | 2/2016 | Ladell |
| 9,341,425 | B2 | 5/2016 | Edwin |
| 9,347,723 | B2 | 5/2016 | Van Burdine |
| 9,354,010 | B1 | 5/2016 | McCullough |
| 9,354,011 | B2 | 5/2016 | Cooke et al. |
| 9,377,259 | B2 | 6/2016 | Milde et al. |
| 9,395,134 | B2 | 7/2016 | Swensen |
| 9,441,896 | B2 | 9/2016 | Allan |
| 9,488,427 | B1 | 11/2016 | Lucero |
| 9,557,129 | B2 | 1/2017 | Lupher et al. |
| 9,599,418 | B2 | 3/2017 | Steele |
| 9,784,516 | B2 | 10/2017 | Murphy, II et al. |
| 9,823,047 | B2 | 11/2017 | Lupher et al. |
| 9,841,249 | B1 | 12/2017 | Nicks et al. |
| 9,857,133 | B1 | 1/2018 | Kloepfer et al. |
| 9,879,932 | B2 | 1/2018 | Milde et al. |
| 9,903,694 | B2 | 2/2018 | Palo |
| 10,001,335 | B2 | 6/2018 | Patterson et al. |
| 10,107,579 | B2 | 10/2018 | Winiecki |
| 10,113,823 | B2 | 10/2018 | Alicea, Jr. |
| 10,126,080 | B2 | 11/2018 | Martin |
| 10,228,208 | B2 | 3/2019 | Galie et al. |
| 10,240,881 | B1 | 3/2019 | Galle et al. |
| 10,260,831 | B2 | 4/2019 | Biran et al. |
| 10,267,583 | B2 | 4/2019 | Murphy, II et al. |
| 10,288,380 | B1 | 5/2019 | York |
| 10,309,740 | B2 | 6/2019 | Fishbein et al. |
| 10,317,160 | B2 | 6/2019 | Righi |
| 10,365,057 | B2 | 7/2019 | Black et al. |
| 10,415,914 | B2 | 9/2019 | Lamparter et al. |
| 10,458,736 | B2 | 10/2019 | Galie et al. |
| 10,458,754 | B2 | 10/2019 | Miller et al. |
| 10,663,244 | B1 | 5/2020 | Galie et al. |
| 10,690,430 | B2 | 6/2020 | Galie et al. |
| 10,712,109 | B1 | 7/2020 | Birgen et al. |
| 10,724,816 | B2 | 7/2020 | Alicea, Jr. |
| 10,731,938 | B2 | 8/2020 | Alicea, Jr. |
| 10,746,490 | B1 | 8/2020 | Yu |
| 10,782,097 | B2 | 9/2020 | Hall |
| 10,816,293 | B2 | 10/2020 | Nieh et al. |
| 10,859,334 | B2 | 12/2020 | Gant et al. |
| 10,866,049 | B2 | 12/2020 | Werner |
| 10,900,733 | B2 | 1/2021 | Itzhakian et al. |
| 10,907,934 | B2 | 2/2021 | York et al. |
| 10,948,253 | B2 | 3/2021 | Teetzel et al. |
| 10,962,319 | B2 | 3/2021 | Shneorson et al. |
| 10,969,186 | B2 * | 4/2021 | Galie ..... F41A 19/59 |
| 10,969,202 | B2 | 4/2021 | Teetzel et al. |
| 10,989,488 | B2 | 4/2021 | Delgado Acarreta et al. |
| 11,085,722 | B2 | 8/2021 | Aaronson |
| 11,105,589 | B1 | 8/2021 | Bilbrey et al. |
| 2001/0032407 | A1 | 10/2001 | Cain et al. |
| 2015/0040453 | A1 | 2/2015 | Ballard et al. |
| 2015/0377574 | A1 | 12/2015 | Cooke et al. |
| 2016/0054081 | A1 | 2/2016 | Creed |
| 2016/0061549 | A1 | 3/2016 | Patterson et al. |
| 2016/0091267 | A1 | 3/2016 | Ray |
| 2016/0138881 | A1 | 5/2016 | Ladell |
| 2016/0209141 | A1 | 7/2016 | Lampela et al. |
| 2016/0233012 | A1 | 8/2016 | Lubinski et al. |
| 2016/0252317 | A1 | 9/2016 | Biran et al. |
| 2016/0258701 | A1 | 9/2016 | Carlson |
| 2016/0273859 | A1 | 9/2016 | Milde et al. |
| 2016/0298920 | A1 | 10/2016 | Stewart et al. |
| 2016/0327356 | A1 | 11/2016 | Milde et al. |
| 2016/0341506 | A1 | 11/2016 | Steele |
| 2016/0348994 | A1 | 12/2016 | Allan |
| 2017/0010062 | A1 | 1/2017 | Black et al. |
| 2017/0102199 | A1 | 4/2017 | Alicea, Jr. |
| 2017/0219306 | A1 | 8/2017 | Murphy et al. |
| 2017/0234636 | A1 | 8/2017 | Hafen |
| 2017/0234637 | A1 | 8/2017 | Patel |
| 2017/0299301 | A1 | 10/2017 | Gant et al. |
| 2017/0328661 | A1 | 11/2017 | Milde |
| 2017/0363380 | A1 | 12/2017 | Alicea, Jr. |
| 2018/0031345 | A1 | 2/2018 | Winiecki et al. |
| 2018/0058786 | A1 | 3/2018 | Carlson |
| 2018/0066910 | A1 | 3/2018 | Biran |
| 2019/0219351 | A1 | 7/2019 | Weinberg |
| 2020/0166309 | A1 | 5/2020 | Panas |
| 2020/0208943 | A1 | 7/2020 | Daly |
| 2020/0370851 | A1 | 11/2020 | Shahbaz et al. |
| 2020/0386504 | A1 | 12/2020 | Tubb et al. |
| 2021/0010773 | A1 | 1/2021 | Montero et al. |
| 2021/0140733 | A1 | 5/2021 | Herskowitz et al. |
| 2021/0148665 | A1 | 5/2021 | Delgado Acarreta et al. |
| 2021/0180899 | A1 | 6/2021 | Farrell et al. |

FOREIGN PATENT DOCUMENTS

| | | |
|---|---|---|
| CA | 1142783 | 3/1983 |
| CA | 1285801 | 7/1991 |
| CA | 2568329 | 12/2005 |
| CA | 2863316 C | 3/2020 |
| CH | 419899 | 8/1966 |
| CN | 104075619 | 10/2014 |
| CN | 105488480 | 4/2016 |
| CN | 105612400 | 5/2016 |
| CN | 105823376 | 8/2016 |
| CN | 205843484 | 12/2016 |
| CN | 205879007 | 1/2017 |
| CN | 107004309 | 8/2017 |
| CN | 107578493 | 1/2018 |
| CN | 206862203 | 1/2018 |
| CN | 206974276 | 2/2018 |
| CN | 105865260 | 9/2018 |
| CN | 103278044 | 4/2019 |
| CN | 110822986 | 2/2020 |
| CN | 210718818 U | 6/2020 |
| DE | 731655 | 6/1979 |
| DE | 2926559 | 1/1981 |
| DE | 3446019 | 6/1986 |
| DE | 3516202 | 6/1986 |
| DE | 4303333 | 6/1994 |

(56) References Cited

FOREIGN PATENT DOCUMENTS

| | | | |
|---|---|---|---|
| DE | 102005040302 | | 3/2007 |
| DE | 202013005117 | | 7/2013 |
| DE | 102016109653 | B4 | 11/2020 |
| EP | 1074810 | | 2/2001 |
| EP | 1132929 | | 7/2008 |
| EP | 2330375 | | 6/2011 |
| EP | 3060870 | | 8/2016 |
| EP | 3093606 | | 11/2016 |
| EP | 2887003 | | 12/2016 |
| EP | 2887002 | | 1/2017 |
| EP | 3239643 | | 11/2017 |
| ES | 2599959 | | 2/2017 |
| ES | 2604474 | | 3/2017 |
| FR | 2794853 | | 10/2002 |
| GB | 224319 | | 11/1924 |
| GB | 271925 | | 5/1927 |
| GB | 2340589 | | 2/2000 |
| IN | 201821002803 | | 9/2018 |
| JP | 20000133091 | | 5/2000 |
| JP | 2001021290 | | 1/2001 |
| JP | 2000133091 | A | 7/2001 |
| JP | 2001250716 | | 9/2001 |
| JP | 3240351 | | 12/2001 |
| JP | 200363194495 | | 7/2003 |
| JP | 4887993 | B2 | 2/2012 |
| JP | 5613731 | B2 | 10/2014 |
| JP | 2016537602 | | 12/2016 |
| KR | 20160016122 | | 2/2016 |
| KR | 101652077 | | 9/2016 |
| KR | 20180086869 | | 8/2018 |
| KR | 20180114377 | | 10/2018 |
| NZ | 210457 | | 10/1988 |
| RU | 2101839 | | 1/1998 |
| WO | WO199744630 | | 11/1997 |
| WO | WO2005116567 | | 12/2005 |
| WO | WO14130625 | | 8/2014 |
| WO | WO14142920 | | 9/2014 |
| WO | WO15066744 | | 5/2015 |
| WO | WO2016109756 | | 7/2016 |
| WO | WO16134851 | | 9/2016 |
| WO | WO19052621 | | 3/2019 |
| WO | WO20201788 | | 10/2020 |
| WO | WO21048307 | A1 | 3/2021 |

OTHER PUBLICATIONS

Moving Magnet Technologies SA, Bistable Actuators Actuators and Solenoids for stable positions without current; See description and rotary actuator figure. Internet site: http://www.movingmagnet.com/en/bistable-actuators-rotary-solenoids/ printed Jun. 19, 2018.

* cited by examiner

| A | B | Actuator |
|---|---|---|
| H | L | Active LEFT |
| L | L | OFF |
| H | H | OFF |
| L | H | Active RIGHT |

FAST ACTION SHOCK INVARIANT MAGNETIC ACTUATOR

CROSS-REFERENCE TO RELATED APPLICATIONS

The present application is a continuation of U.S. patent application Ser. No. 15/930,405 filed May 12, 2020, which is a continuation-in-part of U.S. application Ser. No. 16/504,594 filed Jul. 8, 2019, which is a continuation of U.S. application Ser. No. 16/265,077 filed Feb. 1, 2019 (now U.S. Pat. No. 10,378,848), which is a continuation of U.S. application Ser. No. 15/908,874 filed Mar. 1, 2018 (now U.S. Pat. No. 10,240,881), which claims the benefit of priority to U.S. Provisional Application No. 62/468,679 filed Mar. 8, 2017. The foregoing applications are incorporated herein by reference in their entireties.

BACKGROUND OF THE DISCLOSURE

The invention pertains generally to firearms, and more specifically to battery powered fast-action actuators for use in critical high shock and acceleration exposure environments such as in firearms.

Electromagnetic actuators are typically not used in small portable applications where a reliable fast action, high force, and large displacement is needed, but instead small size, low battery power consumption, and shock invariance is required for mission critical safety and performance such as in a firearm. Typically, electromagnetic actuators require high power energy sources and large electromagnet coils to achieve either fast action or high force and displacement, thereby making them generally unsuitable for use in firearms with spatial and other operational constraints. It is difficult to achieve both small size and fast action while maintaining a useful amount of force and displacement in a small battery powered device.

In addition, traditional approaches for actuators used in firing mechanisms of firearms are very susceptible to unintentional actuation induced by accidental or intentional dropping, jarring, mishandling, and harsh environments of use. Typical actuators in these applications are mechanical devices that use strong springs, levers, sears, and safety linkages to provide fast action and provide safety from accidental
actuation. Such conventional mechanical firing systems however are complex and hence prone to operating problems and wear.

An improved actuator suitable for a firearm is desired.

SUMMARY OF THE DISCLOSURE

According to an embodiment of the present invention, an electromagnetic actuator suitable for a firearm is disclosed that provides the novel combination of very fast actuation, shock invariant design, small size, and which can be controlled using a small low voltage battery power source and simple switching logic. In one embodiment, very fast snap-like action is attained by balancing the forces of two opposing permanent magnets around a central yoke and rotating member to create three circulating magnetic flux circuits. A central electromagnet coil in the center of the yoke amplifies the magnetic flux of one side of the rotating member or the other depending on the actuation polarity. As the rotating member begins to change state or position, an air gap opens on the opposing side (previously closed) of the rotating member and the combined change in reluctance in the three circulating magnetic flux circuits causes a rapid increase in the flux density on the closing side (previously open) of the rotating member and a rapidly decreasing force on the opening side resulting in a very fast snap action closure of the rotating member. This creates two possible actuation positions of the rotating member which can interact and be interfaced with the firing mechanism of a firearm in either a firing mechanism component release application to discharge the firearm, or alternatively a firing mechanism blocking/enablement application each of which is further describe herein.

The disclosed actuator design may have a center of rotation of the rotating member sufficiently close to the center of mass of the rotating member such that random linear acceleration forces from any direction will not generate sufficient force to overcome the static holding force of the permanent magnets on the rotating member. The use of closed feedback sensing of actuation allows very fast reset of the actuator and optimal power conservation. Closed feedback sensing is well known in the art and basically comprises a control loop including an instrumentation sensor that measures the process, a transmitter which converts the measurements into an electrical signal that is relayed to the controller, and the actuator which performs a function measured by the sensor. The controller decides what action to execute based on real-time feedback from the sensor.

In one embodiment of the present invention, strong permanent magnets may be used in combination with a electromagnetic coil optimally designed to substantially improve the speed of actuation under minimal size and power requirements and combined with a center of rotation of the rotating member sufficiently close to the center of mass of the rotating member that random linear acceleration forces from any direction will not generate sufficient force to overcome the static holding force of the rotating member. The use of closed feedback sensing of actuation allows very fast reset of the actuator and optimal power conservation. The foregoing characteristics are ideally suited for incorporation of the electromagnetic actuator into the firing mechanism of a firearm which requires rapid actuation and ability to withstand standard drop tests to verify that the firearm will not discharge in the absence of trigger pull.

The electromagnetic actuators of the present invention may be integrated with an onboard microprocessor-based control system disposed in the firearm which comprises a programmable controller such as a microcontroller. The microcontroller may be configured with program instructions/control logic (e.g. software) which controls operation of the actuator and various functions of the firearm, as further described herein.

Embodiments of the present invention provide an actuator that is able to withstand high shock and acceleration forces without changing state, thereby making them suitable for use in a firearm or other applications benefiting from such capabilities.

The foregoing or other embodiments of the present invention control the change in state at a fast speed of actuation; for example less than 10 milliseconds and a displacement of at least 0.5 millimeters in one non-limiting configuration.

The foregoing or other embodiments of the present invention comprise an actuator that is small in size; for example less than 20 cubic centimeters in one non-limiting configuration.

The foregoing or other embodiments of the present invention provide that the actuator can be controlled using a small low voltage battery source and simple switching logic.

The foregoing or other embodiments of the present invention include the actuator use of a closed feedback sensing of the actuation to allow very fast reset and optimal power conservation.

According to one aspect, a firearm with firing mechanism comprises: a frame; a barrel supported by the frame and including a chamber configured for holding an ammunition cartridge; a movable firing mechanism supported by the frame and comprising a forwardly movable spring-biased striking member and a movable trigger mechanism operably coupled to the striking member, the firing mechanism configured and operable for discharging the firearm; and an electromagnetic actuator operably interfaced with the firing mechanism. The actuator comprises: an annular body defining a central space and central axis; a stationary magnetic yoke having an outer portion forming at least part of the annular body; a rotating member pivotally mounted about a center of rotation in the central space, the rotating member pivotably movable relative to the yoke between first and second actuation positions; an electromagnet coil disposed in the central space; and a pair of first and second permanent magnets affixed to the yoke or rotating member, the magnets positioned to generate opposing magnetic fields within the rotating member and creating a static holding torque on the rotating member for maintaining the first or second actuation positions. The firearm further comprises an electric power source operably coupled to the electromagnet coil, wherein the rotating member is rotatable between the first and second actuation positions by applying an electrical current pulse of alternating polarity to the electromagnet coil.

According to another aspect, a firearm with firing mechanism comprises: a frame; a barrel supported by the frame and including a chamber configured for holding an ammunition cartridge; a trigger-operated firing mechanism comprising a trigger and a spring-biased striking member operably coupled thereto, the striking member movable between a rearward cocked position and a forward firing position for discharging the firearm; and an electromagnetic actuator operably interfaced with the firing mechanism. The actuator comprises: an annular body defining a central space and central axis; a stationary magnetic yoke having an outer portion forming at least part of the annular body and an inner portion extending into the central space; a rotating member pivotally mounted in the central space to the inner portion of the yoke about an axis of rotation, the rotating member pivotably movable relative to the yoke between first and second actuation positions; an electromagnet coil disposed in the central space around the inner the inner portion of the yoke; and a pair of first and second permanent magnets affixed to the yoke or rotating member, the magnets positioned to generate opposing magnetic fields within the rotating member and creating a static holding torque on the rotating member for maintaining the first or second actuation positions. The firearm further comprises an electric power source operably coupled to the electromagnet coil, wherein the rotating member is rotatable between the first and second actuation positions by applying an electrical current pulse of alternating polarity to the electromagnet coil.

According to another aspect, an electromagnetic-actuated firing system for a firearm comprises: a trigger-operated firing mechanism configured for mounting to a firearm, the firing mechanism comprising a spring-biased striking member movable between a rearward cocked position and a forward firing position; an actuator control circuit; an electric power source operably coupled to the control circuit; and an electromagnetic actuator operably coupled to the control circuit. The actuator is configured for mounting to a firearm and comprises: a central axis; a stationary yoke assembly comprising an outer yoke configured for mounting in a firearm, and an axially elongated inner yoke disposed in a central space defined by the outer yoke; an electromagnet coil disposed around the inner yoke; a rotating member pivotally coupled to the inner yoke in the central space about a pivot axis defining a center of rotation, the rotating member pivotably movable relative to the yoke assembly between first and second actuation positions; an engagement feature formed on the rotating member and operably coupled directly or indirectly to the striking member; a pair of openable and closeable first and second air gaps formed between the yoke assembly and rotating member; and a pair of first and second permanent magnets attached to the outer yoke or rotating member and creating a static holding torque on the rotating member to maintain the first or second actuation positions; the yoke assembly, permanent magnets, and rotating member collectively forming a first magnetic flux circuit and a second magnetic flux circuit, wherein opposing lines of magnetic flux are created in the inner yoke and rotating member. The rotating member is rotatable between the first and second actuation positions by applying an electrical current pulse of alternating polarity to the electromagnet coil by the control circuit.

According to another aspect, an electromagnetic actuator for a firearm comprises: a central axis; an annular stationary outer yoke circumscribing an interior central space; a spool arranged in the central space and defining a longitudinal cavity extending along the central axis; an electromagnetic coil wound around the spool; an axially elongated rotating member disposed in the cavity of the spool about a pivot axis defining a center of rotation, the rotating member pivotably movable relative to the yoke between first and second actuation positions; the rotating member configured to interface with a movable mechanical linkage of the firearm; a pair of spaced apart first and second permanent magnets attached to the outer yoke or the rotating member and creating a static holding torque on the rotating member for maintaining the first or second actuation positions; the yoke, permanent magnets, and rotating member collectively forming a first magnetic flux circuit and a second magnetic flux circuit; wherein the rotating member is rotatable between the first and second actuation positions by changing a polarity of an electric current applied to the electromagnet coil.

According to another aspect, an electromagnetic actuator for a firing mechanism of a firearm comprises: a central axis; an annular stationary outer yoke circumscribing an interior central space, the yoke including an open top receptacle and a bottom opening; a spool arranged in the central space and defining a longitudinal cavity extending along the central axis; an electromagnetic coil wound around the spool; an axially elongated rotating member disposed in the cavity of the spool about a pivot axis defining a center of rotation, the rotating member pivotably movable relative to the yoke between first and second actuation positions; the rotating member comprising an operating end protrusion arranged in the top receptacle of the yoke and configured to interface with a movable component of the firing mechanism, and an opposite actuating end protrusion arranged in the bottom opening of the yoke; a pair of spaced apart first and second permanent magnets attached to the outer yoke or the rotating member in the bottom opening and creating a static holding torque on the rotating member for maintaining the first or second actuation positions; an openable and closeable first air gap formed between the yoke and the actuating end protrusion on a first side of rotating member, and an openable and closeable second air gap formed between the yoke and the actuating end protrusion on a second side of rotating member; the yoke, permanent magnets, and rotating member collectively forming a first magnetic flux circuit and a second magnetic flux circuit; wherein the rotating member is rotatable between the first and second actuation positions by changing a polarity of an electric current applied to the electromagnet coil from a power source.

In another aspect, a method for assembling an electromagnetic actuator comprises: providing an outer yoke comprising a first half-section and a second half-section, an elongated rotating member comprising an operating end protrusion and an actuating end protrusion, a pair of first and second permanent magnets disposed on the outer yoke or rotating member, and an inner spool formed of a non-magnetic material; pivotably mounting the rotating member in a cavity formed in the spool; winding an electric coil around the spool yoke; positioning the spool between the first and second half-sections of the outer yoke; coupling the first and second half-sections of the outer yoke together to trap the spool in a central space of the outer yoke; wherein the rotating member is pivotably movable between a first actuation position and a second actuation position.

These and other features and advantages of the present invention will become more apparent in the light of the following detailed description and as illustrated in the accompanying drawings.

BRIEF DESCRIPTION OF DRAWINGS

The features of the exemplary embodiments will be described with reference to the following drawings where like elements are labeled similarly, and in which:

FIGS. 8A-C are simplified views of a firearm system including an asymmetric actuator with an external mechanical reset/return means in which FIG. 8A shows a first position of the reset/return means, FIG. 8B shows a second position of the reset/return means, and FIG. 8C shows a third position of the reset/return means.

FIGS. 9A and 9B are diagrams showing two alternative embodiments of a secondary sensing coil used for closed loop actuation feedback in which FIG. 9A shows a first embodiment of the secondary sensing coil and FIG. 9B shows a second embodiment of the second sensing coil.

All drawings are schematic and not necessarily to scale. Any reference herein to a whole figure number (e.g. FIG. 8) which may include several subpart figures (e.g. FIGS. 8A, 8B, 8C) shall be construed as a reference to all subpart figures unless explicitly noted otherwise.

DETAILED DESCRIPTION

Figure 1:
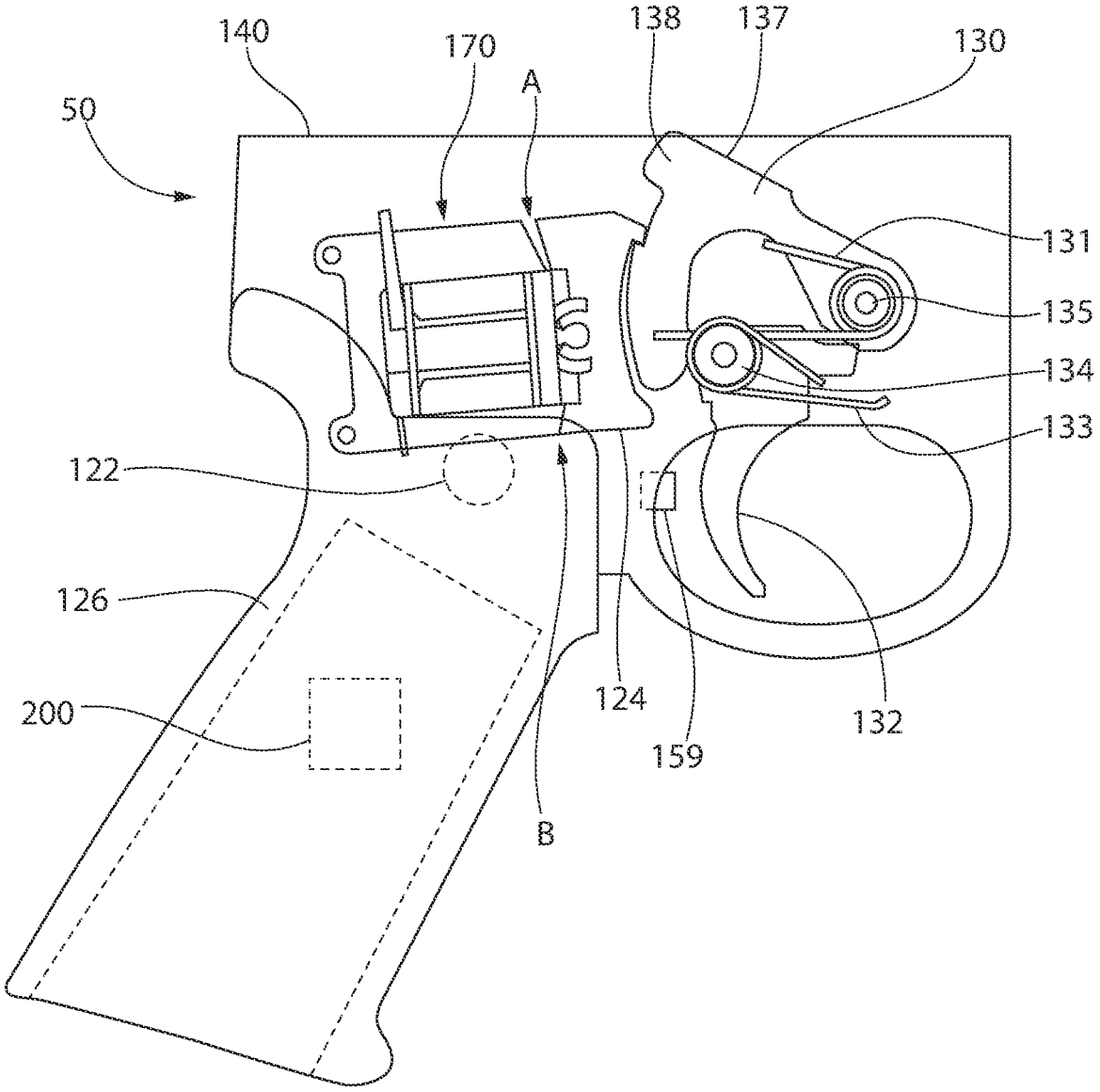
FIG. 1 is a perspective view of a firearm system including an actuator according to the present disclosure provided as a direct replacement of the sear and which interfaces directly with a hammer or striker fired firing system.

The features and benefits of the invention are illustrated and described herein by reference to example ("exemplary") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

As used throughout, any ranges disclosed herein are used as shorthand for describing each and every value that is within the range. Any value within the range can be selected as the terminus of the range.

While the embodiments discussed here all relate to the application in firearms, it is apparent to those skilled in the art that the fast action shock invariant magnetic actuator disclosed is directly applicable to other applications that need a small, battery powered fast acting actuation means that can survive in a high shock environment such as less-lethal weapons (stun guns, pellet guns, tear gas launchers, paintball guns), power tools (drills staple guns, nail guns, pneumatic tools), military applications (small arms, crew served weapons, machine guns), as well as an actuator for access control such as gun holsters, door locks, storage boxes and containers, and any number of replacement applications where other mechanical or electromechanical actuators are used. Accordingly, the applicability of the magnetic actuator mechanisms disclosed herein is not limited to firearms alone and has broad uses in devices and systems that may benefit from the attributes of the actuator.

Figure 14A:
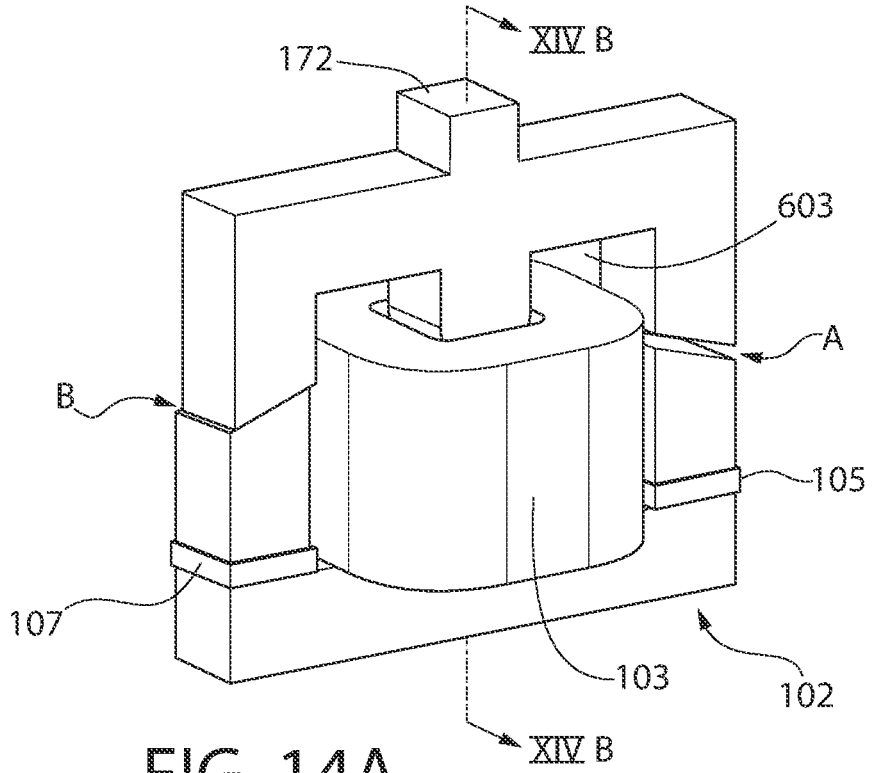
FIG. 14A is a perspective view of an embodiment of a symmetric magnetic actuator according to the present disclosure that is bistable and dual-acting having a center of rotation close to the center of mass of the rotating member.
Figure 14B:
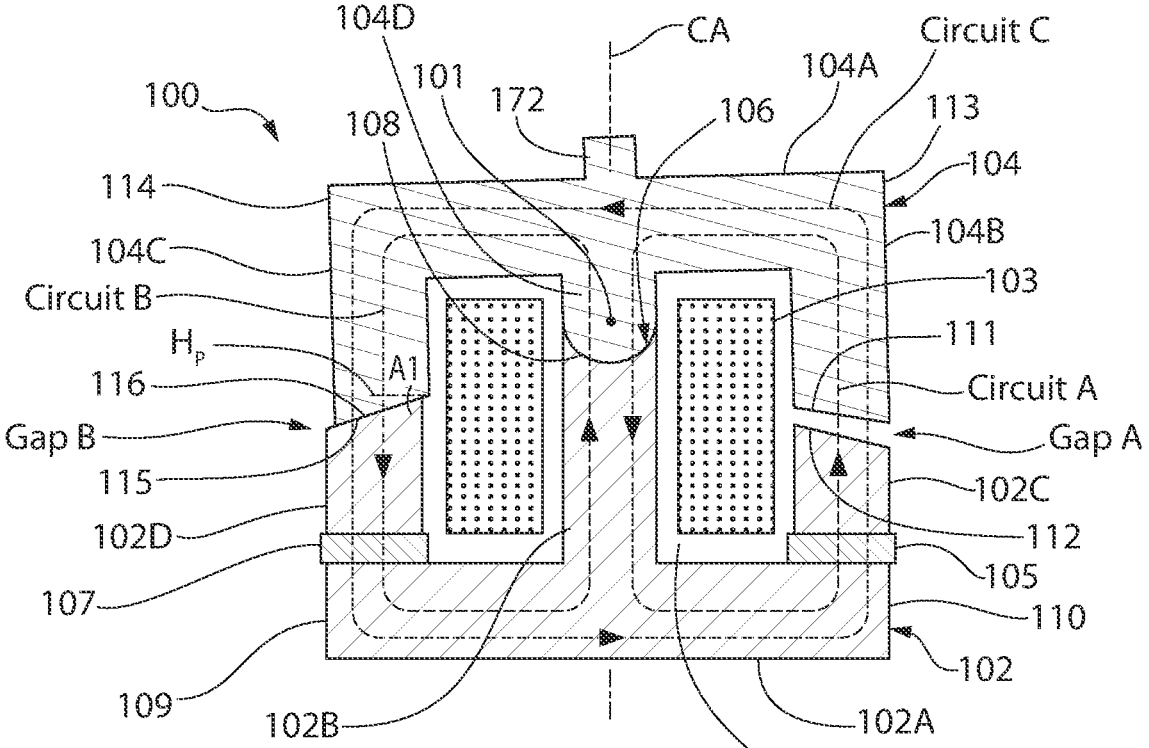
FIG. 14B is a cross-sectional view thereof showing the magnetic flux flow diagram or circuits created by the actuator.

FIGS. 14A and 14B depict one non-limiting embodiment of an electromagnetic actuator 100 according to the present disclosure. The actuator 100 has a generally annular-shaped body defining a central space 603 therein. Actuator 100 includes a stationary element or member such as yoke 102 and a rotating element or member 104. In one configuration, yoke 102 comprises an elongated base portion 102A shown in a horizontal orientation (for convenience of reference only), a central portion 102B extending upwards from the base portion, and opposing upright right and left end portions 102C, 102D extending upwards from the base portion ends 109, 110. Base portion 102A and end portions 102C, 102D define an outer portion of the yoke assembly while central portion 102B defines an inner portion disposed in a central space 603 defined in part by the outer portion. Central portion 102B may be located intermediate and equidistant between opposing ends 109, 110 of the base portion 102A within the central space 603. Yoke 102 may have an inverted generally T-shaped configuration in one embodiment.

A permanent magnet 105, 107 may be affixed to each upright end portion 102C, 102D to generate a static bias, as further described herein. In one embodiment, magnets 105, 107 may be disposed at the interface between the base portion 102A and upright end portions 102C, 102D of the yoke 102. The magnets may be made of any suitable type of magnetic material, such as without limitation rare earth magnets like neodymium or others.

In one configuration, rotating member 104 comprises an elongated top portion 104A shown in a substantially horizontal orientation (for convenience of reference only), a downwardly depending central portion 104D extending downwards from the top portion, and downwardly depending opposing end portions 104B, 104C extending downwards from the top portion ends 113, 114. Rotating member 104 may have a generally T-shape configuration in one embodiment, which may have a somewhat complementary-configuration to yoke 102. Similarly to yoke 102, central portion 104D may be located intermediate and equidistant between opposing ends 113, 114 of the top portion 104A.

Rotating member 104 may be pivotably connected to stationary yoke 102 via pivot 101 defining a pivot axis (perpendicular to the plane of the FIG. 14B). Pivot 101 defines a center of rotation of the rotating member 104. Any suitable type of pivot connection may be used, such as without limitation a pin or rod as some examples so long as a rocking or see-saw type motion of the rotating member 104 is created relative to the yoke 102. In one embodiment, pivot 101 may pivotably couple the central portions 102B, 104D of the yoke 102 and rotating member 104 together as shown. The central portions 102B, 104D of the yoke and rotating member define a central axis CA of the actuator 100 (vertical in FIG. 14B for convenience of reference). The pivot axis defined by pivot 101 in one embodiment intersects and is transverse to the central axis CA.

The end surfaces 111, 112, 115, 116 of the terminal free ends of the mating rotating member end portions 104B, 104C and of yoke end portions 102C, 102D are movable together and apart via the pivoting action of the rotating member 104 relative to the stationary yoke 102. Accordingly, an openable and closeable air space or gap A, B is formed each mating pair of end portions 102C/104B and 102D/014C. In one embodiment, the interface between each mating pair of end surfaces may obliquely angled at an angle Al in relation to a horizontal reference plane Hp passing through gaps A, B. The obliquely angle end surfaces ensures that abutting contact between each pair of mating end surfaces is one of flat-to-flat when the rotating member 104 tilts from one side to the other when the actuator 100 is actuated.

In one embodiment, an arcuately curved interface may be provided between the central portions 102B, 104D of the yoke 102 and rotating member 104 respectively to facilitate pivotable motion of the rotating member. Accordingly, central portion 102B may have a concavely curved terminal free end 106 and central portion 104D may have a convexly curved terminal free end 108 as shown, or vice-versa. The mating end surfaces of the free ends are in sliding mutual engagement allowing the rotating member 104 to rotate or rock back and forth when operating, as further described herein. Other interface configurations may be used that provide rocker-type action.

Rotating member 104 is pivotably movable between a first position and a second position. Each position alternatingly forms a closed air gap A or B on one side of the actuator 100 and an open air gap A or B on the other side during tilting action of rotating member depending on the direction of tilt. This motion is useful for forming a component part of the firing mechanism of a firearm in either a release mode of operation or a blocking/unblocking mode of operation, as further described herein.

With continuing reference to FIGS. 14A & B, actuator 100 may include an electromagnetic coil 103 which is electrically coupled to and energized by an electrical power source 122 (see, e.g. FIG. 1) of suitable voltage and current to actuate the actuator. Applying an electric current to the coil and changing/reversing polarity causes the rotating member 104 of the actuator to pivot or tilt back and forth from side to side in a rocking motion. In one embodiment, a single coil 103 wrapped primarily around and supported by the upright central portion 102B of the stationary yoke 102 may be provided as shown which collectively forms an electromagnet. Operation of the actuator 100 such as for controlling the firing mechanism of a firearm or other applications is further described herein. In one embodiment, a protective casing 190 may be provided to at least partially enclose the coil 103.

The stationary yoke 102 and rotating member 104 may be formed of any suitable soft ferromagnetic metal capable of being magnetized, such as without limitation iron, steel, nickel, etc.

A key feature of the present electromagnetic actuator 100 is the interaction of the three magnetic flux fields generated in the actuator when energized by a suitable compact power source 122, as shown in FIG. 14B. The magnetic actuator 100 incorporates a magnetic circuit wherein the magnetic circuit is comprised of three magnetic flux paths or loops shown as circuit A, circuit B and circuit C, wherein circuit A and B are two loops each biased with a permanent magnet 105, 107 and each sharing a common, centrally located return flux path (via central portions 104D of rotating member 104 and 102B of yoke 102) in which the flux from circuit A and circuit B are biased in opposite directions; and circuit C is the closed outermost loop comprised of the portions of circuit A and circuit B which are not common to both circuit A and circuit B and in which the flux from circuit A and circuit B are biased in the same direction.

Actuator 100 may further include an engagement feature strategically located on the rotating member 104 and configured to interface with a component of the firearm's firing mechanism in either a blocking or release operational role. In various embodiments, the engagement feature may be an operating extension or protrusion 172 of the rotating member 104 as illustrated herein, a socket or recess formed in the rotating member (not shown), or other element of other type and/or configuration (not shown) capable of mechanically interfacing with the firing mechanism. Although the engagement feature may be described herein for convenience of description and not limitation as an operating protrusion, any other form of engagement feature may be provided so long as the feature is capable of mechanically interfacing with a portion of the firing mechanism. The engagement feature when configured as a protrusion 172 extends outwardly from the rotating member and may have any suitable configuration and size. The engagement feature 172 is further described herein with respect to FIG. 16 below.

It bears noting that the shape of the various actuators shown in the accompanying figures is intended to be schematically descriptive; thus, geometries are rectangular. In actual use, the actuators may be a variety of shapes and contours, provided the center of rotation is sufficiently close to the center of mass of the rotating member for reasons described herein.

Figure 16:
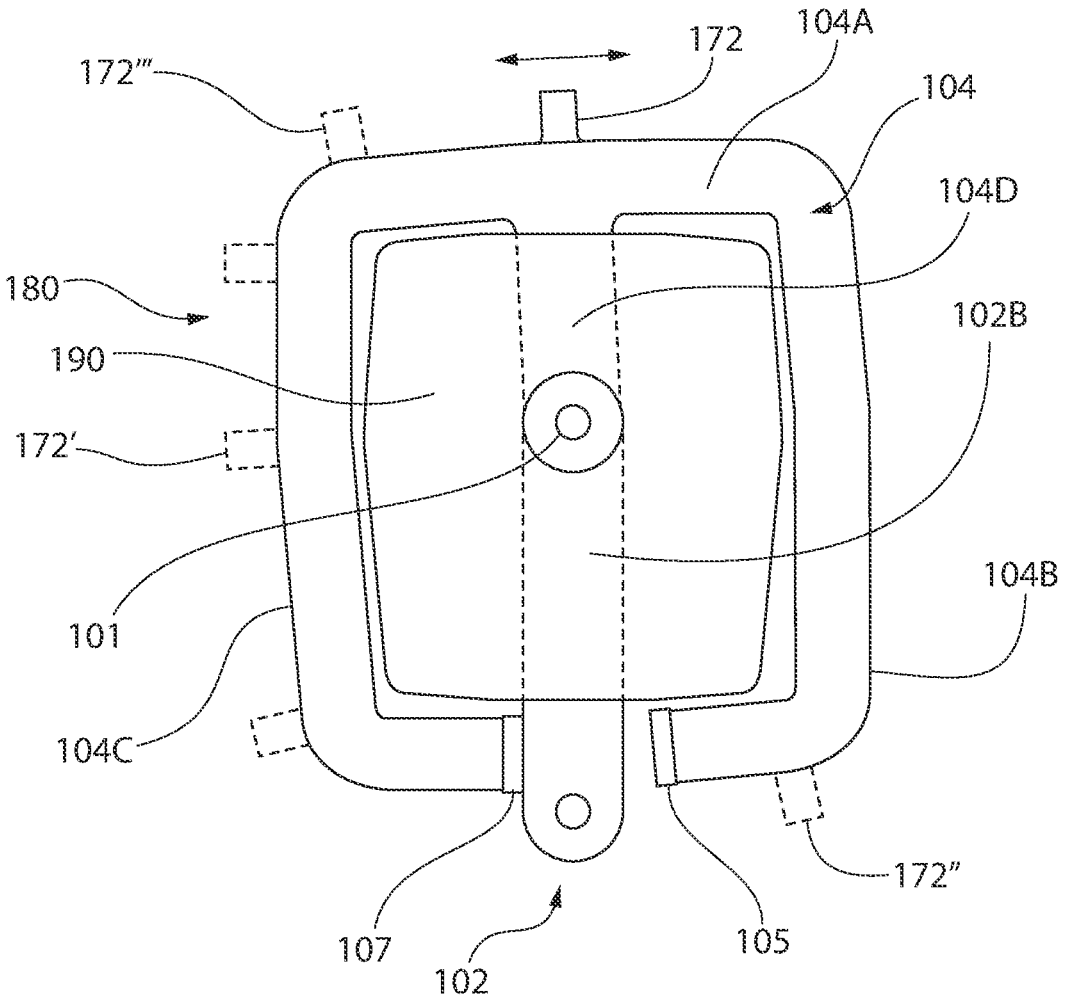
FIG. 16 shows an alternative embodiment of a magnetic actuator showing the permanent magnets located on the rotating member.

FIG. 16 presents another alternative configuration of an actuator 180 where the permanent magnets 105, 107 that make up the outer magnetic flux loops are rigidly attached to the rotating member 104 instead of the fixed central yoke 102. The yoke comprises a single elongated central member or portion 102B. The end portions 104B, 104C of rotating member 104 are lengthened and turned inwards in opposing relationship to each other towards the yoke 102. The pivot location 101 coinciding with the center of rotation may be at approximately the same relative position shown in FIGS. 14A and B. The magnets 105, 107 may be mounted at the terminal free ends of the rotating member end portions 104B, 104C as shown and alternatingly and directly engage the yoke 102 under toggle action. Many other design locations within the outer loops (end portions) of the rotating member 104 however are viable to place the permanent magnets to bias the outer loops of the actuator while maintaining the common central return path of the opposing fields returned through the center of the yoke.

Figure 2:
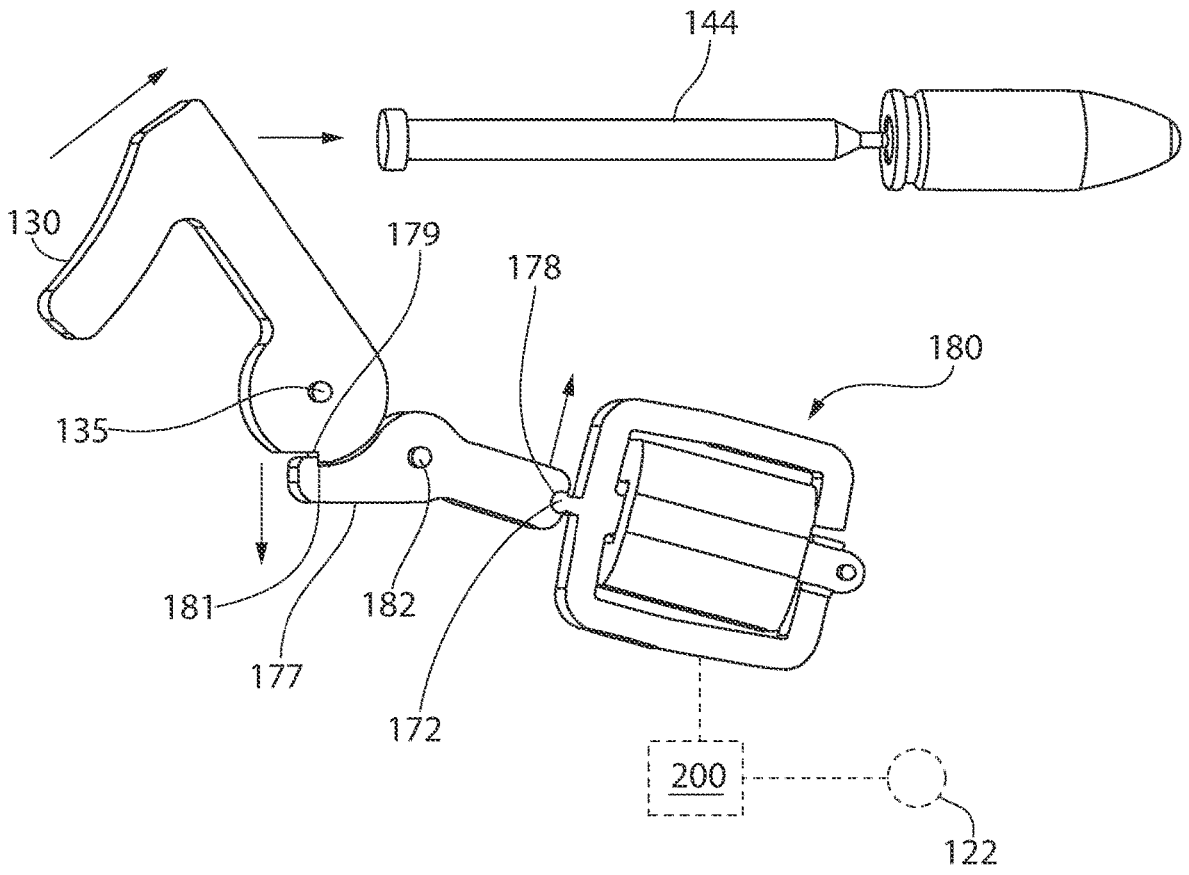
FIG. 2 is a simplified view of a firearm system including an actuator interfacing with a sear that actuates the hammer or striker fired firing system.
Figure 3:
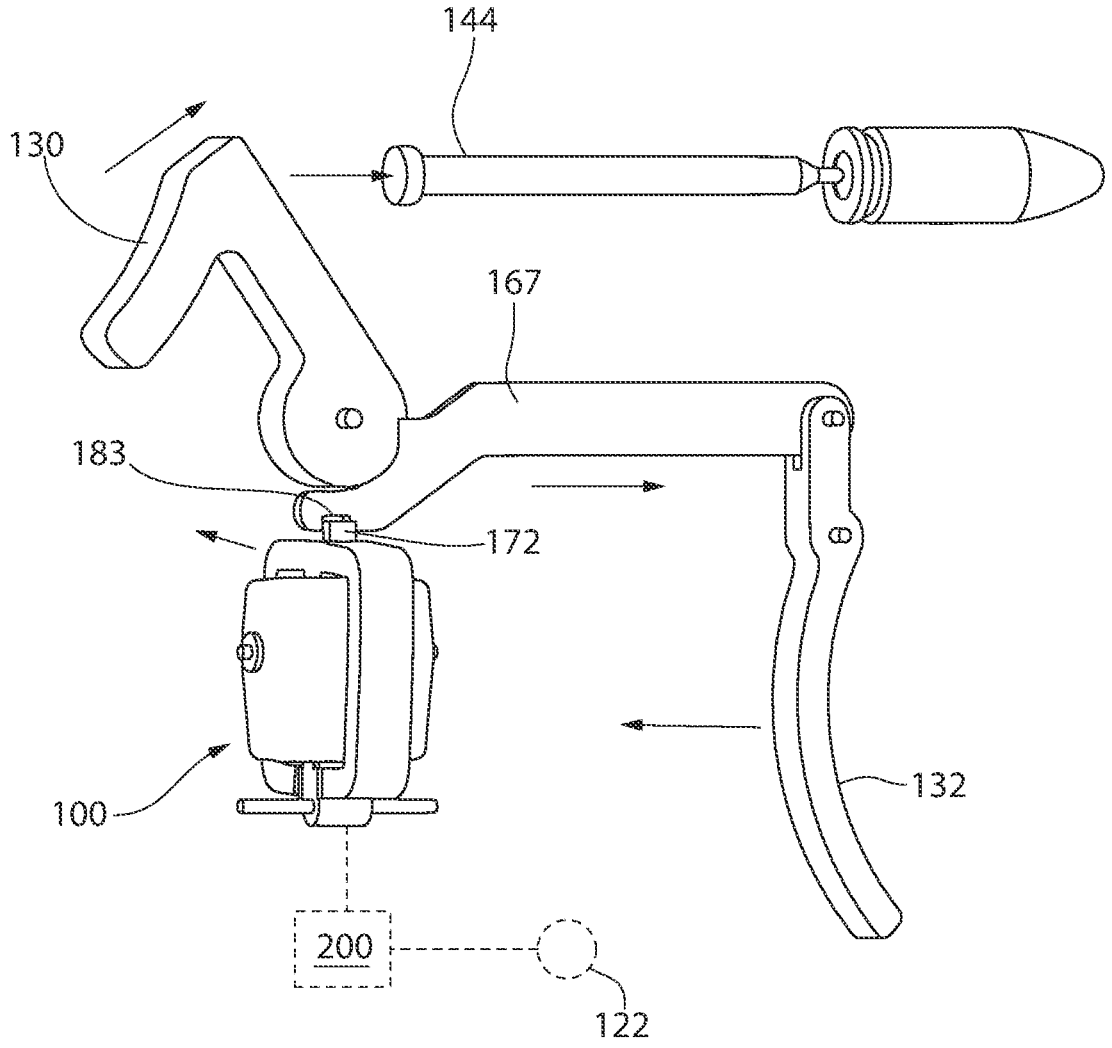
FIG. 3 is a simplified view of a firearm system that uses the actuator to enable/disable a trigger or intermediate component between the trigger and energy storage device to prevent the firearm from being fired.

The rotating member 104 is shown having an engagement feature 172 in the form of an outwardly projecting operating protrusion configured for engaging a firing mechanism component of the firearm in either a blocking or release type mode of operation; examples of each being described herein. Although engagement feature 172 is illustrated as having a rectilinear shape (e.g. rectangular or square), other polygonal and non-polygonal shapes may be used depending on the application and corresponding configuration of the firing mechanism component engaged. Protrusion 172 may be centrally located on the top portion 104A of rotating member 104 and moves laterally back and forth to two different positions as the actuator 180 is activated. Other locations for protrusion 172 on the rotating member 104 may be used, such as for example (1) different lateral positions on vertical side sections the end portions 104B, 104C for upward/downward motion (see, e.g. 172'), (2) underside positions on the in-turned horizontal bottom sections of the end portions (see, e.g. 172"), or other top-side positions on the top portion 104A (see, e.g. 172'"). Any of these positions or others may be used which may be beneficial in certain firearm installations depending on the layout of the firing mechanism components. Various embodiments contemplated may include more than one operating protrusion 172 comprising any combination of the foregoing possible locations. This would allow the actuator 180 to block and/or release more than one firing component Design Considerations Design criteria for implementation of a fast action shock invariant magnetic actuator in a firearm creates numerous challenges. The actuator preferably should be capable of mechanical displacements suitable for either blocking or releasing mechanical devices such as on a firearm. For example, the actuator may be configured for releasing functionality to directly release an energy storage device in the form of a striking member such as a rotatable spring-biased hammer as shown in FIG. 1 (or alternatively a spring-biased linearly movable striker shown in FIG. 37), or the actuator may indirectly release the energy storage device through releasing an intermediary firing mechanism component or linkage such as without limitation the sear for example, thereby allowing the firearm to fire as in FIG. 2. As shown in FIG. 1, the actuator unit incorporates the sear, which is operable via mating latching surfaces to hold or release the hammer. Alternately, the actuator may be configured for blocking functionality disable a trigger or intermediate components of the firing mechanism between the trigger (e.g. trigger bar, disconnector, blocker, etc.) and the energy storage device, thereby preventing the firearm from being fired as shown in FIG. 3. An actuator could also be used to enable or disable other actions on a firearm, including bolt release, round feeding, magazine release, and well as many applications both related and unrelated to firearms. These applications are only briefly noted here.

It bears noting that the actuator may be oriented within or on the firearm frame to produce motion of the rotating member in any number of possible directions and orientations, including for example without limitation forward/rearward, up/down, laterally side to side, or any direction and orientation therebetween. Motion may be parallel to, transversely to, or obliquely to the longitudinal axis of the firearm defined by the bore of the elongated barrel which chambers an ammunition cartridge. The direction and orientation of motion will be dictated at least in part by the arrangement and location of the firing mechanism components in the firearm with which the actuator interacts, and the overall physical design of the firearm package.

In different embodiments, the actuator preferably should be physically small enough to fit within the handgun (e.g. pistol or revolver) or long gun (e.g. shotgun, carbine, or rifle), or be appended thereto preferably without adding undue bulk to the firearm. The volume to force ratio of the actuator is desired to be as low as possible. The optimal actuator will be strong enough to operate directly on the energy storage device (i.e. spring-biased hammer or striker) as seen in FIG. 1; however, practical designs could be limited to force/displacement combinations in certain firearm platforms that operate on a sear or other intermediate mechanical parts of the firing mechanism between the trigger and energy storage device as seen in FIG. 2.

In certain non-limiting embodiments, the actuator preferably should also be capable operating from a portable electric power source such as battery power, with batteries suitable for packaging within the firearm. This imposes certain power restrictions. This also suggests that actuation must either be bistable and fast-acting or be timed to a transient timed event. Practically, because of power consumption considerations, it is preferable the actuator not be held under active electrical power for indeterminate durations to conserve battery life.

Firearms must be capable of withstanding very large randomly unidirectional shocks, such as those encountered in a drop test. Some state regulations such as Massachusetts, New York, and California mandate drop tests. Drop testing is a means to determine whether a handgun will fire after being dropped onto a hard surface from a specified distance. An actuator for use in the firing mechanism of a firearm must therefore be immune to changing states or positions from such a shock. This practically eliminates most linear actuator designs from consideration.

Actuation speed must be consistent with normal rapid firearm cycle times. For example, if an actuator releases a hammer or striker, then the state change must be capable of being reset at speeds that are faster than those demanded by the natural cycle time of the reciprocating slide or bolt such as used in the actions of semi-automatic firearm to discharge a round and unload/load cartridges from the barrel chamber. In general, the actuator must generally be very rapid acting, on the order of milliseconds, not hundreds of milliseconds.

Figure 4:
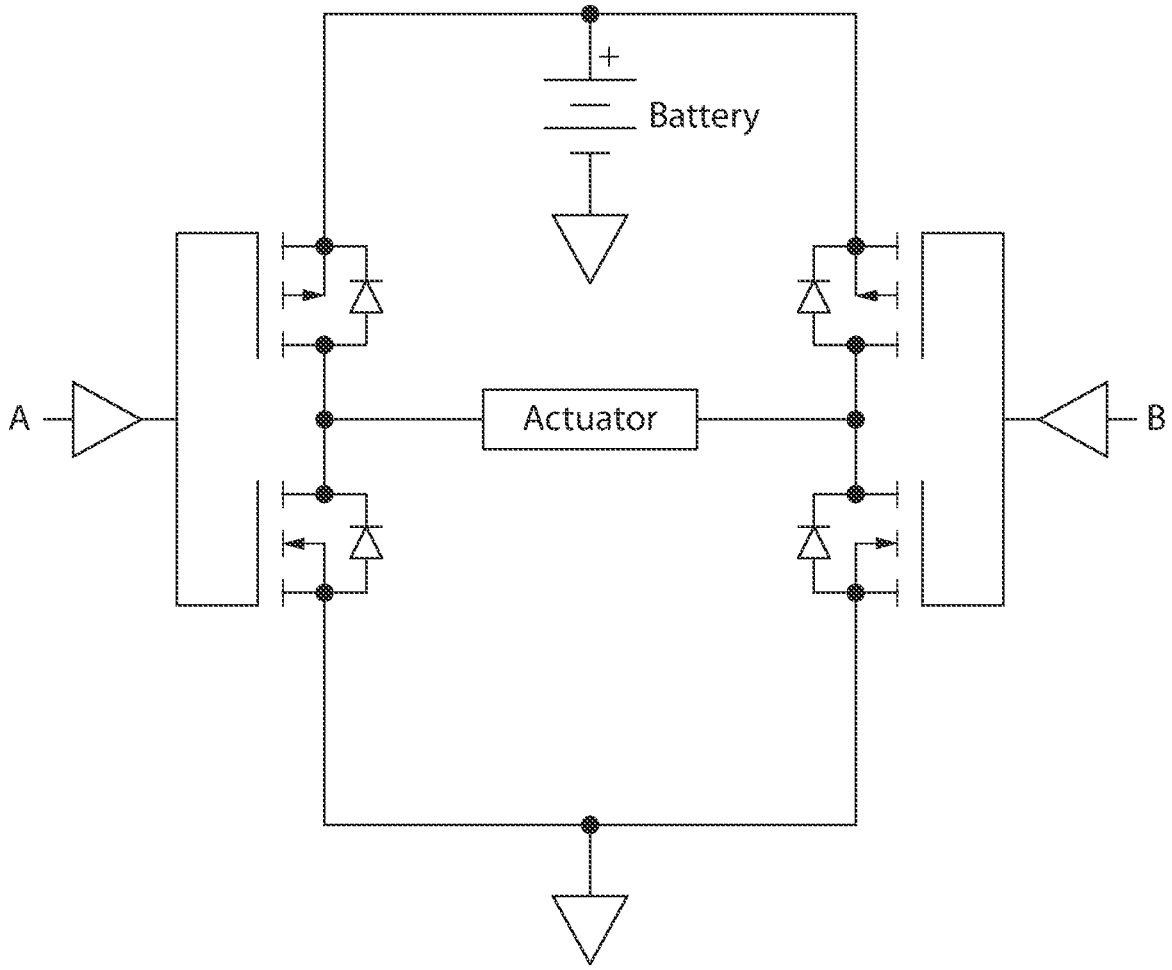
FIG. 4 is an electrical diagram showing a representative simple solid-state switching control circuit with battery for driving the actuator.

In certain non-limiting embodiments, the actuator preferably should be capable of being controlled by low-level logic signals with minimal intermediate circuits. The best design will use simple switching circuits such as transistors, FETs or other solid-state switches. Minimal voltage scaling from raw battery voltage is optimum as shown in FIG. 4.

In certain non-limiting embodiments, the actuator preferably should have a usable cycle lifetime equal to or better than the cycle lifetime of the firearm. Firearms experience very harsh operational conditions including chemical contamination from ammunition powders and cleaning solutions, dust and grime from outdoor use, thermal extremes, and shock and vibration from firing. The actuator must be capable of operating successfully in these conditions. This suggests a minimum force which can be practically tolerated is related to the frictional forces required to clear the actuation path from oil and dirt. The imposition of a minimum force, in practice, suggests the actuator is limited in how small it can be made.

Technology Considerations

Several core technologies may be considered for use of a non-conventional actuator in the firing mechanism of a firearm, including for example: piezo actuators, linear solenoids, gear motors, brushless electric DC (BLDC) motors, and custom magnetics. However, these technologies are not ideally suited for use in a firearm and fail to meet the foregoing design criteria described for the following reasons.

For example, piezo stack actuators coupled with mechanical displacement multipliers were considered and tested. Advantages include high-speed and low-power. Disadvantages include high-cost, piezo stack failure due to mechanical or electrical shock, and very high drive voltages, requiring complex power supplies.

Commercially-off-the-shelf (COTS) linear solenoids are readily available. Advantages are cost and availability. Disadvantages include susceptibility to drop test failure, contamination failure and low nonlinear force profiles.

DC gear motors are used in many consumer products and in the hobby toy industry. Advantages are high linear force and relatively low power. Disadvantages include very slow actuation speed, susceptibility to jamming and damage in the drive system due to inherent complexity and fragility, and relatively short unpredictable lifecycles.

Brushless Electric DC (BLDC) Motors are gaining widespread use in many industries. BLDC motors offer the highest shaft power to weight ratios in industry. When used as a short-stroke actuator; however, the magnetic configuration yields low force to physical volume ratios. The absence of a suitable COTS solution motivated an investigation into a custom magnetic actuator specifically designed for gun applications.

Functional Use Categories

As noted above, the application of the present electromagnetic actuator 100 according to the present disclosure to the firing mechanism of a firearm for discharging the firearm can generally be described in two ways: (1) a release actuator; or (2) an enabling/disabling actuator. Examples of each application is now described in further detail below.

Release Actuator

A release actuator 100 is intended to directly or indirectly release the energy in the energy storage device (e.g. spring-biased hammer or striker) which is movable to strike a chambered cartridge positioned in the barrel of the firearm. If the sear is built into the actuator, then the actuator is directly releasing the hammer or striker as shown in FIG. 1. If the sear is a secondary component, then the actuator could release the sear which in turn releases the hammer or striker as shown in FIG. 2. In either case, energy applied to the actuator directly results in the firing of the weapon.

A release actuator 100 always receives an electrical actuation signal synchronous with the firing of the gun. That is, the state of the gun is known at the time of the actuation, and the duration of the actuation can be a fixed timed event as shown in FIG. 5, or it can be a momentary event which is terminated when a property of the actuator is sensed to show that mechanical actuation is complete as shown in FIG. 6.

Figure 5:
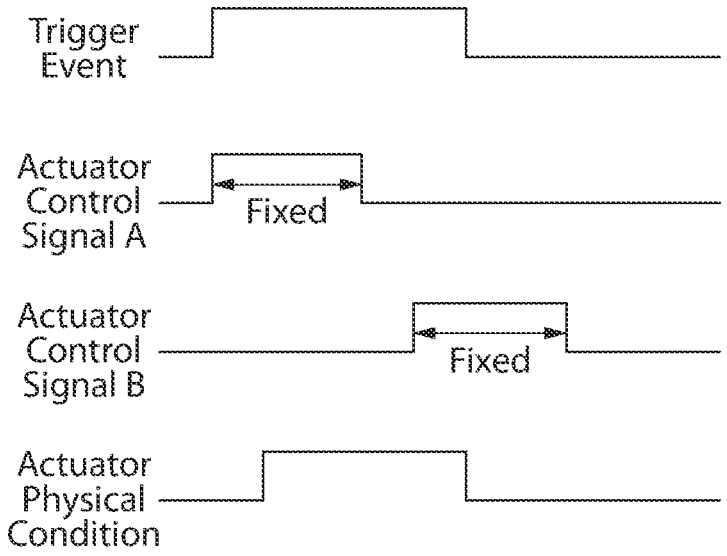
FIG. 5 is a high level control diagram showing fixed timed event actuation duration.

In FIG. 5 the trigger event could be a physical trigger switch or control signal from any number of implementations that indicates the timing of the actuator state change request. When a state change is desired the control Signal A is held on for a fixed duration which biases the actuator to change state. The control Signal A is held on for a period of time that is longer than the expected actuator state change timing to insure that the actuator has completed movement. At a later time control signal B is held on for a fixed duration which biases the actuator to return to its previous state. Again the control signal B duration is held on for a period of time that is longer than the expected actuator state change timing to insure that the return movement has completed.

Figure 6:
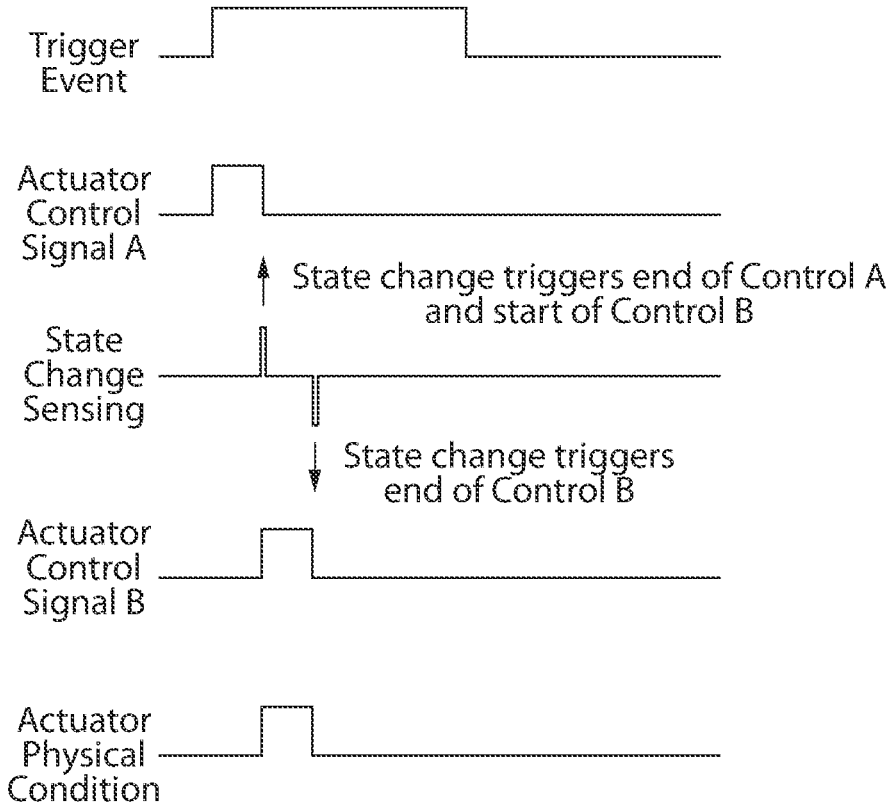
FIG. 6 is a high level control diagram showing a momentary event actuation duration with closed loop feedback.

In FIG. 6, closed loop feedback is used to greatly speed the reset timing of the actuator and to greatly minimize the amount of energy expended for each actuation. The trigger event indicates the timing of the actuator state change request. When a state change is desired, the control Signal A is held on for only the amount of time necessary trip the actuator. Fluctuation in the drive current of the actuator or a movement sensor are options that may be used to detect or sense a state change. The state change sensing signal is used to provide positive control feedback such that control signal A is terminated when the very first sign of movement is detected. Concurrent with turning off control signal A the reset control signal B is driven high to quickly reset the actuator for the next event. Again the movement of the actuator is used as feedback to terminate the control signal B to again minimize energy usage and minimize the cycle time of the actuator so that it is ready for the next event. Details of embodiments for closed loop feedback means will be discussed in further detail in a later section.

Enabling/Disabling Actuator

Figure 23A:
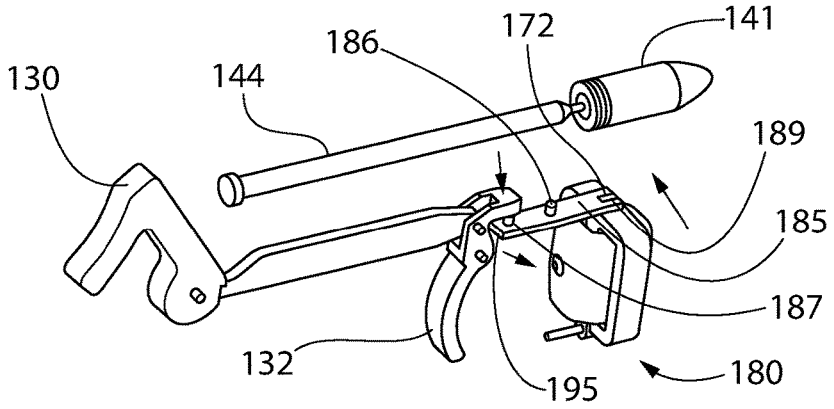
FIGS. 23A and 23B are schematic perspective and side views respectively of an enable/disable actuator in a firearm directly blocking the trigger of the trigger-operated firing mechanism.
Figure 23B:
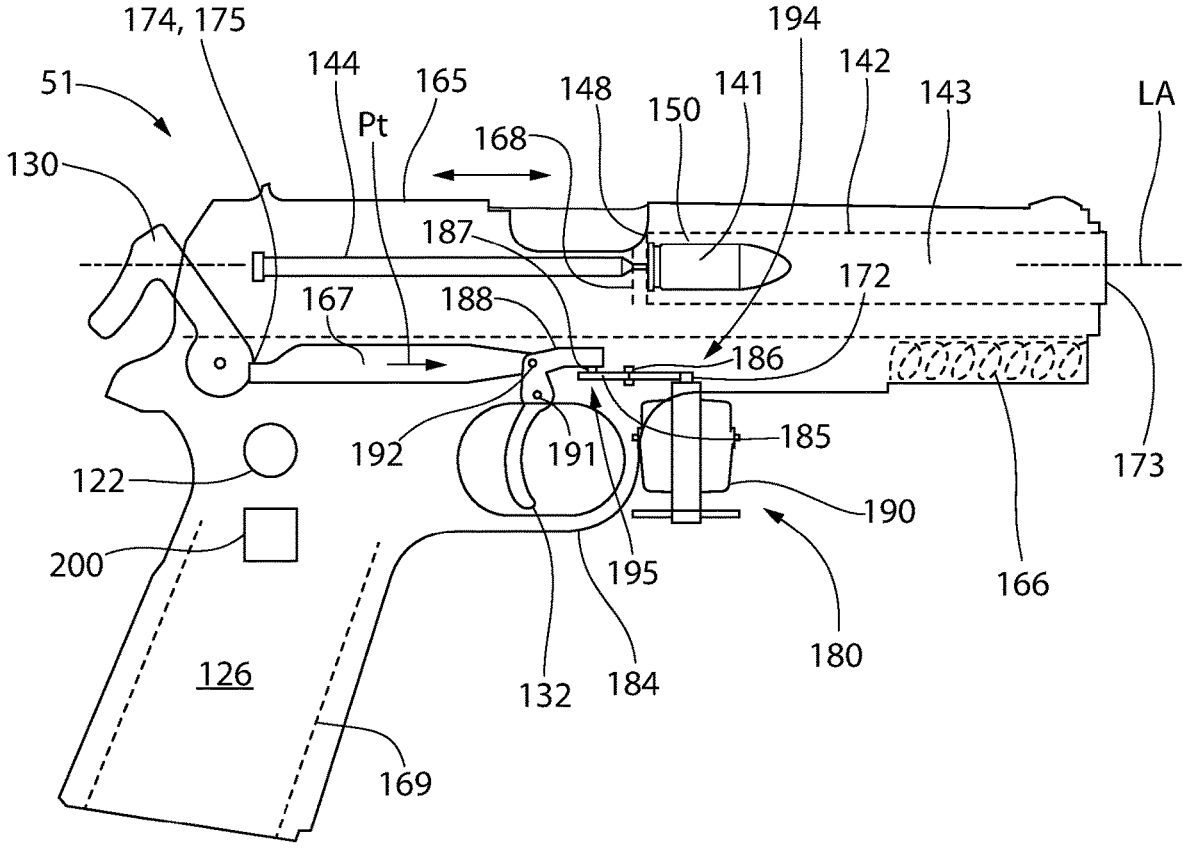
Figure 24A:
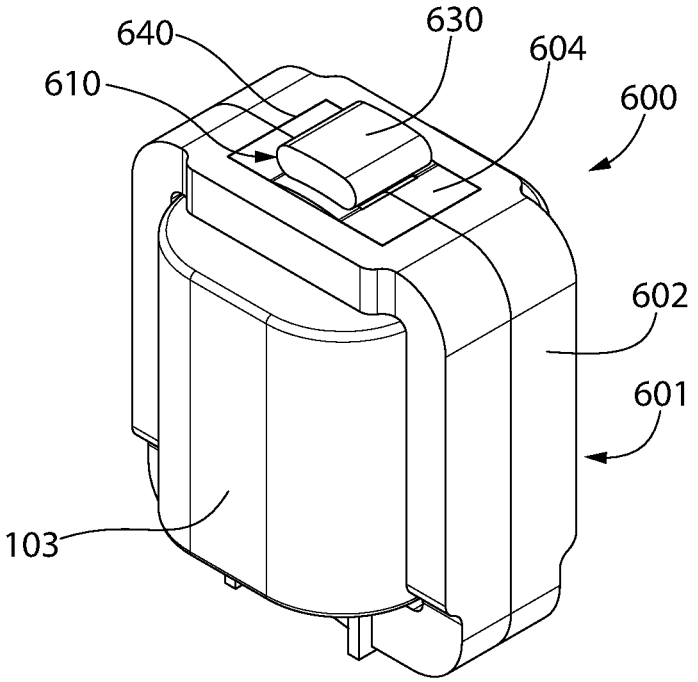
FIGS. 24A and 24B are top and bottom perspective views respectively of an alternative embodiment of an electromagnetic actuator with sheathed or shrouded rotating member.
Figure 24B:
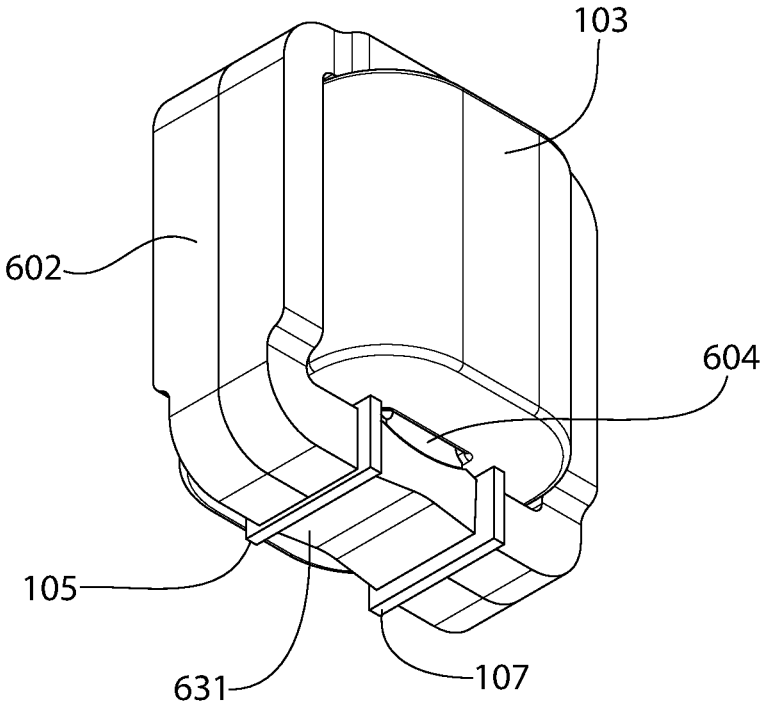

An enabling/disabling actuator 100 acts on some component in the mechanical fire control mechanism of the firearm. FIGS. 3, 23, and 24 show some non-limiting examples of how an enabling/disabling actuator may be implemented in a firearm. In general, such an actuator acts to enable or disable the normal mechanical firing of the gun. The distinction is that this type actuator supplies no energy to release stored energy in the spring-loaded hammer or striker like in a release actuator format.

Whereas a release actuator is always synchronous with the firing of the firearm, an enabling/disabling actuator may be synchronous, but may also be configured to be asynchronous with the firing of the firearm. In the case of asynchronous actuation, the state of the firearm may not be fully known at the time of actuation. It is possible that the firearm could be in a state that mechanically blocks the actuator from completing its action. In this case, control logic must be incorporated within the activating circuit to complete the action when the firearm is in a proper state. A non-limiting example of an enabling/disabling actuator control logic flowchart is shown in FIG. 7.

As a clarifying example, consider a disabling actuator that interferes with the trigger bar by engaging a slot in the trigger bar as shown in FIG. 3. If the trigger is fully pulled at the time of actuation, the position of the trigger bar may be such that the engaging slot is not aligned with the operating protrusion 172 of the actuator. Thus the trigger bar interferes with the actuator moving to the intended position due to the misalignment of mating features. In this case, the control or drive logic must either sense that the trigger is pulled and delay actuation, or the drive logic must sense that the actuation did not succeed in moving and try to complete the action redundantly according to a schedule as shown in control logic of FIG. 7.

Figure 7:
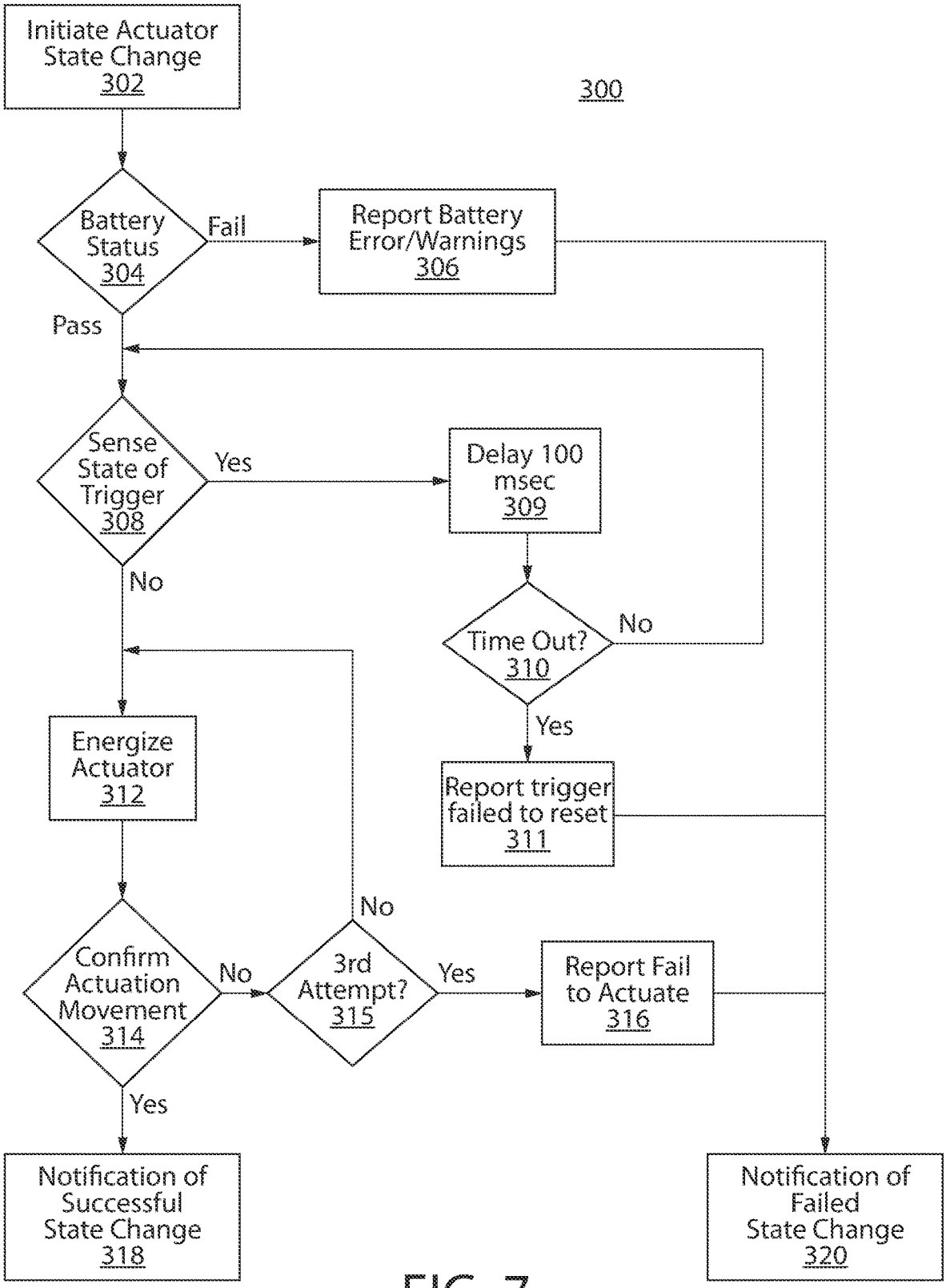
FIG. 7 is an example of an enabling/disabling actuator control logic flowchart.
Figure 17A:
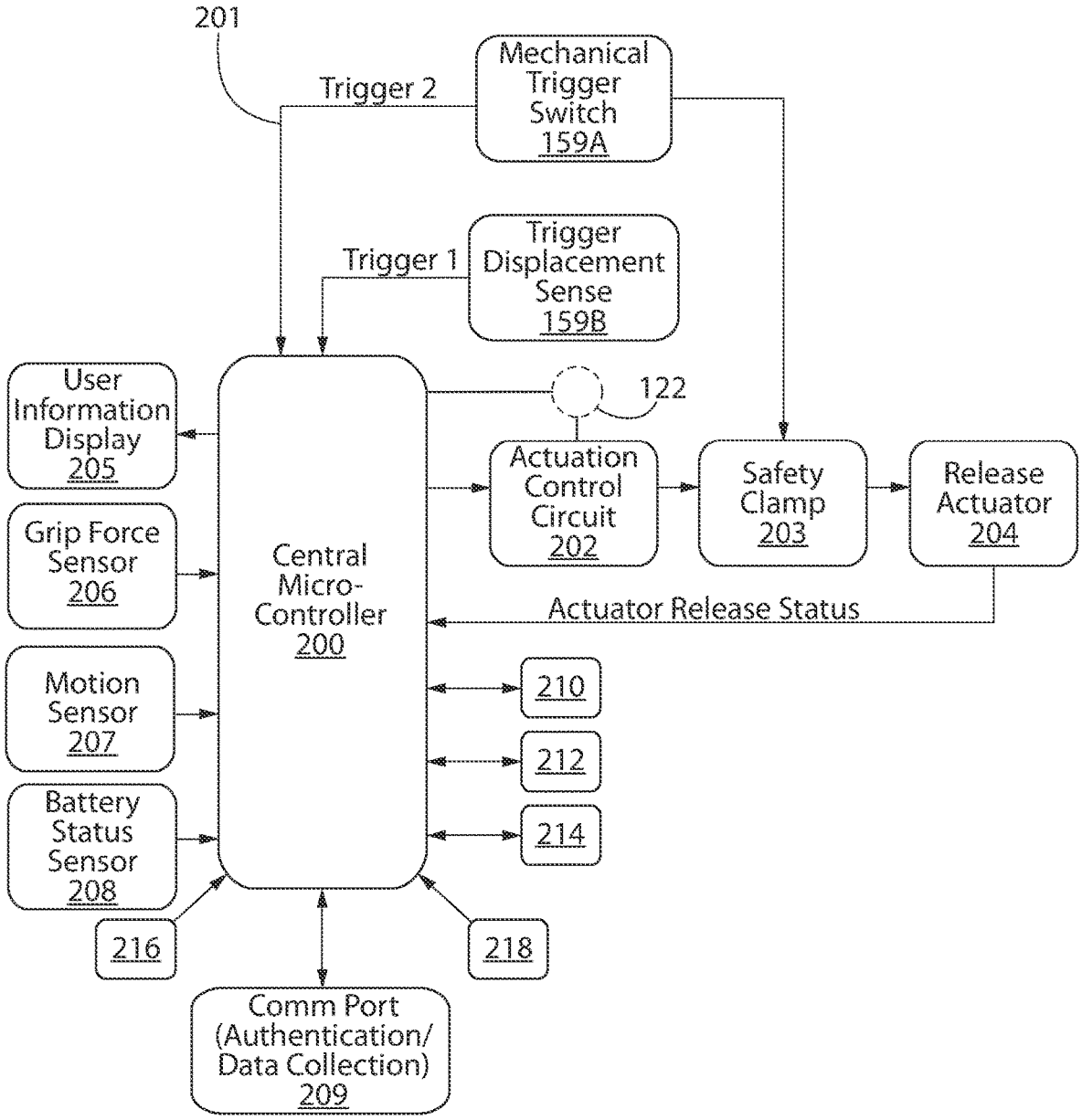
FIG. 17A shows a system block diagram of a microcontroller controlled direct release actuator system with additional features such as trigger sensing, grip sensors, acceleration sensors, and external communications supporting authorization and authentication access control.
Figure 17B:
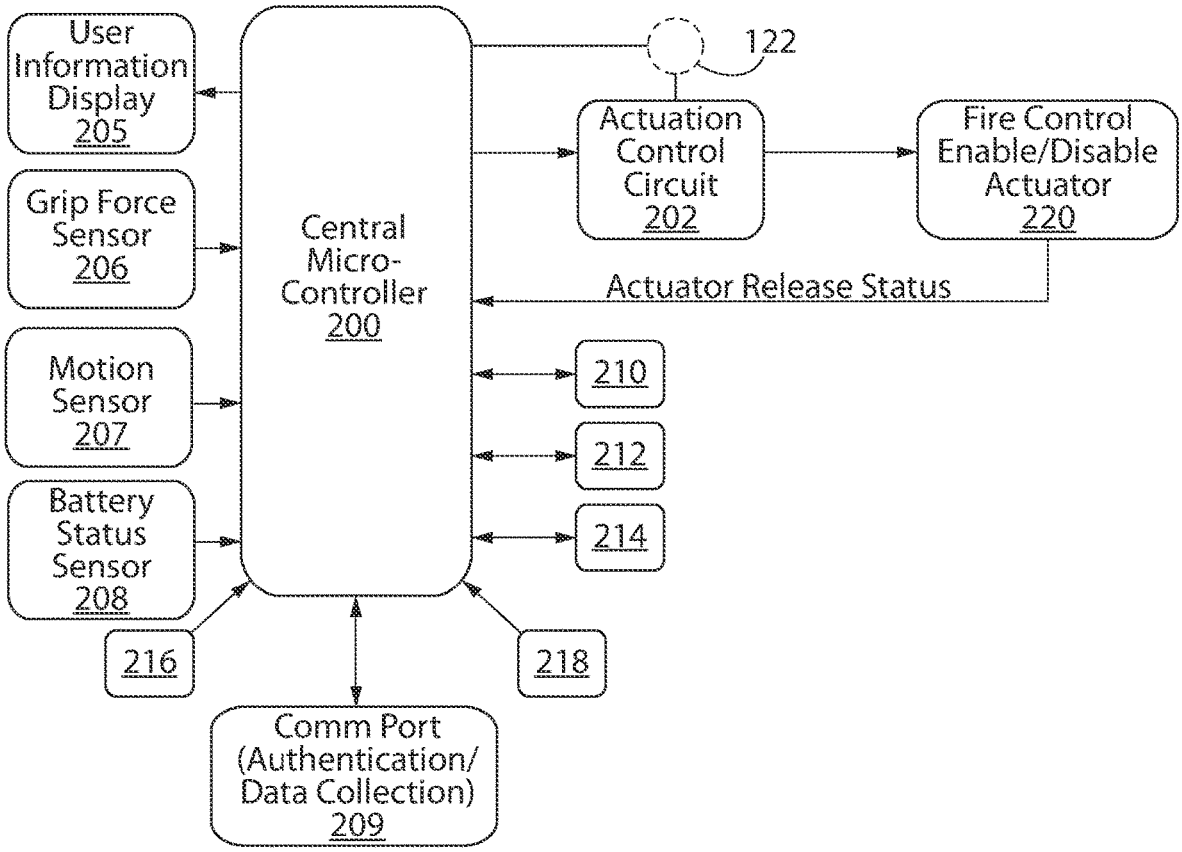
FIG. 17B shows a system block diagram of a microcontroller controlled enable/disable actuator system with additional features such as trigger sensing, grip sensors, acceleration sensors, and external communications supporting authorization and authentication access control.

Referring now to FIGS. 7 and 17B showing a system block diagram of actuator 100 in a system configured for enabling/disabling operation, the enable/disable control logic process 300 implemented by programmable microcontroller 200 starts with microcontroller sending a signal to actuator 100 to change state or position via the actuation control circuit 202. The microcontroller first performs a test to check the status of the battery 122 in Step 304. The battery sensor 208 senses and provides status information to the microcontroller. If the battery charge level is too low to operate the system or there is an equipment problem with the battery ("fail"), a battery error or warning low is reported to the user (Step 306). The actuator 100 is not energized and the user is notified of the failure to activate the actuator (Step 320). If the battery test proves acceptable ("pass"), control passes to Step 308.

In Step 308, the state or position of the trigger 132 is sensed by the microcontroller (i.e. trigger pulled or not pulled). The trigger sensors 159A and/or 159B sense and provide the trigger positional status to the microcontroller. If the microcontroller senses that the trigger has already been pulled at the time the actuator actuation signal is initiated ("yes"), a preprogrammed delay timer is activated (Step 309). The system will continue to check the status of the trigger for the duration of the delay time to determine if the trigger has been reset (i.e. no longer in a pulled position and in a forward ready-to-fire state). If the timer times out and exceeds the preprogrammed delay time as determined in Step 310, this condition is indicative of a trigger malfunction. The microcontroller reports the trigger rest failure to the user in Step 311 and the user is notified of the failure to activate the actuator (Step 320). However, if conversely the trigger 132 resets before the delay time is exceeded ("no" response returned in Step 308 indicating trigger is not in a rearward pulled position), the actuation signal is passed to the actuator 100 in Step 312 and the actuator is energized (see also block 220, FIG. 17B). The "no" response indicates the trigger bar slot 183 is laterally and axially aligned with the actuator operating protrusion 172 so that changing position of the actuator will engage the two mating features to block movement of the trigger bar 167 and firing mechanism.

In Step 314, the microcontroller performs a test and checks to confirm that the actuator 100 has physically changed position. If a "no" response is received by the microcontroller 200, control passes to the test of Step 315. The microcontroller is preprogrammed with "X" number of attempts that will be attempted by the system to activate the actuator before the process is discontinued. In one non-limiting example, X may equal 3 attempts; however, more or less attempts may be used. If the actuator 100 is still not activated after X attempts, the actuator failure is reported to the user in Step 316 and the user is notified of the failure to activate the actuator (Step 320). If the actuator is activated before X attempts ("yes" response in test Step 314) or the first time ("yes" response immediately in Step 314), the user is notified of the same in Step 318. It will be appreciated that numerous variations of the process may be used in other implementations.

It bears noting that if the system is configured for "enabling/disabling" operation, the actuator operating protrusion 172 is automatically engaged with blocking slot 183 in the trigger bar 167 as the default position when the system is energized. Position of the actuator may change to actuate the actuator and disengaged the operating protrusion from the slot when activated by the occurrence of one or more events which are monitored by the microcontroller 200. The events may include without limitation proper authentication confirmation (further described herein), a trigger pull, grip force sensor indication, motion sensor (e.g. accelerometer), battery status, etc. This forms a multi-layered safety system intended to avoid unintentional and/or unauthorized firing of the firearm.

Actuator Action Categories

The actuators described herein may be configured to operate in a variety of ways that have applicability to firearms or other devices. In a first mode of operation, an actuator can be configured to be either momentary acting or bistable. In the case of a momentary actuator, electrical energy will move the actuator from a rest position to an active position. When the electrical signal is removed, an external force (usually imparted by a spring, slide, bolt, or other component of a firearm) is required to move and reset the actuator back into the rest position (see, e.g. FIG. 8).

Bistable actuators move between two magnetically stable positions A and B. Electrical energy is always supplied to move from position A to B. Either electrical energy or optionally an external force can be used to move from position B back to A. Bistable actuators can be either synchronous or asynchronous. Energy is only supplied to the actuator from the power source during the transitions, thereby conserving battery life.

In a second mode of operation, an actuator can be configured to be either single or dual acting. A single acting actuator moves under electrical power to a single position. A dual acting actuator can be driven under electrical power to one of two positions. A momentary actuator is usually but not necessarily single acting. Bistable actuators may be either single acting or dual acting.

Drop Test Compliance

To achieve drop test compliance, an actuator for a firearm optimally should have at least three properties: (1) they must have a principle rotating member; (2) the center of rotation must be mathematically sufficiently close to the center of mass of the rotating member; and (3) interacting surfaces between the actuator rotating member and accompanying external mechanical parts must be designed such that force from the external part cannot apply a net torque on the rotating member to force a position or state change. The first two properties ensure that the actuator as a stand-alone component is insensitive to a random direction, high-force, linear shock such as those experienced in a drop test. The last property ensures that an external component, under shock forces, cannot force a state change on the actuator. If these properties cannot be satisfied, then external safeties must be designed to ensure drop test compliance. In the case of a momentary actuator, the necessity of an external spring makes satisfying these conditions increasingly complex or impossible. For this reason, one preferred but non-limiting embodiment of this invention is focused on bistable, intrinsically drop test compliant designs.

Target Design Categories

The present invention relates to both release and enable/disable, drop test compliant bistable actuators, either single or dual acting. The core design principles are similar in all cases. The design distinctions are principally defined by the use case.

Core Design Principles

Basic magnetic actuator design uses "soft" magnetic materials to focus magnetic flux into a geometrically designed air gap such that the magnetic flux within the air gap produces a mechanical force across air gap. Soft magnetic materials have large magnetic permeability, where the permeability is defined as the ratio of the produced magnetic flux density to the magnetizing field. Refer to Equation 1.

$$\vec{B} = \mu\vec{H}. \qquad \text{Equation 1}$$

Where $$B \equiv \text{magnetic fluxdensity} \qquad \text{Equation 2}$$

$$H \equiv \text{magnetizing field}$$

$$\mu \equiv \text{permeability.}$$

This can be restated in terms of the permeability of free space.

$$\mu = \mu_0 \mu_r. \quad \text{Equation 3}$$

Where $$\mu_r \equiv \text{relative permeability} \quad \text{Equation 4}$$

$$\mu_0 \equiv \text{permeability of free space}$$

$$\mu = 4\pi \times 10^{-7}\left(\frac{H}{m}\right).$$

Various magnetic materials may be suitably used; however, since magnetic actuators are relatively low-frequency devices, magnetic hysteresis is relatively unimportant. Low carbon steels can be suitably used for magnetic flux densities up to 1.5 to 2.0 tesla (T). Many more exotic materials are available at increased cost and increased manufacturing complexity.

The use of soft magnetic materials and well-defined air gaps allow the designer to approach the design of magnetic circuits similarly to the design of DC electrical circuits, with relationships that parallel Ohm's Law.

In electrical circuits we have the relationship for Ohm's Law.

$$V = I \times R. \quad \text{Equation 5}$$

In magnetic circuits a similar relationship can be used.

$$NI = \phi \times R \text{ where} \quad \text{Equation 6}$$

$$NI \equiv \text{amp turns in driving force}$$

$$\phi \equiv \text{flux in } Tm^2$$

$$R \equiv \text{reluctance in } \frac{A}{Tm^2}.$$

Reluctance for a uniform rectangular air gap is given by the following.

$$R = \frac{l_g}{\mu a_g} \text{ where} \quad \text{Equation 7}$$

$$l_g \equiv \text{length of air gap, and}$$

$$a_g \equiv \text{area of the air gap.}$$

In terms of an air gap, the flux in Equation 6 can be approximated as follows.

$$\phi = B \times a_g. \quad \text{Equation 8}$$

Figure 11A:
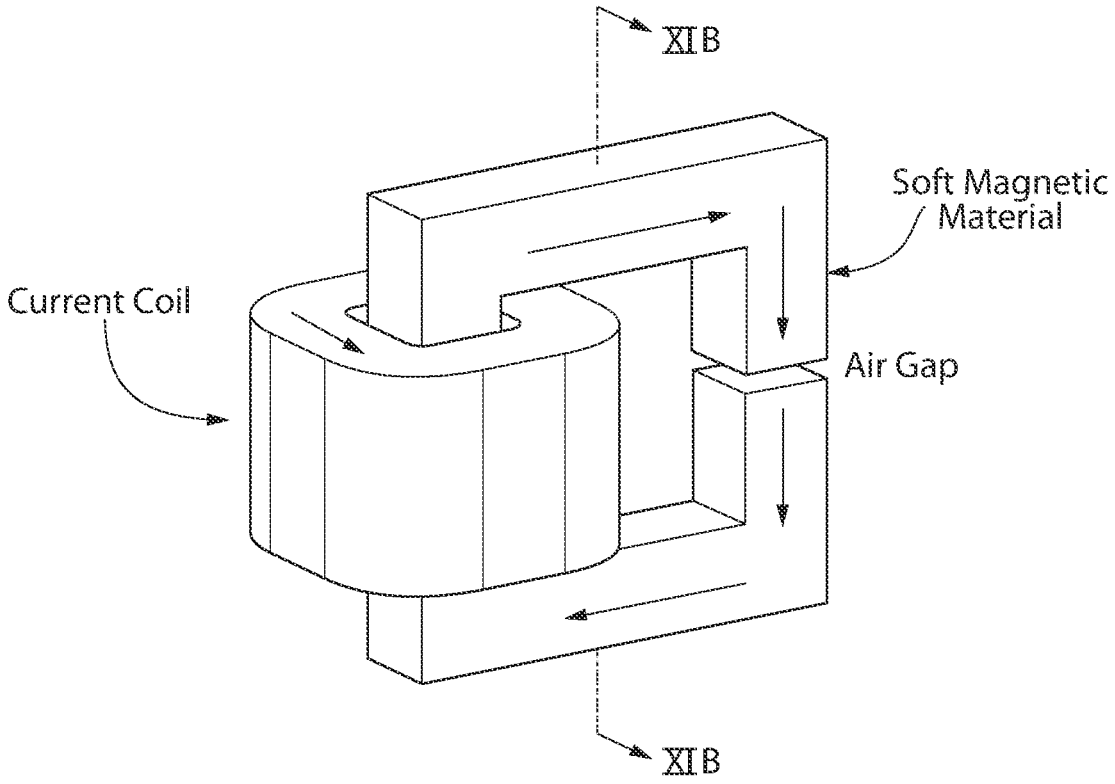
FIG. 11A is a perspective view of a first order theoretical model or embodiment used to predict magnetic flux density in an air gap.
Figure 11B:
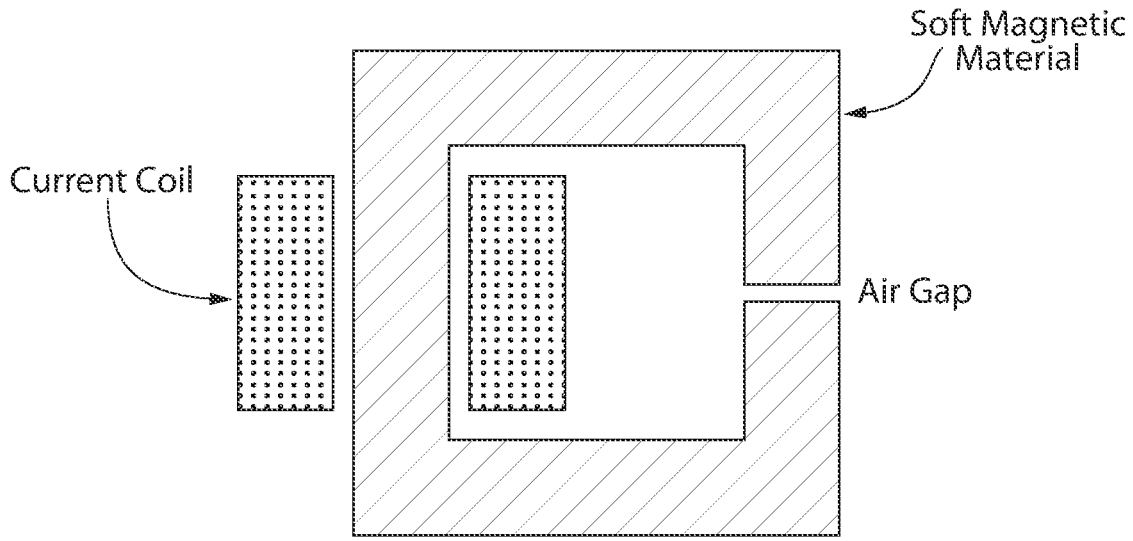
FIG. 11B is a cross-sectional view thereof.
Figure 12A:
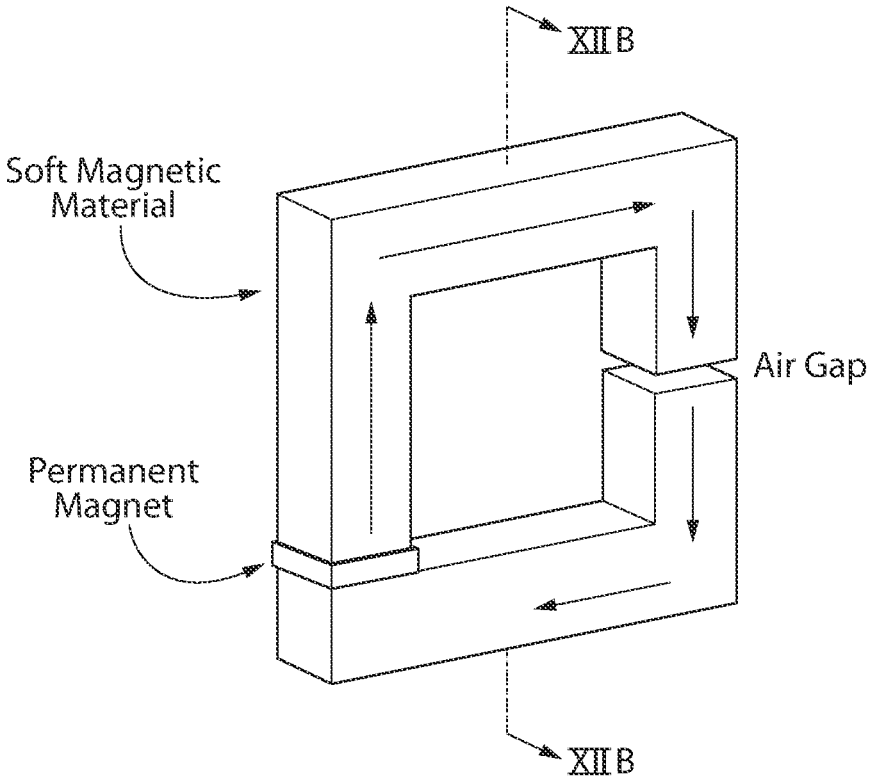
FIG. 12A is a perspective view of a first order theoretical model or embodiment used to predict magnetic flux density in an air gap and utilizing fixed permanent magnets to generate a static bias.
Figure 12B:
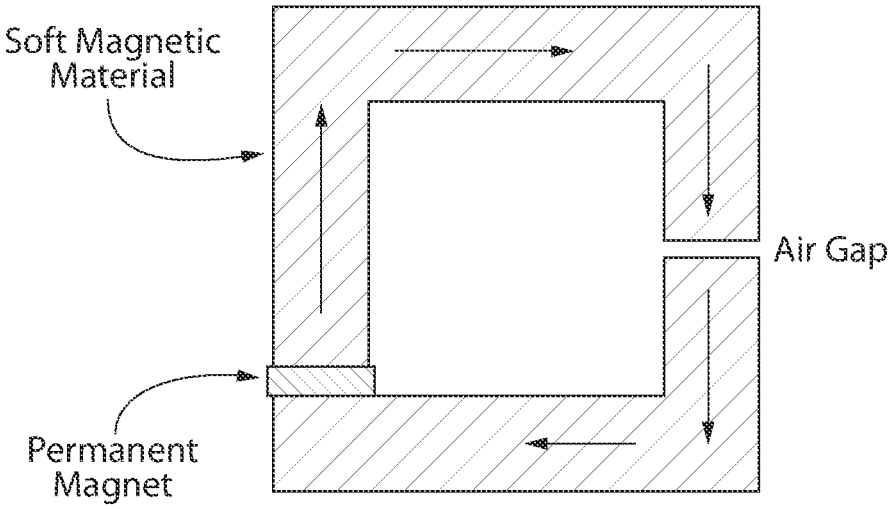
FIG. 12B is a cross-sectional view thereof.

For a first order approximation, the above equations may be used to predict the magnetic flux density in an air gap produced by applying current through an external conductive coil wrapped around the magnetic material as shown in the theoretical model of FIG. 11. Furthermore, it can be shown that instead of using an external conductive coil wrapped around the magnet material, flux density can be created within the magnetic yoke by inserting a fixed permanent magnet into the magnetic circuit as shown in the theoretical model of FIG. 12. If the permanent magnetic permeability is suitably high, as in the case of Neodymium rare earth magnets, then the effect of the magnet is nearly equivalent to a geometrically identical air gap coupled with a fixed current external coil.

This principle can be exploited to produce static biases within the magnetic circuit which, when coupled with the variable reluctance of a changing air gap, forms the basis for a bistable magnetic actuator. The forces achieved by such actuators are driven by the magnetic flux density within the air gap and are expressed below.

$$F = \frac{1}{2}\frac{B^2}{\mu_0} a_g. \quad \text{Equation 9}$$

Figure 13A:
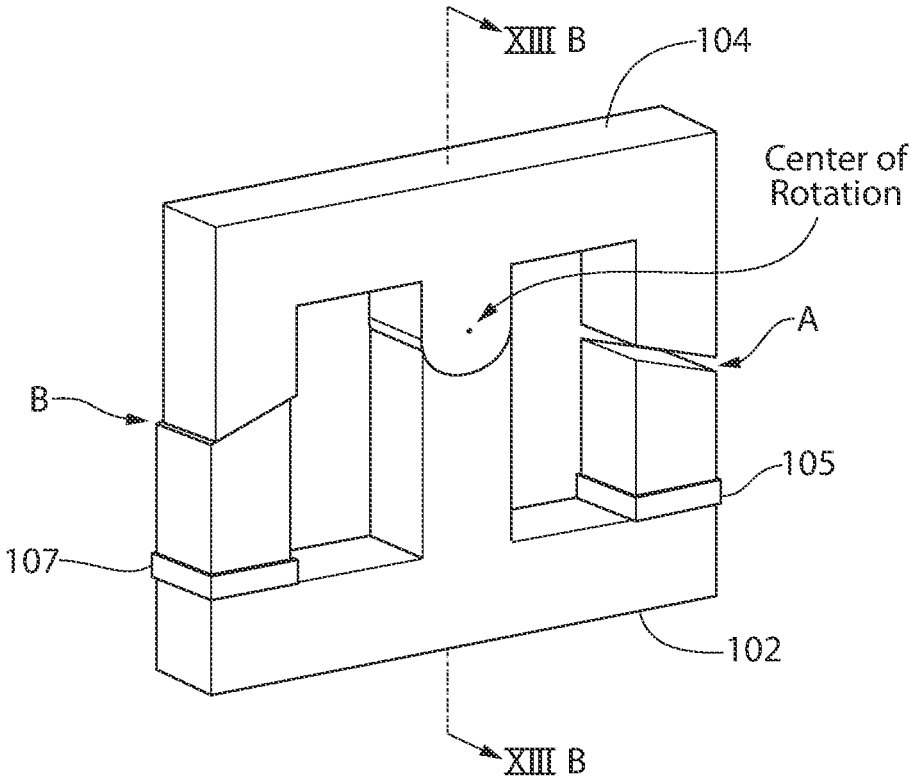
FIG. 13A is a perspective view of a theoretical magnetic actuator model or embodiment utilizing permanent magnets and the shape of the magnetic central yoke to form a group of three circulating magnetic flux circuits.
Figure 13B:
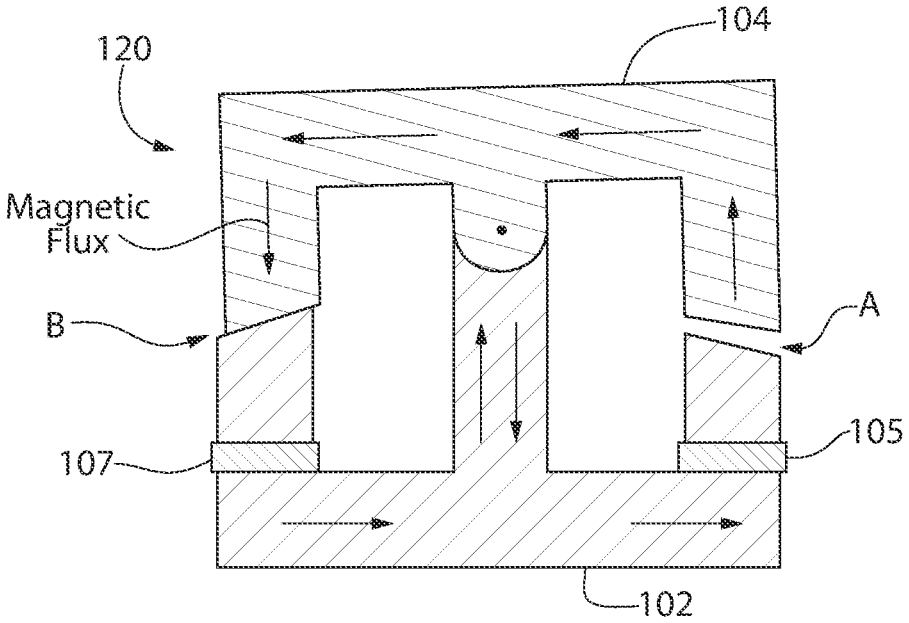
FIG. 13B is a cross-sectional view thereof.

Thus, it can be shown that the force within the air gap increases with increasing air gap cross-sectional area and decreases with the square of the length of the air gap. Consider FIGS. 13A, 13B, and 14B for example. The permanent magnets and the shape of the magnetic yoke form a group of three circulating magnetic flux circuits: (1) the loop or circuit A on the right; (2) the loop or circuit B on the left; and (3) the outer loop or circuit C. Because the circuit A on the right has more air gap, the magnetic flux at open gap A is less than the flux at closed gap B and the rotating member is statically attracted to the pole on the left at gap B. If, however, an external force is applied to close the gap at A, at the point in time where the gap length at A starts to close, the gap at B starts to open and the combined change in reluctance causes a rapid movement of flux density to gap A and away from gap B, and the device rapidly moves to a state where the rotating member is held tightly to the pole at gap A. As shown, the process is symmetric and reversible. This design gives a very rapid, snap-acting mechanism with no physical detents or springs.

It is not necessary for the force to be a physical external force. Consider FIGS. 14A & B. In this case, an electrical current coil 103 has been placed around the central member or portion of the actuator as already described herein. If the current in the coil is in the proper direction, it will oppose the flux lines in the left magnet loop or circuit B and diminish the force at gap B. Simultaneously, it will begin to increase the flux density in the right magnet loop or circuit A and increase the force at gap A. At the point where the force begins to move the rotating member from one state to the next, the flux density rapidly increases on the closing side and rapidly decreases on the opening side causing a very fast snap action.

Drop Test Compliant Actuator Design

Firearms are subjected to drop tests to quantify that the firing mechanisms do not actuate in the absence of a trigger pull within certain parameters. One design goal of the present invention is that the actuator should be sufficiently resistant to changing states when exposed to large external linear shock forces such as those experienced by dropping the device onto a hard surface or an applied impact with a hard surface. Such linear shocks can be quantified by expressing the acceleration experienced by the actuator as some multiple, k, of the standard gravitational acceleration constant, g (9.8 m/s/s).

If the center of rotation of the actuator rotating member is located at the precise center of mass of the rotating member, then any external forces on the rotating member due to linear shock will be completely balanced about the center of rotation and the resulting moment of force (torque) on the rotating member will be zero. Hence, in the ideal design, with the center of rotation and the center of mass perfectly aligned and coaxial, the actuator will be completely immune to changing states under the influence of all external shocks and forces.

In practical terms, however, the distance between the center of mass and the center of rotation of the rotating member cannot be exactly zero or coaxial due to practical limits on manufacturing tolerances. The distance, r, between the actual center of mass and the actual center of rotation can be thought of as the length of a lever arm that transfers the external shock force as a torque acting against the holding force of the actuator. As long as the shock force transferred to the actuator as torque is below the holding torque of the actuator, the actuator will not change states. By controlling the design and manufacturing tolerances of r, the actuator can be made immune to shock forces below some specified value. The term "substantially" coaxial as may be used herein reflects consideration of the manufacturing process.

In simple terms, if the actuator is subjected to a linear shock, then the acceleration due to that shock can be expressed as some multiple, k, of the gravitational acceleration constant, g. And the resulting applied force is given by the product of mass and acceleration.

$$F=mkg,$$

where F is force, m is the mass of the rotating member, k is the multiple of gravitational acceleration, and g is gravitational acceleration (9.8 m/s/s).

The maximum possible applied torque occurs when the force is perpendicular to the lever arm and is given by the product of the force and the length, r, of the lever arm.

$$T(\max)=Fr,$$

where T(max) is the maximum applied torque,

F is force, and r is the length of the lever arm.

T(max) is the maximum applied torque experienced by the rotating member of the actuator due to an externally applied shock. When T(max) exceeds the holding torque, T(hold), of the actuator, then the actuator is subject to changing states. That is we can impose the following condition.

$$T(\max)<T(\text{hold})$$

where T(max) is the maximum applied torque from shock, and

T(hold) is the magnetic holding torque of the actuator.

For a given linear shock, T(max) can be reduced by minimizing and controlling r.

Taking into consideration many factors such as manufacturing tolerances, the operating environment, and the forces that might be encountered in our preferred firearm applications, plus a margin of safety, it is desired that the actuator should be capable of withstanding a shock force of at least 100 g. Higher shocks are preferable though.

For a given actuator of known mass and holding torque, we can then define a maximum permissible value for r.

$$r<T(\text{hold})/(m*g*100)$$

where:

r is the distance between center of mass and center of rotation of the rotating member, T(hold) is the magnetic holding torque of the actuator m is the mass of the rotating member, and 100 is the minimum linear acceleration which can be produce a state change.

Values for r which exceed the above relationship would not be suitable for firearm applications without secondary safety measures.

Resistance to External Magnetic Fields

Since magnetic force within the air gap increases with magnetic cross-sectional area and decreases with the square of the air gap length, practical designs which are optimized for force and speed tend to minimize the length relative to the cross-sectional area. A consequence of this is that actuator designs based on these design principles are inherently immune to external magnetic field interference. In practice, it is impossible to change the state of the actuator using an external magnet (and optional iron yoke) provided the rotating member is physically isolated from the external magnet by at least one air gap distance. This will always be the case in practical firearm embodiments.

Embodiment Variations

The embodiment of FIGS. 14A & B previously described above illustrates a symmetric actuator design which is bistable and dual acting. The dimensions of the yoke 102 and rotating member 104 are dimensionally similar in cross-sectional area and size on both sides of the common central portion of the actuator. The permanent magnets 105, 107 also have the same dimensions. The rotating member can be moved back and forth between the two stable positions or states by applying a pulse of current in the coil and alternating polarity. As shown in FIG. 14B, the current and force between the two locations is thus symmetric. This is optimal for a dual acting actuator moving under electrical power between two equal positions. This type actuator and its application to a firearm will be further described elsewhere herein.

By contrast, a single acting actuator 170 may benefit from an asymmetric design. An example is shown in the embodiment of FIGS. 1, 8, 15, and 37. In this case, the portion of magnetic yoke forming side A associated with air gap A could be increased in cross-sectional area and/or the permanent magnet thickness at side A could be increased in thickness and/or size as illustrated to result in a higher static force at gap A. Similarly, the portion of rotating member 104 may be concomitantly larger in cross-sectional area forming side A. This results in higher actuation force preferentially favoring side A when gap A is closed. In this case, the actuation back to the original position is accomplished by an external mechanical force derived from the firing operation of the firearm (via a moving component) or applied by the user. Optimization of the air gaps and point of rotation locations such that the center of rotation is the center of mass, will ensure the shock invariant design characteristics. This asymmetric design may be exploited in the manner exemplified in the application shown in FIGS. 8A-C having a single acting actuator in which the rotating member 104 is configured as the sear of the firearm firing mechanism.

Figure 8A:
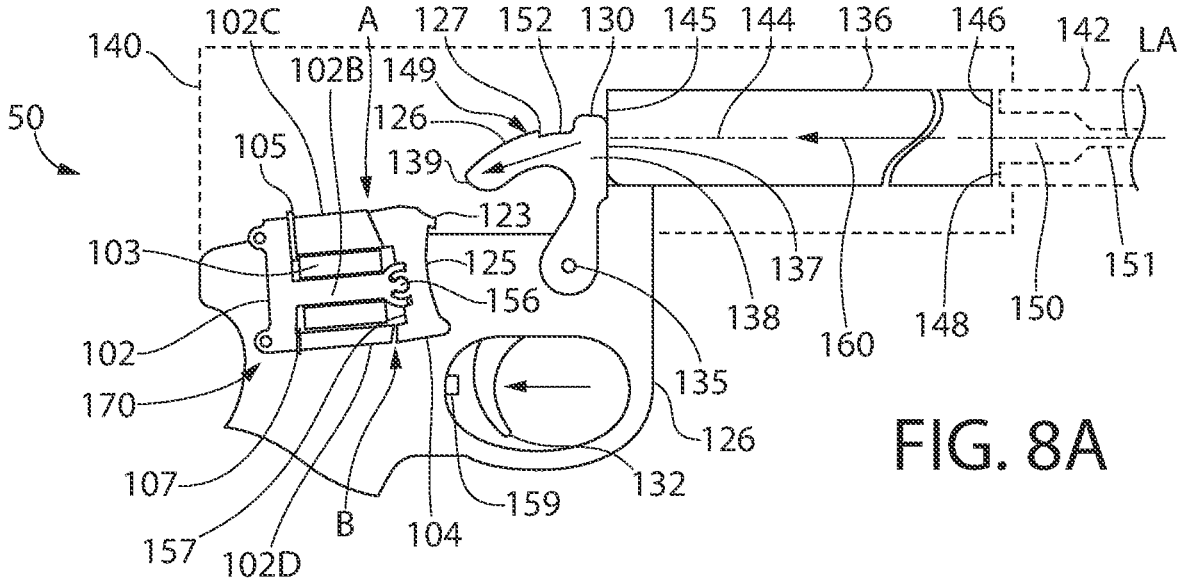
Figure 15:
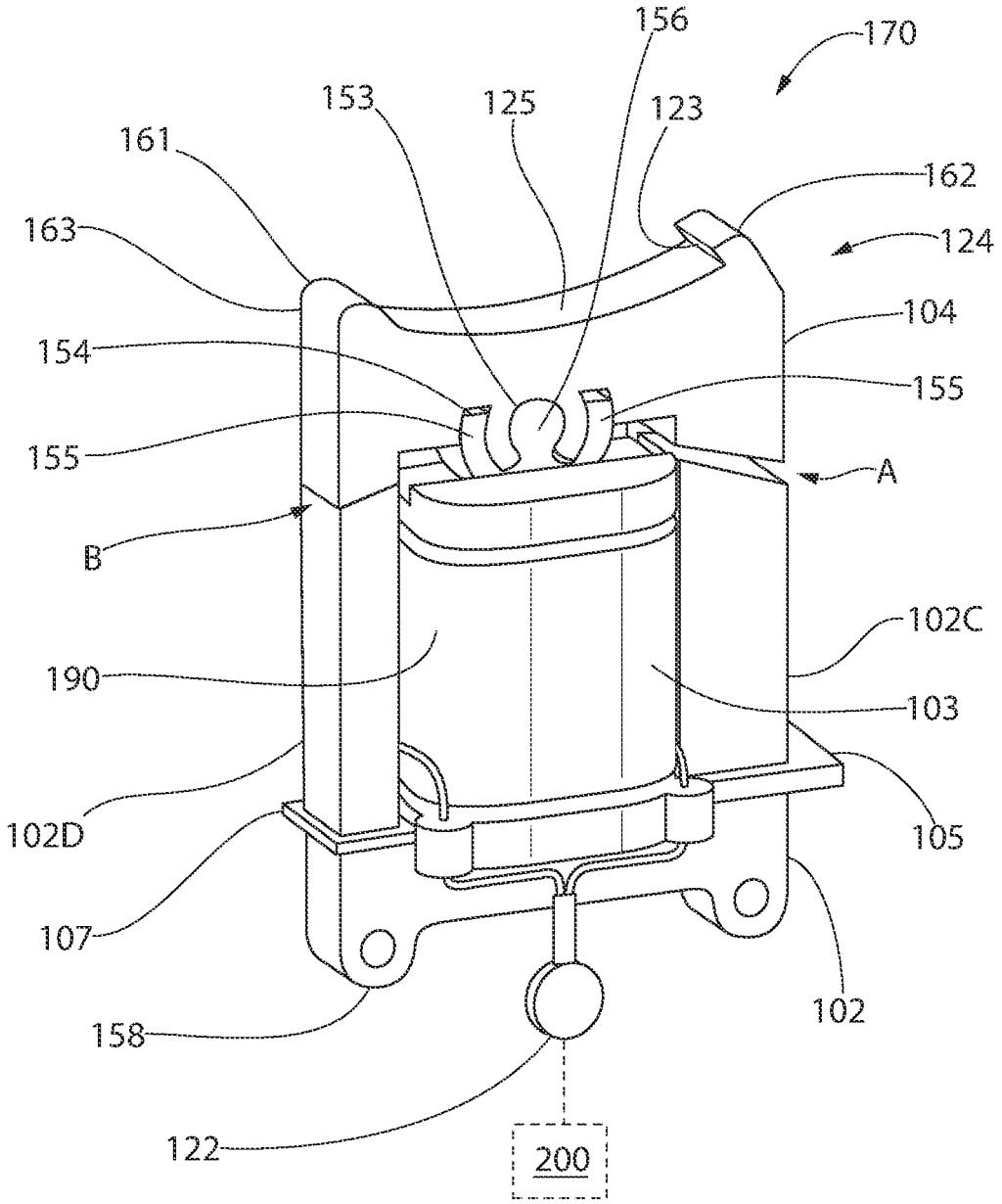
FIG. 15 is a perspective view of an embodiment of an asymmetric magnetic actuator according to the present disclosure.

Referring to FIGS. 1, 8, 15, the frame 126 and action portion of a firearm 50 is depicted including the foregoing single acting asymmetric electromagnetic actuator 170. In this example, the actuator is asymmetric including an operating protrusion in the form of a hook-shaped sear surface or protrusion 123 and actuator reset surface 125 formed integrally with the rotating member 104, thereby defining a direct release type actuator. Reset surface 125 may be arcuately concavely shape in one embodiment as shown. Sear protrusion 123 may be formed on one end 162 of sear 124 and a rounded reset protrusion 161 may be formed on the opposite end 163 (best shown in FIG. 15). Protrusions 123 and 161 project outwardly and perpendicularly from opposing ends of the reset surface 125 defined therebetween. The actuator 170 is pivotably/rotatably movable between a release position coinciding with closed air gap A/open air gap B (see, e.g. FIG. 8A) and an engaged position coinciding with open air gap A/closed air gap B (see, e.g. FIG. 1). Actuator 170, similar to all actuators disclosed herein, is configured for mounting in a firearm and may include various types and configurations of mounting features 158 including protrusions, apertures for receiving pins or screws, and/or other elements.

Figure 8B:
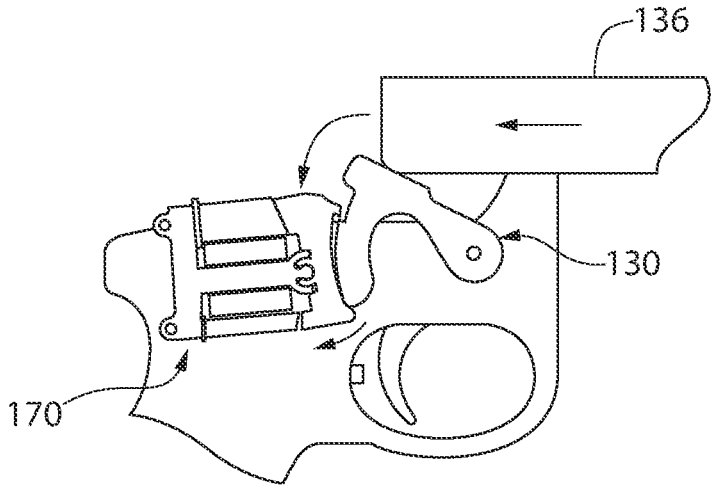
Figure 8C:
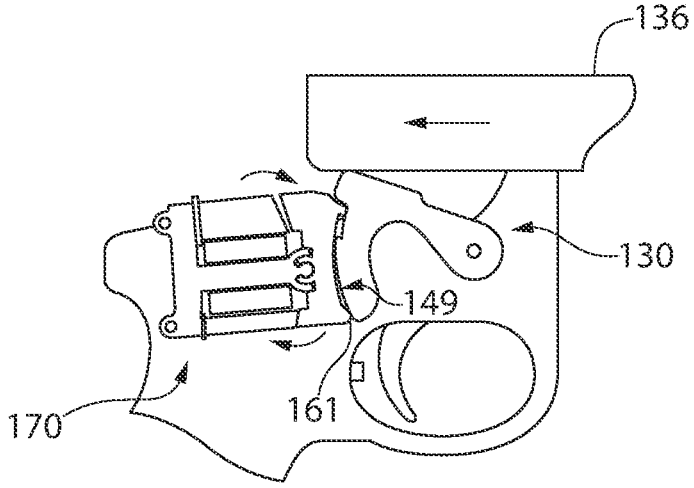

To provide the actuation force needed to reset the present asymmetric actuator 170, the present embodiment advantageously uses the recoil force generated from cycling a firearm as shown in FIG. 8. FIG. 8A demonstrates how the recoil force of cycling a firearm can be harnessed from the movement of a slide, bolt, or linkage within the firearm mechanism to reset the actuator 170. In this non-limiting hammer fired example, the force from the slide movement is transferred to the hammer as in FIG. 8B and the hammer movement transfers and uses the force to reset the asymmetric actuator as in FIG. 8C. This operation is further described below.

Firearm 50 may be a rifle; however, the direct release actuator 170 with integrated sear 124 may be embodied in other types of firearms including shotguns or handguns such as semi-automatic pistols or revolvers. Firearm 50 may include a frame 126 directly or indirectly supporting the single acting asymmetric electromagnetic actuator 170, a receiver 140 for loading/unloading ammunition cartridges into the action, a barrel 142 coupled to the receiver, a trigger assembly comprising a movable trigger 132, and a pivotable hammer 130. In other possible firearm embodiments such as a semi-automatic pistol shown in FIGS. 22A-B and 23A-B, it will be appreciated that receiver and its function in essence may be embodied in the form of a reciprocating slide which is well known in the art. In essence, a slide forms a movable receiver supported by the frame whereas the receiver of the rifle is fixed in position to the frame of the firearm. Both embodiments however may be broadly considered as a receiver.

Barrel is axially elongated and includes a rear breech end 148 defining a chamber 150 configured for holding a cartridge and an opposite front muzzle end (not shown) through which a projectile exits the barrel. An axially extending bore 151 is formed between the muzzle and breech ends, and defines a projectile pathway in a well-known manner. The barrel bore 151 defines a longitudinal axis LA of the firearm and associated axial direction; a transverse direction being defined laterally with respect to the longitudinal axis.

The receiver 140 in FIGS. 1, 8, and 15 includes an axially and linearly reciprocating bolt 136 having a front breech face 146 which defines an openable/closeable breech area with the rear breech end 148 of the barrel 142 for loading/unloading cartridges into/from the barrel chamber 150 in a convention manner when the action is cycled. An elongated spring-biased striking member such as a firing pin 144 (shown in dashed lines) is slideably carried by the bolt 136 and projectable forward through the breech face 146 when struck on its rear by the hammer 130 to in turn strike and detonate a chambered cartridge 141 (see, e.g. FIG. 22). In other embodiments, the striking member may be the forward portion of a linear acting striker having an integral firing pin.

The trigger assembly includes a trigger spring 133 which biases the trigger towards a forward substantially vertical rest position as shown. Any suitable type spring may be used, such as a torsion spring as shown for one non-limiting example. Trigger 132 may be pivotably mounted to frame 126 or receiver 140 in one embodiment via a transverse pivot pin 134. Linearly movable triggers however may also be used.

Hammer 130 may be pivotably mounted to the frame or receiver via another transverse pivot pin 135 and is movable between a rearward cocked position (see, e.g. FIG. 1) and a forward firing position (see, e.g. FIG. 8A). A hammer spring 131 biases the hammer toward the forward firing position for striking the firing pin 144. Any suitable type spring may be used, such as a torsion spring as shown, a compression spring, or other type spring. Hammer 130 may be considered to have a generally L-shaped configuration in this embodiment and includes a front end 138 defining flat front end surface 137 for striking the firing pin 144 and opposing rear end 139. An arcuately curved convex cam surface 149 is formed on a top surface of the hammer between the front and rear ends. Cam surface 149 may have a complementary-configured shape to a cooperating arcuately curved concave actuator reset surface 125 (i.e. cam follower) formed on the front side of the sear 124 (i.e. rotating member of actuator). Cam surface 149 further defines a sear engagement ledge 127 formed between ends 138, 139 of the hammer 130. Ledge 127 is configured to engage sear protrusion 123 on the sear 124 of the actuator 170 for retaining the hammer in the rearward cocked position. An outwardly open recess 152 facing the actuator 170 (as viewed in FIGS. 15B and 15C when the sear engages the hammer) may be formed in the cam surface 149 between the hammer ledge 127 and front end 138. Recess 152 slidably receives the sear protrusion 123 for movement therein to reset the actuator 170 when cam surface 149 engages the reset surface 125 of the sear (see, e.g. FIGS. 8B and 8C).

Sear 124 of the present direct acting actuator embodiment being described is pivotably mounted to the central portion 102B of the stationary via a pivot connection, thereby providing a hinged actuator-sear assembly. This allows the sear 124 to rotate or rock with respect to the yoke for alternatingly engaging or disengaging the hammer 130. In one possible embodiment, a pin-less pivot connection may be provided as shown in FIGS. 1, 8A-C, and 15. The rear side of the sear 124 opposite the reset surface 125 defines a rear surface 157 having a rearwardly open circular receptacle 153 and a pair of arcuately curved guide slots 154; one slot formed on each side of receptacle 153 as shown. Receptacle 153 receives a complementary configured and outwardly projecting pivot protrusion 156 formed on the terminal free end 106 of the yoke central portion 102B. Pivot protrusion 156 defines a pivot axis for sear 124 which extends transversely to longitudinal axis LA of firearm 50 and parallel to the pivot axis of the hammer 130 (i.e. into the sheet in FIGS. 8A-C). Pivot protrusion 156 may be bulbous having a convexly curved and rounded (circular-shaped) head and narrower waist portion which connects the head to the free end 106 of the yoke central portion 102B as shown. Receptacle 152 has a matching configuration with a narrower throat formed between the larger main portion of the circular receptacle and rear surface 157 of the sear. Each guide slot 154 receives a complementary configured arcuately curved guide arm 155 extending upwards from the central portion free end 106 of the yoke 102; one arm formed on each side of the pivot protrusion 156. The concave sides of the guide slots 154 and arms 155 face inwards towards the receptacle 153 and pivot protrusion 156, respectively. Due to the mating narrow waist and throat of the pivot protrusion 156 and sear receptacle 153 respectively, it bears noting that the sear 124 must be assembled to the yoke 102 by laterally inserting the protrusion into the receptacle until the final assembled position shown in the figures is attained.

The foregoing combination of mating pivot connection elements provides pin-less guided rock-type action for the sear to engage, hold, and release the hammer. In other possible embodiments, it will be appreciated that a pinned connection similar to or different than that shown in FIG. 14B may alternatively be provided. The type of pivotable connection used does not limit the invention so long as rocker-type action of the sear is provided to change operational positions.

FIG. 17A shows one embodiment of a microprocessor-based control system mounted in the firearm 50 at a suitable location and usable with the direct release type single acting asymmetric electromagnetic actuator 170 presently being described with reference to FIGS. 1, 8, and 15. A trigger pull may be sensed or detected in one embodiment via one or more trigger sensors 159. Sensors 159 are positioned proximate to trigger 132 and operable to detect movement of the trigger such as by direct engagement or proximity detection. Two independent detection means may be used. In this non-limiting example, the trigger sensors may include an electronic displacement sensor 159B sensing movement of the trigger and a back-up physical mechanical-type switch or sensor 159A providing a physical indication that the firing decision has been made. This provides redundancy in the event one trigger sensor fails as it is unlikely that both sensors would fail simultaneously. Alternatively, a force sensing resistor can be used. In other possible embodiments, a single trigger sensor 159 may be provided. The microcontroller 200 receives and processes input signals from both trigger sensors to ensure that there is a very low possibility of a false trigger event. Each sensor 159 is communicably and operably connected to the microcontroller via wired and/or wireless communication links 201 (represented by the directional arrowed lines shown in FIG. 17A).

Operation of the single acting asymmetric electromagnetic actuator 170 in the direct release application described above will now be briefly explained. Starting with FIG. 1, the firing mechanism of firearm 50 is in the ready-to-fire position with the spring-biased hammer 130 shown in the rearward cocked position. Air gap A at top of the actuator 170 is open and air gap B at bottom is closed as active applying a holding force at this side of the actuator. A user or operator then manually pulls the trigger. Trigger sensors 159A and/or 159B (depending on the number and type of sensor employed) detect the trigger pull and transmit a corresponding detection signal to the microcontroller 200, as shown in FIG. 17A. Based on received the sensed trigger pull signal, the microcontroller activates the actuation control circuit 202 which generates and transmits an electric activation control signal to the actuator 170. The mechanical switch or sensor 159A may be operably connected to a safety interlock 203 which operates to electrically/electronically arrest the firing control circuitry. For example, in an electronic implementation of the safety interlock 203, the interlock may be a switch or hardware clamp circuit that maintains a dead short across the actuator inputs until the system is ready to be actuated. By providing an independent control signal to lift the short, the possibility of a failure or glitch in software can be eliminated from accidentally causing an actuation. This safety clamp feature can be enhanced by designing the clamp release circuit to only lift the short for a specific time period and then reapply the short independent of the control signal using a means such as charging an RC timing circuit. The safety interlock 203 has a blocking and non-blocking condition or position. In some embodiments, the blocking position may be the automatic default positon to which the interlock is returned after each firing of the firearm. The interlock 203 is interposed in the electronic control signal path between the actuation control circuit 202 and actuator 170. Mechanical trigger sensor 159A is operably coupled to the interlock 203 as shown in FIG. 17A. When the sensor 159A detects a trigger pull, a safety release signal is sent to the interlock 203 which is placed in the active non-blocking position. This allows the actuator activation signal to pass through the interlock switch and reach the actuator 170 which is activated for releasing the sear 124 (control block 204). If the safety release signal is not sent or detected by the interlock 203, the activation signal from the actuation control circuit 202 is intercepted by the interlock which is in the blocking position, thereby preventing activation of the actuator 170 and discharge of the firearm. According, the interlock 203 will not allow the actuator activation signal from the microcontroller 200 to pass through if a safety release signal is not received from the mechanical trigger sensor 159A.

Referring back to FIG. 1, the actuator activation control signal has been successfully transmitted to the electromagnetic actuator 170 by the microcontroller 200, based on verification that an intentional trigger pull has been made as described above. This causes the sear 124 to rotate counter clockwise which closes air gap A and opens air gap B. Simultaneously, the sear protrusion 123 on sear 124 disengages sear engagement ledge 127 on the hammer 130, thereby releasing the hammer which strikes the rear end of the firing pin 144 to discharge the firearm as shown in FIG. 8A (showing firing mechanism in the fire position). The actuator 170 may return a release status signal to the microcontroller 200 confirming that the actuator has moved to the release position noted.

Recoil forces produced by detonating the cartridge drives the bolt 136 axially rearwards against the hammer 130 which is in the forward fire position in FIG. 8A (see directional force arrow 160). Hammer 130 rotates rearward and downward (counter clockwise) which slidably engages cam surface 149 on hammer 130 with the actuator reset surface 125 on actuator 170, as seen in FIG. 8B. The bolt 136 maintains contact with the hammer 130 as it continues moving rearward forcing the hammer down farther. The hammer continues to rotate downwards and slides down along the actuator until the hammer cam surface 149 engages the outwardly projecting reset protrusion 161 on the sear 124 shown in FIG. 8C. This engagement toggles or rotates the sear 124 clockwise, thereby causing it to move back to the engaged position opening air gap A and closing air gap B. The bolt 136 travels rearward until the breech is fully opened to eject the spent cartridge casing from the firearm 50 allowing the magazine to upload a new cartridge from the magazine (not shown) into the receiver 140 for chambering in a well-known manner. As the bolt reverses direction and moves back forward, the hammer will start moving clockwise partially from the position shown in FIG. 8C towards the position shown in FIG. 8B. The hammer cam surface 149 will slide upwards along the sear actuator reset surface 125 until the sear protrusion 123 re-engages the sear engagement ledge 127 on the hammer 130 which arrests the hammer's motion. The hammer is now returned to the ready-to-fire cocked position as shown in FIG. 1.

It will be appreciated that although the sear 124 is shown in a substantially vertical orientation when mounted in firearm 50, in other embodiments the actuator and sear may have different orientations depending on the particular type and design of the firearm and firing mechanism components.

In other embodiments, it will further be appreciated that the hammer 130 may be replaced by an axially movable striker having a downwardly extending catch protrusion which may be selectively engaged/disengaged by the sear protrusion 123 of the sear 124 on the actuator using a similar methodology and approach to that described above for the hammer embodiment. The direct release embodiment of actuator 170 is expressly not limited in its applicability to either hammer or striker fired firearms but may be used with equal benefit in either type firing system.

In lieu of integrating the sear 124 into a single acting asymmetric actuator 170 as described above in a direct release mode of operation, a symmetric actuator such as actuator 100 in FIGS. 14A&B or actuator 180 in FIG. 16 may instead be configured and arranged to indirectly release the hammer 130 via releasing an intermediate firing mechanism component such as a separately mounted sear 177 as depicted in FIG. 2. This figure shows the key firing system components and actuator disembodied from the firearm for clarity. Sear 177 is operably coupled in the firing mechanism linkage between the actuator 100 and hammer 130. Sear 177 may have an axially elongated body including a rear end comprising a hook-shaped sear protrusion 181 and opposite front end with a recess 178. A pivot 182 disposed between the ends pivotably mounts the sear 177 to the firearm frame. The enlarged lower portion hammer 130 which pivotably mounts the hammer to the firearm frame via pivot 135 includes a sear engagement ledge 179 that releasably engages the sear protrusion 181 on sear 177. The recess 178 on sear 177 receives and engages the operating protrusion 172 formed on actuator 180, which is illustrated.

Actuator 180 is operably coupled to the microcontroller 200 shown in FIG. 17A which controls movement of the actuator. The actuator 180 moves between two actuation positions in the manner already described herein which is initiated when the actuator senses a trigger pull. Actuation of the actuator 180 creates motion causing the operating protrusion 172 to rock or toggle in opposing directions from side to side. FIG. 2 shows the actuator in a first position with sear 177 engaged with the hammer 130 being held in the rearward cocked position. The firing mechanism and sear are in a ready-to-fire position. Upon sensing a trigger pull via trigger sensors 159 as previously described, the microcontroller 200 activates the actuator 180 which is moved to a second position (upwards in FIG. 2). The front end of sear 177 is rotated upward via operating protrusion 172 and the opposite rear end of the sear rotates downward. Engagement between the sear protrusion 181 and sear engagement ledge 179 of hammer 130 is broken. The releases the hammer which rotates forward to strike the rear end of firing pin 144 which moves forward to detonate the cartridge. After firing and actuator activation, the microcontroller 200 signals the actuator to return to the first position which moves the sear back to the original ready-to-fire position for re-engaging the hammer 130 when it is re-cocked by the firing mechanism (e.g. bolt or slide now shown in FIG. 2).

An example of the bistable dual acting actuator 180 of FIG. 16 embodied in a firearm and moving under electrical power between two equal positions is shown in FIGS. 21A and B. In this embodiment, the actuator 180 is used in a blocking role to arrest an intermediate trigger mechanism linkage from the trigger to the sear in a firearm. In one embodiment, the firearm may be a semi-automatic pistol 51 recognizing that the actuator may be used in any type firearm having a sear or similar component which operates to hold and selectively release the energy storage device (e.g. hammer or striker). The actuator 180 in this embodiment is located in the front of the trigger guard area. An actuator placed in the front of the trigger guard would allow for utilization of a space envelope within the firearm that would not impact the primary mechanics of the firearm.

Pistol 51 includes reciprocating slide 165, barrel 142 defining barrel bore 143, and firing pin 144. Slide 165 is slideably mounted to frame 126 and moves in a known reciprocating manner between rearward open breech and forward closed breech positions under recoil after the pistol is fired. A recoil spring 166 compressed by rearward movement of the slide acts to automatically return the slide forward to reclose the breech. Barrel 142 further includes chamber 150, rear breech end 148, and front muzzle end 173 similarly to firearm 50. The grip portion of frame 126 comprises a downwardly open magazine well which receives a removable ammunition cartridge magazine 169 therein for uploading cartridges automatically into the chamber 150 via operation of the slide 165. All of the foregoing components and operation of semi-automatic pistols are well known in the art without requiring further elaboration.

Pistol 51 further includes the microcontroller 200 and power source 122; both of which are operably and communicably connected to the actuator 180. Microcontroller 200 controls the operation and position of the actuator 180 via the control logic in the manner described elsewhere herein.

The firing mechanism of pistol 51 includes a trigger 132, hammer 130, and trigger bar 167 mechanically coupling the trigger to the hammer. Trigger 132 is pivotably mounted to frame 126 via transverse pivot pin 191 disposed below the trigger bar 167. The trigger bar in turn is movably coupled to an upward operating extension 193 of the trigger via transverse pin 192. The trigger bar 167 is axially and linearly movable in a forward path of travel Pt via pulling the trigger 132.

The actuator 180 may be located in the front of the trigger guard 184. An actuator placed in this location would allow for utilization of a space envelop that would not impact the primary mechanics of the firearm. The rotating member 104 of actuator 180 includes an outwardly and in this orientation of the actuator upwardly projecting operating protrusion 172. Operating protrusion 172 is moveable laterally and transversely (i.e. right side to left side) in a plane perpendicular to the longitudinal axis LA of the firearm. In this embodiment upon pulling the trigger, the trigger bar linkage is either blocked from moving by the actuator 180 when the blocking protrusion 172 is in a blocking position to the left or free to travel for discharging the firearm when the blocking protrusion is in a non-blocking position to the right.

The rear end 175 of the trigger bar 167 is configured and arranged to engage a sear ledge 174 on the front of the hammer 130, which holds the hammer in the rearward cocked position. The front end 176 of the trigger bar is selectively blocked or unblocked by the blocking protrusion 172 of actuator 180. In the non-blocking position, the actuator operating protrusion 172 is laterally displaced and axially misaligned with a forward surface of the trigger bar 167 so that protrusion does not obstruct the linear path of travel Pt of the trigger bar. The trigger bar may therefore be fully actuated by pulling the trigger 132 to release the cocked hammer 130 and discharge the firearm. In the blocking position, the actuator operating protrusion 172 is axially aligned with the forward surface of the trigger bar 167 and obstructs the linear path of travel. Pulling the trigger bar will abuttingly engage the operating protrusion 172 with the trigger bar to prevent discharging the firearm. This type operation and functionality is optimal for a dual acting actuator moving under electrical power between two equal positions. The microcontroller 200 sends actuation signals to the actuator 180 to automatically select either the blocking or non-blocking positions.

The actuator 180 may be configured and arranged of course to block other portions of the trigger bar 167; an example of which is shown in FIG. 3. A rear portion of the trigger bar engages the hammer 130 in a generally similar manner to FIG. 22. In this instance, however, the trigger bar includes a downwardly open slot 183 which is selectively engaged by the actuator operating protrusion 172 under the control of microcontroller 200. When the actuator is in the blocking position, the slot 183 is engaged by laterally movable protrusion 172 to prevent movement of the trigger bar 167. When the actuator is in the non-blocking position, the operating protrusion 172 is disengaged from the slot, thereby allowing the trigger bar 167 to move forward for releasing the hammer 130 and discharging the firearm. In this embodiment, the actuator may be mounted within a portion of the rear grip frame of the firearm behind the trigger and/or trigger guard.

Figure 21:
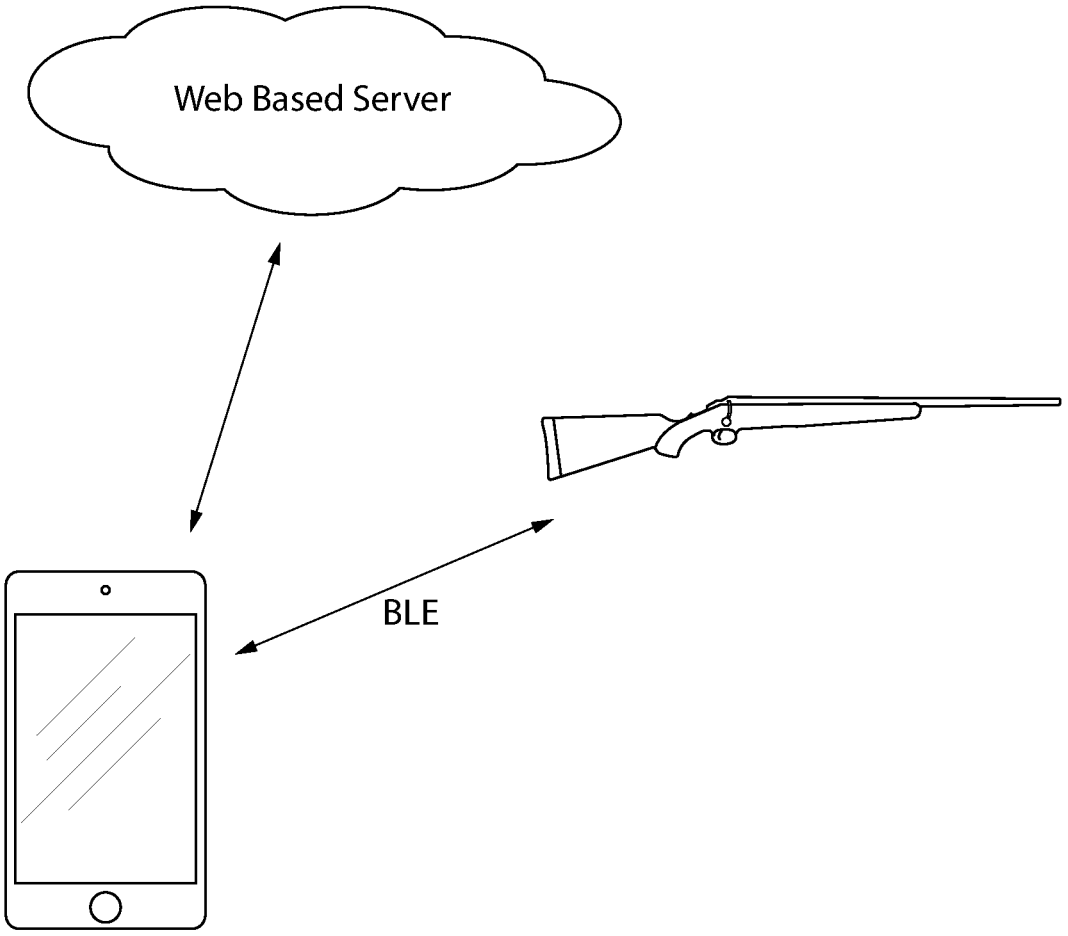
FIG. 21 is a system graphic showing an actuator wireless data collection and communication smart application with wireless communication between a personal electronics device and a firearm.
Figure 22A:
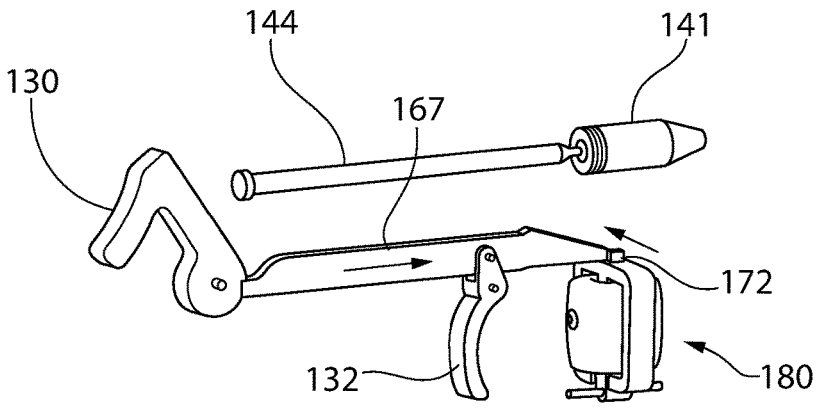
FIGS. 22A and 22B are schematic perspective and side views respectively of an enable/disable actuator in a firearm blocking an intermediate linkage of the trigger-operated firing mechanism.
Figure 22B:
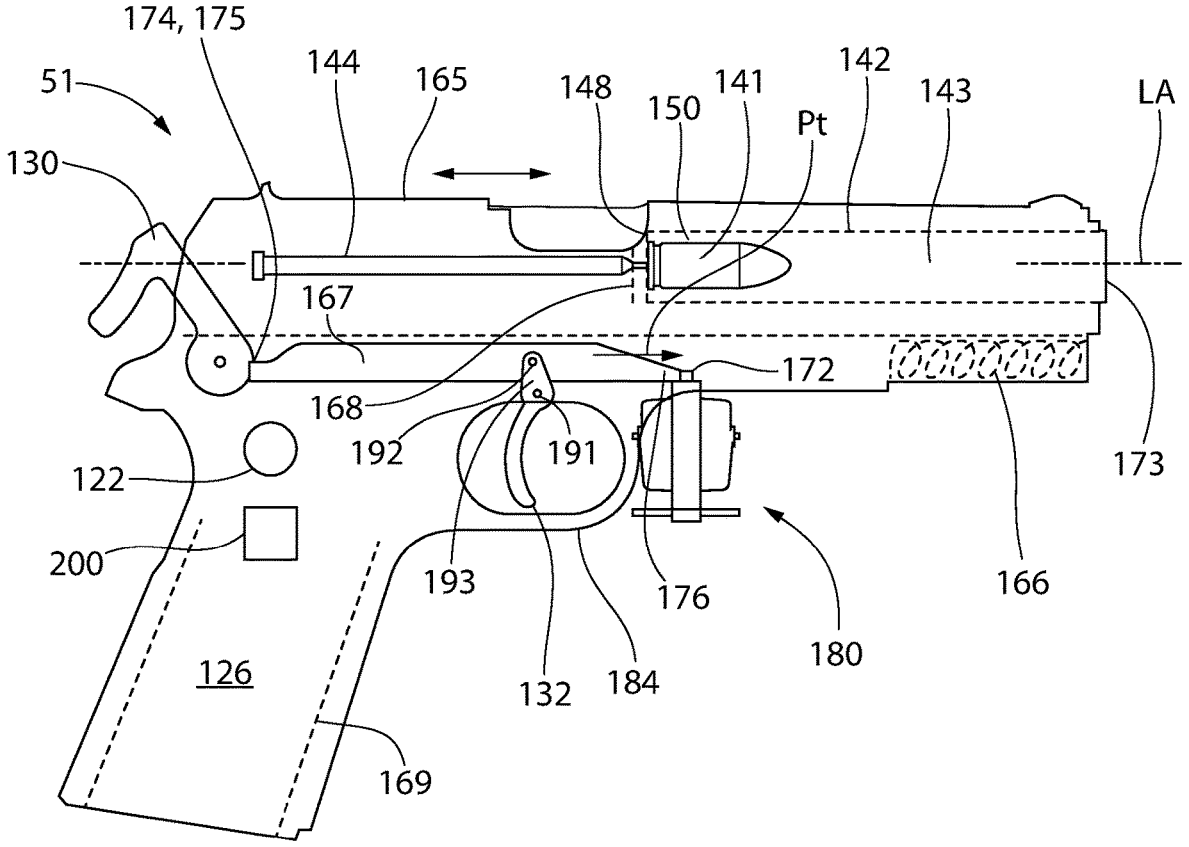

FIGS. 22A and B show another example of the bistable dual acting actuator 180 in a firing mechanism blocking role. Actuator 180 is movable under electrical power between two equal positions in a similar manner to FIGS. 21A and B described above. In this embodiment, the actuator 180 acts on and blocks the trigger 132 from movement when the actuator is in the blocking position to prevent discharging the pistol 51. The pistol and firing mechanism components are similar to that in the pistol of FIGS. 22A and B already described herein, except that the trigger bar which is truncated in length and the trigger is specially configured to interact with the actuator 180.

In this embodiment, the actuator 180 is located in the firearm forward of the trigger guard 184 and blocks the movement of the trigger 132 by means of a movable blocking member such as rotational safety linkage 185. Linkage 185 may be an elongated bar having a generally horizontal and axial orientation. Trigger 132 includes a forwardly projecting cantilevered operating extension 188 which is configured and operable to selectively engage the rear end 195 of the linkage 185. In one non-limiting embodiment, the rear end of linkage 185 may include an upright blocking protrusion 187 that engages the trigger extension 188; however, in other implementations the linkage may directly engage the trigger extension without the protrusion. The front end 194 of the rotational linkage 185 is configured with a slot 189 configured to operably engage the operating protrusion 172 of the actuator 180. A vertically oriented pivot pin 186 rotatably mounts the linkage to the firearm frame 126. The pin 186 defines a rotational axis of the linkage 185 which is perpendicular to the longitudinal axis LA. Pivot pin 186 may be located between the opposite ends of linkage 185 at a suitable location to provide the desired lateral or transverse displacement of the rear end 195 of the linkage with respect to the trigger 132 when the linkage is rotated by the actuator at the front end 194. Linkage 185 is rotatable in a horizontal plane between a blocking position which prevent firing of the pistol 51 and a non-blocking position which permits firing the pistol.

FIGS. 22A and B show the actuator 180 in the blocking position. The rotational safety linkage 185 is axially aligned with the trigger and parallel to the longitudinal axis LA (when viewed from above). Attempting to pull the trigger 132 abuttingly engages the trigger operating extension 188 with the safety linkage 185, thereby blocking and arresting movement of the trigger and trigger bar 167 which cannot release the hammer 130. In operation, when the actuator 180 receives an actuation signal from the microcontroller 200, the safety linkage 185 is rotated laterally and horizontally about pivot pin 186 via the toggle-like action of operating protrusion 172 on the actuator. The front end 194 of linkage 185 rotates in a first direction (e.g. left) and rear end 195 rotates in an opposite second direction (e.g. right) such that the linkage is now obliquely angled to the longitudinal axis LA (when viewed from above). This laterally and transversely removes the blocking protrusion 187 on the linkage 185 from beneath the trigger operating extension 188, thereby allowing downward movement of the trigger extension when the trigger is pulled and full actuation of the trigger bar 167 to discharge the firearm. The actuator 180 may maintain this non-blocking position of the safety linkage 185 until an actuation signal is received from the microcontroller 200, which returns the linkage to the blocking position.

It will be appreciated that use of the actuator 180 in a firing mechanism blocking function as described above with respect to FIGS. 3, 21, and 22 may ideally form part of an authentication-enabled safety system which prevents unauthorized use of a firearm. An authentication system is described in further detail elsewhere herein.

Actuator Position Sensing

Coils may be optimized for battery voltages within a firearm. Features in the actuator may be used to track the state of the actuator. For example, when the actuator changes state, there is a momentary change in the flux density in the driving coil. This will produce an inductive voltage event in the drive circuit. This may be exploited to terminate the actuator drive current at an optimal time as shown in FIG. 6.

Figure 9B:
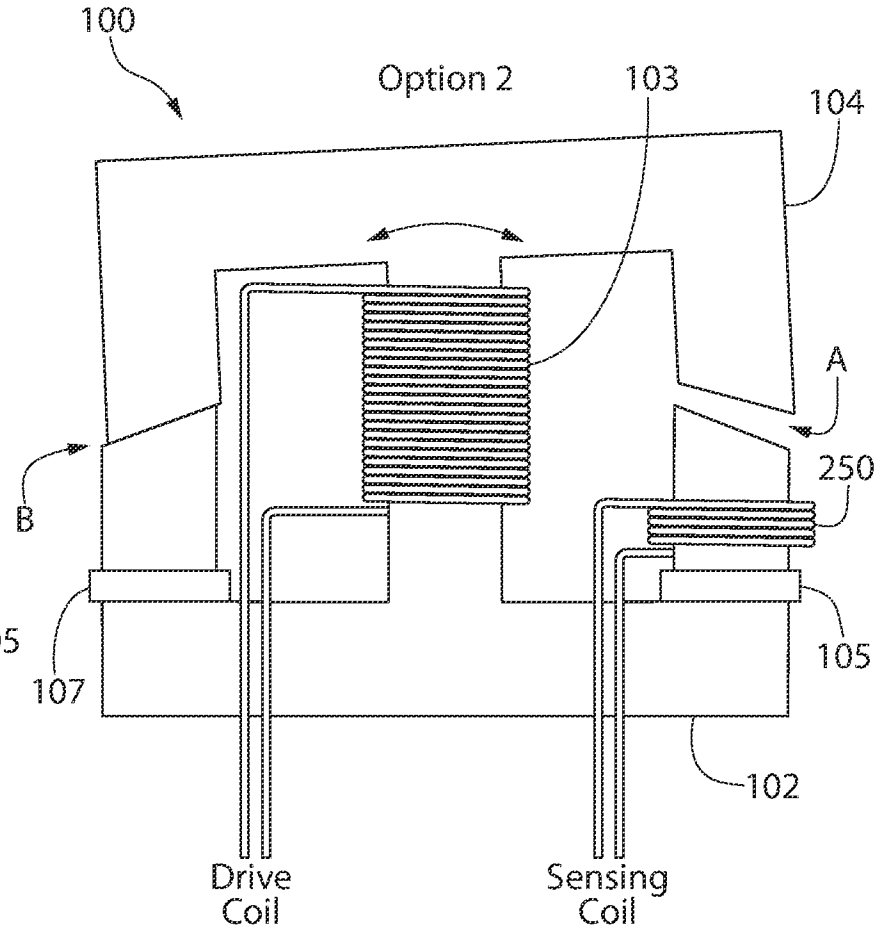
Figure 9A:
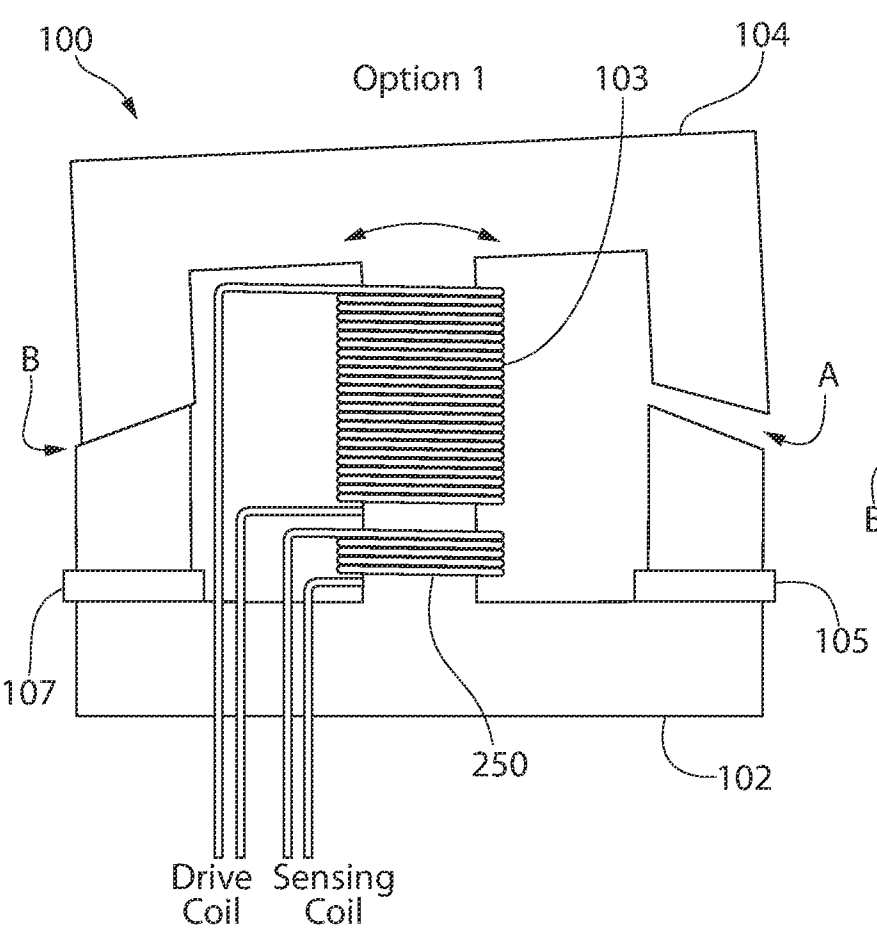

A secondary sensing coil may be used to produce an independent signal which the control or drive logic implemented by microcontroller 200 may use to determine when to terminate the actuation current as shown in FIGS. 9A and 9B. In FIG. 9A, a sensing coil 250 is inductively coupled to the electromagnetic drive coil 103 through the stationary central portion 102B of armature or yoke 102 (see also FIGS. 14A-B). Drive coil 103 is electrically coupled to power source 122 through the microcontroller control circuity (see, e.g. FIGS. 17A-B) or directly. In FIG. 9A, any change in flux density caused by energizing the driving coil will induce voltage into the sensing coil that can be used to provide feedback on the timing of the transition of the actuator states. In FIG. 9B, the sensing coil 250 is placed on one of the two separate legs (e.g. upright end portions 102C or 102D) of the actuator armature or yoke 102 and is inductively coupled only when the actuator is in one of the two states providing an even more easily detectable feedback means to indicate successful actuator state transition. This feedback sensing can be used to provide visibility to the timing of a successful state transition and can also be used to optimize performance by limiting the amount of energy sent to the drive coil to the minimum necessary to transition between states.

Figure 10A:
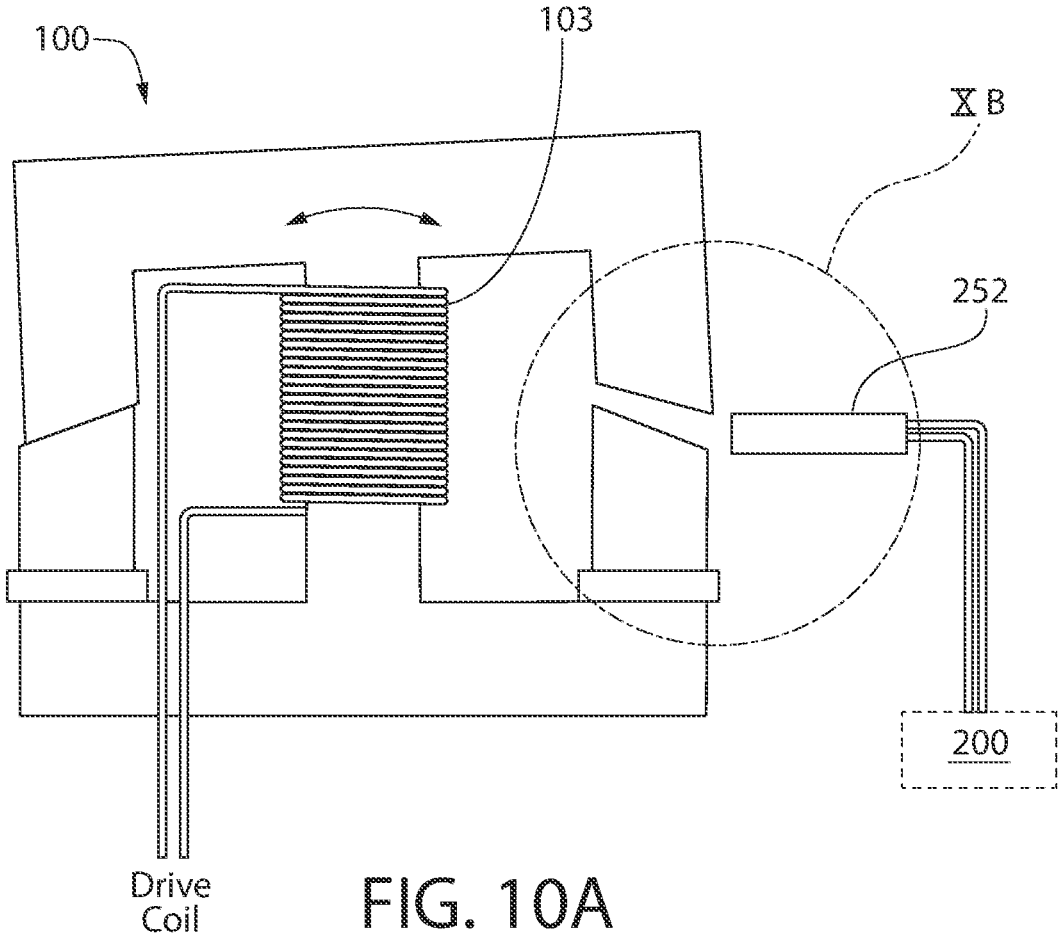
FIG. 10A is a diagram showing a hall-effect sensor placed near the air gap at A and/or B to measure leakage flux at the air gap.
Figure 10B:
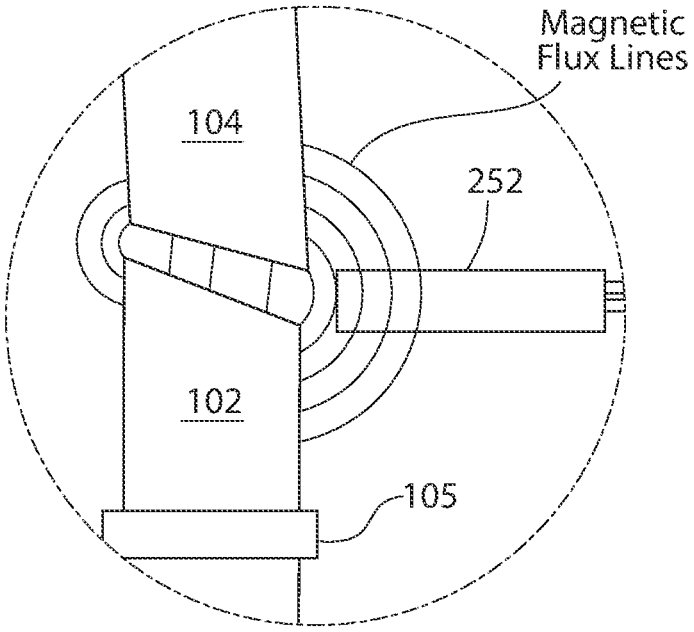
FIG. 10B is a detailed view taken from FIG. 10A.

A hall-effect sensor 252 or alternatively a GMR(Giant Magnetoresistance Effect) sensor could alternatively be placed near the air gap at A and/or B to measure leakage flux at the air gap as shown in FIGS. 10A-B. This could be used to deduce the state of the actuator. These sensors and drive circuits could be fabricated with the actuator as a modular unit. The hall-effect sensor 252 or GMR is placed in close proximity to the air gap on one leg (e.g. upright end portions 102C or 102D) of the actuator yoke 102 to measure leakage flux at the air gap location. The leakage flux will vary significantly depending on if the air gap is in the open or closed state providing a non-contact means of determining successful state transition of the actuator. Hall-effect sensors 252 are commercially available and well known in the art.

The three above mentioned techniques for detecting actuator state may have significant impact on the commercial viability of an actuator, particularly actuators which are used asynchronously with the firing event. The closed loop feedback can also be a major advantage for synchronous applications.

Comparing FIG. 5 and FIG. 6, it can be shown that significant minimization of the cycle reset time can be achieved to ensure that the speed of actuation and reset can meet the unique high speed operation cycle times needed for firearm applications as well as many other envisioned related industrial applications. In addition, the closed loop feedback will allow for the least wasted energy making it possible to use small battery sources physically capable of fitting into the design requirements for portable very small applications.

Control Logic

The use of a magnetic actuator to control actions within the firearm provides a direct replacement for the mechanical system of springs, cams, linkages, and sears and can be used to reduce cost of manufacturing, simplify tolerances of critical parts, improve functionality and timing, and modularize the fire control system. In its most basic form, a simple solid-state switching control circuit with battery (power source) for driving the actuator could be used as shown in FIG. 4. Similar designs using NPN or PNP transistors and other switching elements could easily be implemented as well.

By replacing the simple circuitry with a programmable microprocessor such as microcontroller 200, however, the power, speed, and control and safety logic can be made highly adaptable and configurable. FIGS. 17A and B show system block diagrams of how a microcontroller can be combined with additional features such as for example without limitation trigger sensing, grip sensors, acceleration sensors, and external communications supporting authorization and authentication access control; all of which could be incorporated into the controller of the actuator in firearm applications.

Referring to FIGS. 17A and B, programmable microcontroller 200 for controlling operation of the actuator and firearm includes a programmable processor 210, a volatile memory 212, and non-volatile memory 214. The non-volatile memory 214 may be any type of non-removable or removable semi-conductor non-transient computer readable memory or media. Both the volatile memory 212 and the non-volatile memory 214 may be used for saving sensor data received by the microcontroller 200, for storing program instructions (e.g. control logic or software), and storing operating parameters (e.g. baseline parameters or set points) associated with operation of the actuator control system. The programmable microcontroller 200 may be communicably and operably coupled to a user display 205, a geolocation module 216 (GPS), grip force sensor 206, motion sensor 207, battery status sensor 208, audio module 218, and a communication module 209 configured for wired and/or wireless communications. The geolocation module 161 generates a geolocation signal, which identifies the geolocation of the firearm (to which the programmable controller is attached), and communicates the geolocation signal to the programmable microcontroller 200, which in turn may communicate location with a remote access device. The audio module 218 may be configured to generate suitable audible alert sounds or signals to the user such as confirming activation of the actuator system, successful or failed authentication attempts, component failure attention alerts, or other useful status information.

The communication module 209 comprises a communication port providing an input/output interface which is configured to enable two-way communications with the microcontroller and system. The communication module 163 further enables the programmable microcontroller 200 to communicate wirelessly wired with other remote electronic devices directly and/or over a wide area network. Such remote devices may include for example cellular phones, wearable devices (e.g. watches wrist bands, etc.), key fobs, tablets, notebooks, computers, servers, or the like. In certain systems configured with authentication as described herein, module 209 serves as the authentication communications gateway.

The display 205 may be a static or touch sensitive display in some embodiments of any suitable type for facilitating interaction with an operator. In other embodiments, the display may simply comprise status/action LEDs, lights, and/or indicators. In certain embodiments, the display 205 may be omitted and the programmable microcontroller 200 may communicate with a remote programmable user device via a wired or wireless connection using the wireless communication module 209 and use a display included with that remote unit for displaying information about the actuator system and firearm status.

A number of additional sensors operably and communicably connected to microcontroller 200 may be used and integrated into the actuator-based electronic firearm control system described herein besides a battery sensor 208, trigger sensor(s) 159, and actuator movement/status sensor. In one example, a grip force sensor may be used to both wake up and insure a valid intent-to-fire grip is maintained as shown in the control logic of FIGS. 19A-B or 20A-B. The grip sensor only enables a firing event when a solid intent-to-fire grip on the firearm is present. Dropping, fumbling, or even small children that cannot securely and safely grip the firearm would be sensed as a lack of adequate control and disable the firearm.

Another example of desirable sensors is an accelerometer or other motion sensing sensor to determine if the environment is safe. By monitoring the acceleration or motion of the firearm, the magnetic actuator can be disabled during undesirable conditions such as high acceleration caused by the user falling, tripping, being bumped or jarred, or exposure to other potential forces that could cause component failures. Thus in the presence of a high acceleration force, the control system could be configured to disable the firing mechanism due to the foregoing unsafe conditions.

One possible enhancement to the firearm control would be to sense the movement of the trigger using sensors 159 and actuate the firing event prior to the operator feeling the end of travel of a mechanical trigger when using the actuator in a firing mechanism release role as further described herein. This would enhance trigger follow-through and greatly reduce the operator effects of flinching as the firing event approaches. Additionally, since precise trigger event timing can be provided independent of the firing actuation event, the same firing actuator can be used with many different trigger force and displacement profiles.

One enhancement to the control system disclosed herein is the inclusion of one or more wireless communications options in some embodiments such as Bluetooth® (BLE), Near-Field Communication (NFC), LoRa, Wifi, etc. implemented via communications module 209 (see, e.g. FIG. 17A). This would allow the collection of data such as rounds fired, attempted fires, acceleration forces, performance data, maintenance data, and timing and authorization events. This data could be wirelessly shared with a cellphone or other remote electronic data processing/communication device, or even directly through a WiFi hub as shown in FIG. 21. In addition, operation of the magnetic actuator system on the firearm may be programmed and controlled via the remote device.

According to another aspect of the present invention, some embodiments may include the use of authentication technology to enable and disable the firearm from being capable of firing. For example, the control system of the present firearm may be configured to require authentication by the authorized user of the firearm before any one of the magnetic actuator embodiments disclosed herein can be actuated. Any suitable type of authentication system, protocol, and input mechanism may be used. As one non-limiting example, by using an input keypad located directly on the firearm or via a personal electronic device (e.g. handheld or wearable cell phone, watch, key fob, tablet, remote control, etc.), a personal identification PIN code could be entered to enable use of the firearm. Other Alternatives include an electronic touch token for unlocking the firearm control system, a fingerprint sensor, or multiple grip force and position sensors to identify and authorize a user.

One preferred but non-limiting authentication technology would be the use of a short-range non-contact authentication token in the form of a ring, wristband, medallion, pendent, or pocket size device as some examples. Other forms of authentication devices of course may be used in various embodiments. This non-contact authentication device could communicate directly with the firearm control system and indicate the presence of an authorized user via commercially available communications architectures such as Bluetooth BLE, NFC, LoRa, WiFi, Bodycom, or PKE(Passive Keyless Entry) While all of these architectures are viable, a preferred technology would be to use a low frequency (e.g. around 125 kHz) inductively coupled identification authenticator. Low frequency inductively coupled or capacitively coupled communications would provide a very controllable distance of operation between the authorization device and the actuator. Inductive coupling would provide the ability to have low power and simple circuits while being less sensitive to the shielding effects of metals and the human body between the actuator and firearm. Capacitive coupling would ensure the operator is actually holding the device.

Figure 18:
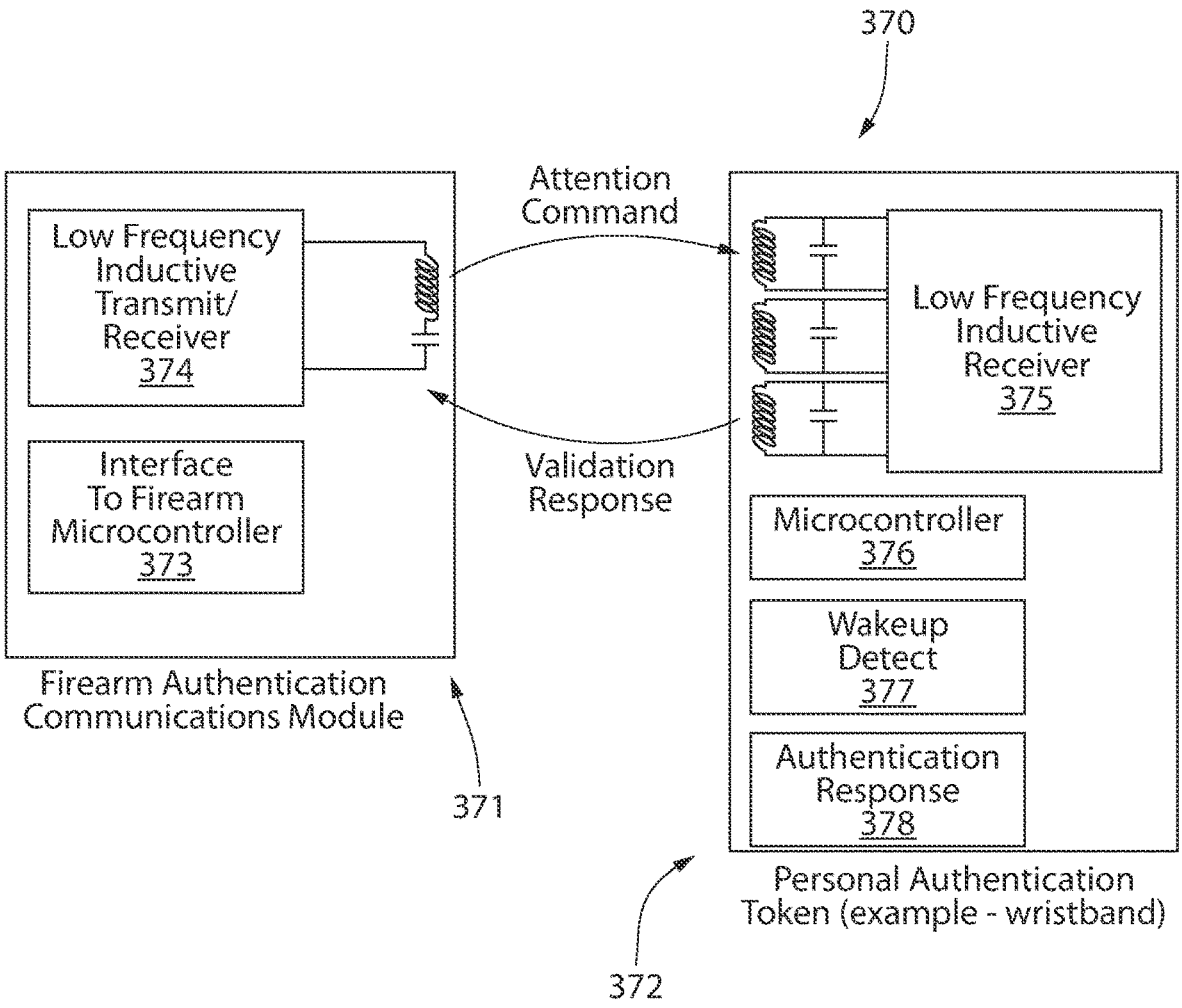
FIG. 18 is a system block diagram of one embodiment of an authentication control system.

One non-limiting preferred authentication system and control scenario is shown in the example system block diagram in FIG. 18 and accompanying authentication control flowcharts in FIGS. 19A-B or 20A-B. While FIG. 18 demonstrates a communications authentication control architecture based on low frequency inductive means, many other communications architectures using BLE, NFC, LoRa, WiFi BodycomBodycoE etc. could be used and substituted. The token based authentication communication architecture would interface with the magnetic actuator through the authentication/data collection module (i.e. communications module 209) depicted in FIGS. 17A and 17B.

Referring to FIG. 18, the authentication system 370 comprises the firearm on-board communications module 209 forming part of the microcontroller-based firearm control system as already described herein and a personal authentication device 372 ("PAD" for brevity) communicably and operably coupled to the control system. To communicate wirelessly with PAD 372, the communication module may include a microcontroller interface circuitry 373 and a low frequency inductive transmitter/receiver 374. PAD 372 may comprise on-board microcontroller 376, wakeup detect circuit 377, authentication response circuit 378, and low frequency inductive receiver 375. Inductive low frequency coupling of an authorization (Identification) token may be used to make a decision on whether an authorized user is in possession of the device. Preferably, one approach may be to use low frequency inductive coupling based on its potential to precisely control short range distance and immunity to interference and spoofing over RF.

The authentication control processes 400 and 500 of FIGS. 19A-B and 20A-B respectively are implemented via the foregoing authentication control system hardware of FIG. 18 in cooperation with firearm control system microcontroller 200. In FIGS. 19A-B or 20A-B, one possible approach to authentication control for a firearm actuator is shown. Those skilled in the art can see that the control flow is equally valid and adaptable for a number of different authentication technologies such as alternative token based identification technologies, hardware authentication devices such as fingerprints and other biometrics.

In the approach taken in FIGS. 19A-B or 20A-B, a wake-up sensor in the grip in the form of either a grip sensor 206 and/or motion sensor 207 will conserve power. When triggered, the wake-up sensor will use near field inductive RF in the 125 kHz range (or an alternative token base identification protocol or biometric) to confirm that an authorized user is within usable range of the firearm and either enable a magnetic actuator based safety mechanism (i.e. enable/disable actuator operation) or enable the logic to a firing actuator. This can be pre-authorized while gripping the weapon or simply confirmed at the moment that the trigger is engaged if the authentication technology has a fast enough cycle time. Lack of a response would disable the firearm. The effective distance for actuation would be chosen to ensure reliable function of the system at normal firearm use scenarios, but disable the firing if the operator/user steps away from the firearm a short distance such as in a take-away situation, when reloading, or changing targets, etc.

Figure 19A:
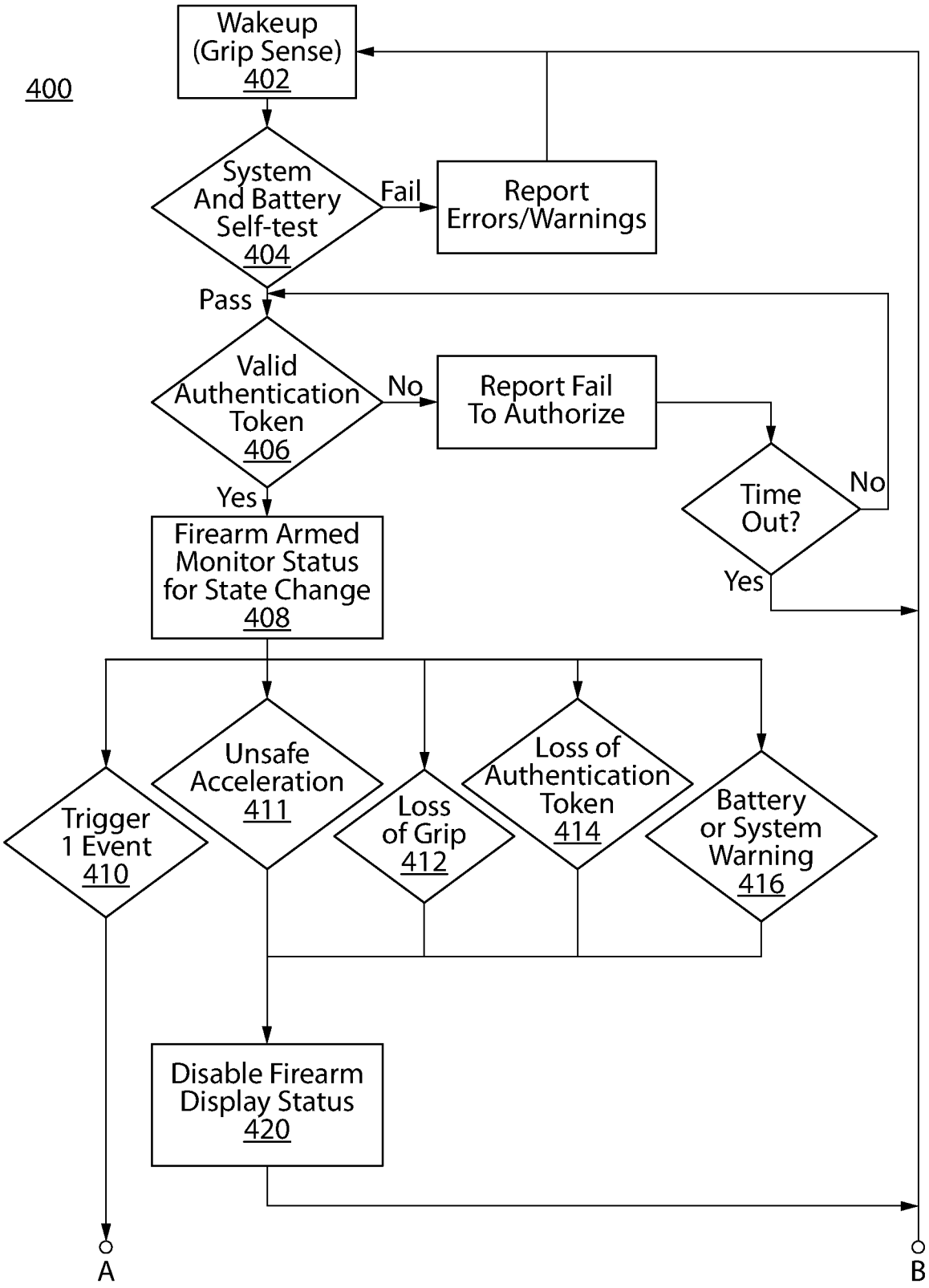
FIGS. 19A and 19B show an authentication control logic flowchart for a firearm direct release type actuator.
Figure 19B:
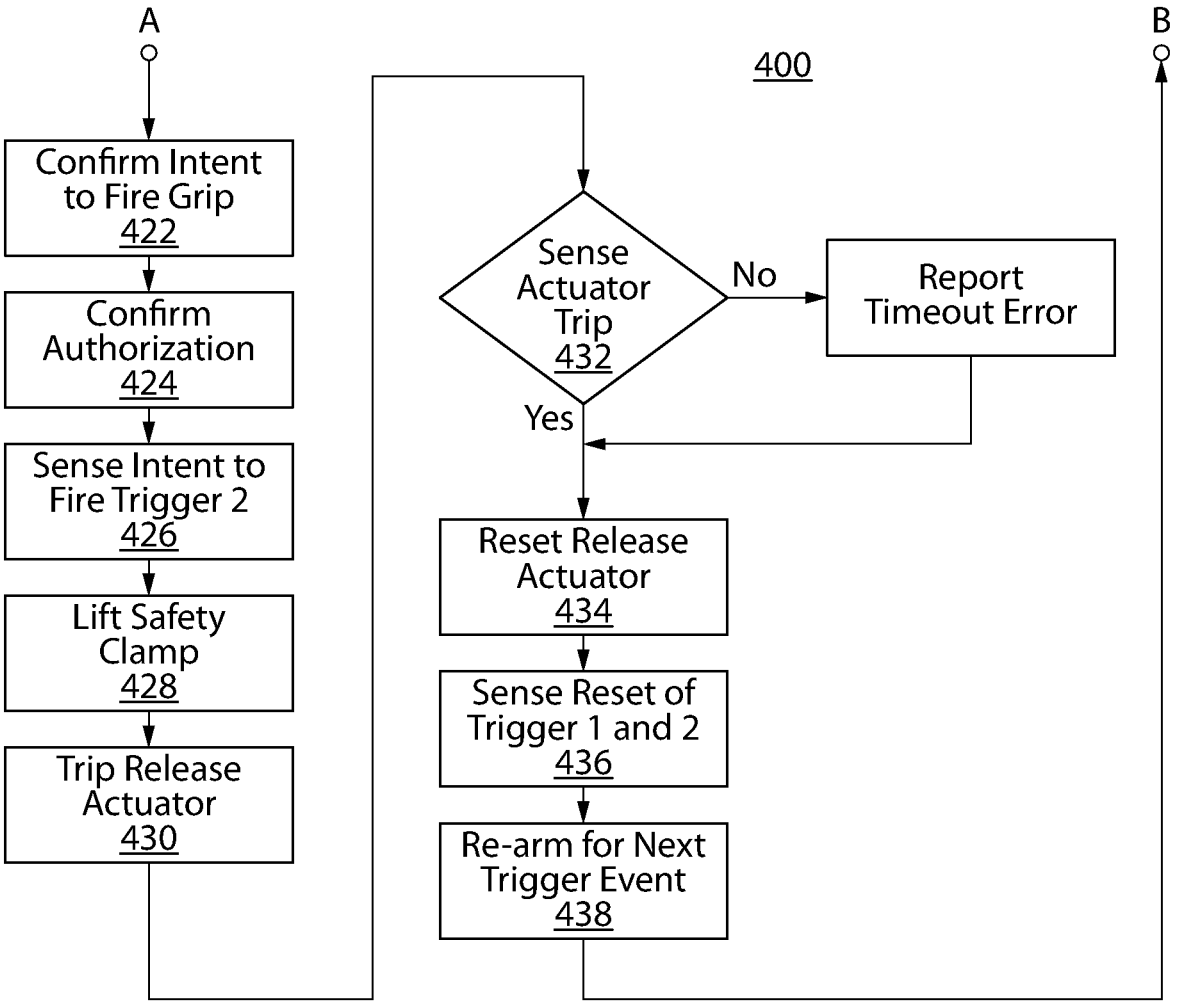

FIGS. 19A-B show one specific example of how authentication and actuation control would flow for a firearm release actuator. Such an arrangement of actuator 100 is shown for example in FIGS. 1 and 2 where the actuator is configured and operable to release the hammer or striker of the firearm, as explained elsewhere herein. Many similar variations in the control flow can be envisioned by those skilled in programming microcontrollers. In the example in FIGS. 19A-B, the system would awaken when it detects a wake-up signal generated from gripping the gun which is sensed by grip sensor 206 and communicated to microcontroller 200 (Step 402). Alternatively, this could be a motion detection wake-up signal sensed by motion sensor 207 instead of a grip sensor. On wake-up, a quick check that sufficient battery power is available and that the system is functioning is performed in the form of a self-test (Step 404). A failure of this self-test or battery check would result in aborting the start-up sequence and informing the operator of the error/warning so that corrective action can be taken.

If the self-test and battery test is passed, then an authorization test is performed in Step 406. The system will confirm that the firearm is authorized to be used by searching for an identification token as illustrated, or alternatively a valid input of a personal identification code or valid test of a biometric. If the authentication test fails, the system will indicate this failed authorization to the user and continue to attempt to authorize until a predefined and preprogrammed time-out limit is reached. If however the authorization test is positive, the microcontroller 200 will arm the firearm and continuously monitor for a trigger event and a number of other possible state change events with examples of some being indicated in FIGS. 19A-B. Alternatively, these state change events could be polled periodically on a reasonable preprogrammed time schedule to ensure reliable and timely detection.

An example of one state change event that would effect authorization is the detection of loss of intent-to-fire grip that would indicate the user no longer has control of the firearm (Step 412). Another example would be the detection of an unsafe acceleration force detected by motion sensor 207 (Step 411), which is associated with falling or being bumped or jarred while holding the firearm. In the presence of a high acceleration force, the system disables the firing due to unsafe conditions. Another example would be the detection that the proximity to the identification token, or the time of a predefined timeframe for authentication has expired (Step 414). Loss of authentication will reset the authorized armed state of the firearm and disable operation of the firearm. Another example of state-change events would be the detection of a system error or the detection that the battery might not have sufficient remaining power to reliably actuate the magnetic actuator (Step 416). These types of faults and warning would also drop the firearm out of the authorized arm state and indicate a warning to the user.

An actuation event cycle also starts if a trigger event is detected by trigger sensor 159 in Step 410, and the firearm is authorized in an armed state and no state change event (Steps 411, 412, 414, or 416) has de-authorized the armed state as indicated above. Steps 422 through 430 represent a firing sequence for the firearm implemented by microcontroller 200. For safety, two independent trigger events, "Trigger Event 1" and "Trigger Event 2," are preferred to initiate a valid trigger event; however, a single trigger event may be used in other embodiments. After the system detects Trigger Event 1 has occurred, the system then confirms that the firearm is still under the users physical control with an intent-to-fire grip (Step 422). The system then confirms the user's authorization criteria is still valid (Step 424). Next, the system detects whether an intent-to-fire Trigger Event 2 is activated. This provide the double layer of firing security. Assuming Steps 422, 424, and 426 are positive, the electronic safety shorting clamp is lifted (Step 428) to enable the firing mechanism and the actuation control signal is sent by microcontroller 200 to release the magnetic actuator 100 which discharges the firearm as previously described herein. As the actuator changes position (i.e. fires the gun), the feedback sensor detects and confirms that the actuator has transitioned (Step 432). As soon as the actuator state-change is detected, a control signal is removed to conserve power and decrease total cycle time. In a bistable release actuator application, a reset control signal is sent by microcontroller 200 immediately to the release actuator to move the actuator back to its starting state in preparation for the next triggering event as fast as possible (Step 434). If in Step 432 the feedback sensor fails to identify that the actuator 100 transitioned after a predefined time-out duration, the system will log an error but continue under the assumption that the actuator could have changed state. Under this condition, a reset control signal is sent after the timeout duration to attempt to move the actuator back to its starting state independent of the actual state of the actuator to ensure it is reset.

The rest of the firing and actuation cycle also includes the system sensing that the actuator has in fact physically reset (secondary part of Step 434), that trigger signals Trigger Event 1 and Trigger Event 2 are reset (Step 436), and finally that all ready-to-fire again conditions are met (Step 438).

While not shown, it should be noted that a momentary release actuator could be controlled similarly to that shown in FIGS. 19A-B and described above. Instead of sending a reset control signal to the actuator (Step 434 above), the system can simply wait for the external force of the firing event to physically reset the actuator. Instead of sending a reset signal, this step would be replaced with either closed loop feedback sensing of a successful reset event such as via a motion/displacement, proximity, or other type sensor, hall-effect sensor, sensing coil, or alternatively the expiration of a predetermined cycle time to ensure that the actuator has had sufficient time to reset.

Figure 20A:
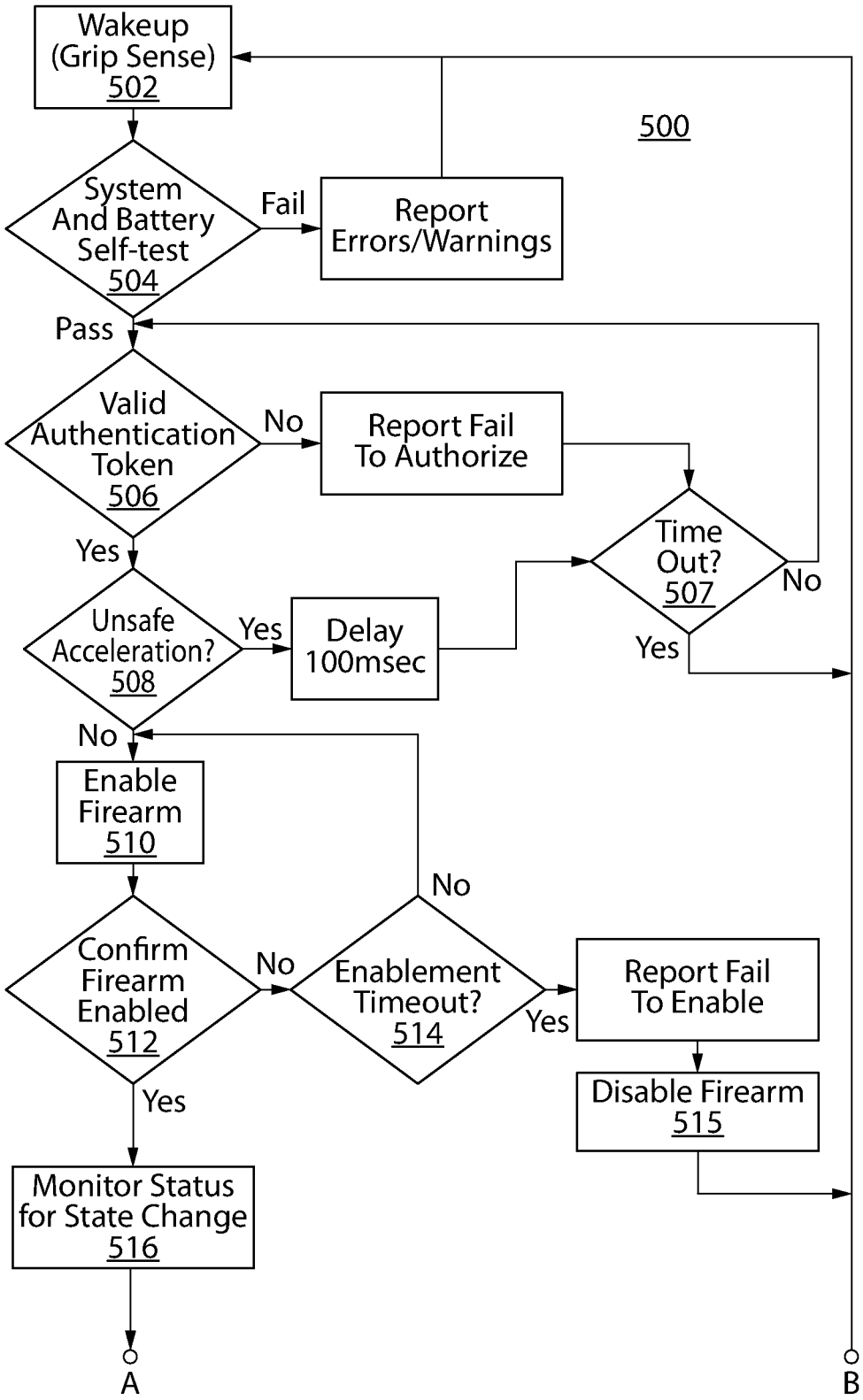
FIGS. 20A and 20B show an authentication control logic flowchart for a firearm enable/disable type actuator.
Figure 20B:
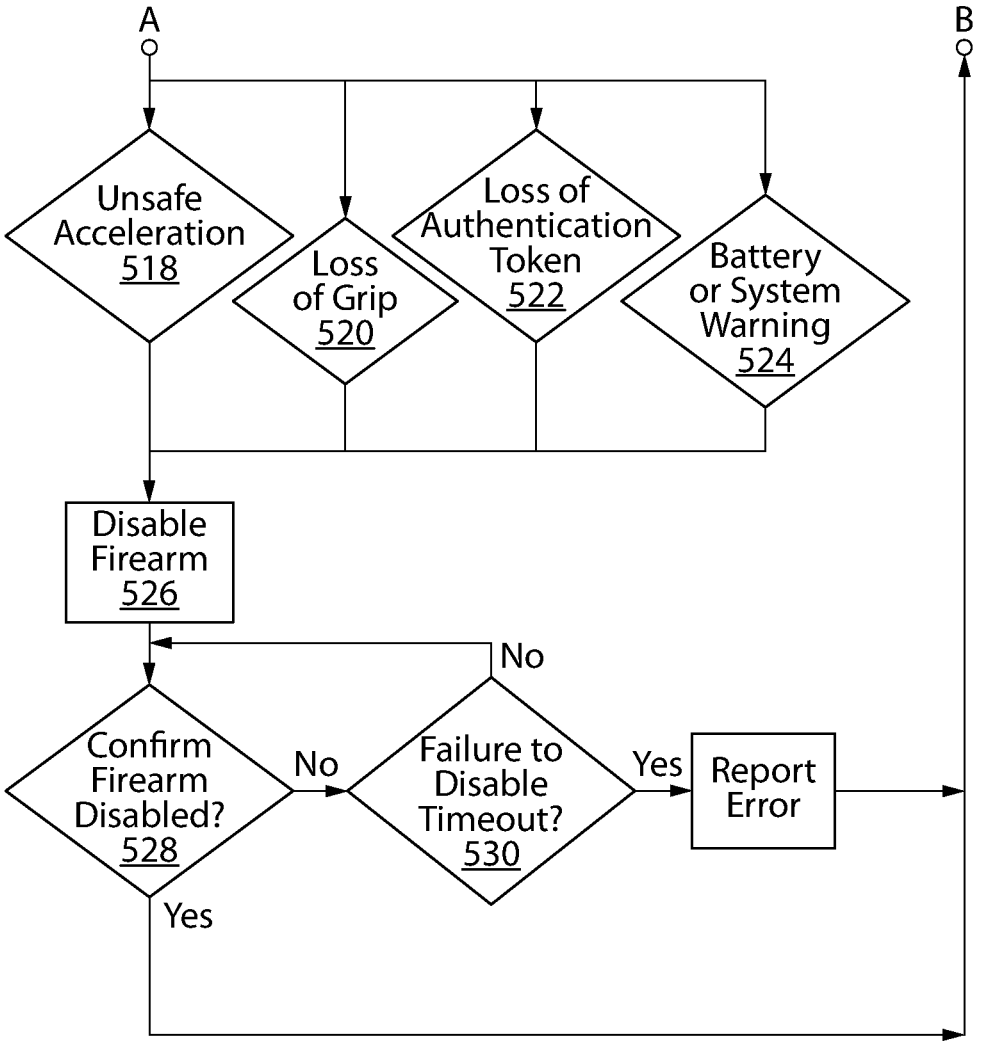

FIGS. 20A-B shows a non-limiting example of how authentication and actuation control could flow for a firearm enable/disable style actuator. Such an arrangement of actuator 100 is shown for example in FIGS. 3, 23A-b, and 24A where the actuator is configured and operable to enable or disable the firearm firing mechanism, as explained elsewhere herein. This implementation may be thought of as an access control application similar to locking or unlocking a firearm device. The control flow is similar to the release actuator of FIGS. 19A-B, except that the enable and disable events can happen asynchronously.

In the non-limiting example control logic flow process 500 shown in FIGS. 20A-B, the control system would awaken when microcontroller 200 detects a wake-up signal generated from gripping the gun sensed via grip sensor 206 (Step 502). Alternatively, this could be a motion detection wake-up signal sensed via motion sensor 207 instead of a grip sensor. On wake-up, a quick check that sufficient battery power is available and that the system is functioning is performed in the form of a self-test (Step 504). A failure of this self-test or battery check would result in aborting the start-up sequence and informing the operator of the error/warning so that corrective action can be taken.

If the self-test and battery test is passed, then an authorization test is performed in Step 506 (similarly to Step 406 in FIG. 19A). The system will confirm that the firearm is authorized to be used by searching for an identification token as illustrated, or alternatively a valid input of a personal identification code or valid test of a biometric. If the authentication test fails, the system will indicate this failed authorization to the user and continue to attempt to authorize until a predefined and preprogrammed time-out limit is reached in the test of Step 507.

If the authorization test conversely is positive, the firearm will attempt to authorize "Enable" the firearm by first checking that no high acceleration events are present that could inhibit proper performance of the actuator (Step 508). If successful, a control signal is sent to the actuator to change state. If high acceleration or motion indicates an unsafe environment, a predefined short delay (e.g. 100 milliseconds or other) is activated which allows a pause in the control flow to allow for the unsafe condition to be resolved, and/or a preprogrammed time-out limit (Step 507) is reached that causes the attempt to authorize to be aborted as an error which may be reported to the user.

If the system does not detect an unsafe acceleration condition in Step 508, microcontroller 200 generates and transmits a control signal that energizes the magnetic actuator 100 to change position (e.g. disabled position/state to enabled position/state) in Step 510. The firearm firing mechanism is now authorized and armed for firing using the trigger operated firing mechanism of the firearm. In Step 512, a feedback sensor (e.g. motion/displacement, proximity, or other type sensor, hall-effect sensor, sensing coil, or other means) determines that the actuator has physically transitioned to the enabled state. As soon as the actuator state-change is detected and confirmed by the system (i.e. positive response), the control signal may be removed by the system to conserve power. Control passes to Step 516.

If however the feedback sensor fails to identify that the actuator transitioned in Step 512 to the enabled state after a predefined time-out duration, the system would log an error and control continues under the assumption that the actuator 100 has not changed state. Under this condition, several attempts may be made by microcontroller 200 to retry transitioning the actuator (see Step 514 and return control loop). After a retry timeout period is reached in Step 514 without a confirmed actuator "enabled" state change, the system would log a hard error and report the "failure to enable" to the user. But this time, the assumption is that the actuator 100 may have changed state and is in fact in the "enabled" state. To ensure that the system is not left in a possible unconfirmed enabled state after this error, the firing mechanism of the firearm is disabled by the system (Step 515) which transmits a control signal to the actuator. In some embodiments, the system may be configured to execute several attempts to reset the actuator to the "disabled" state in Step 515. Control is returned to Step 502 from Step 515. In some embodiments, the system may be configured to confirm that the "disabled state" is in fact achieved by passing control from Step 515 to Steps 526-530 described below.

Once the system is in the confirmed "Enabled" state in Step 512, the system will transition into a monitoring state (Step 516) to detect conditions that would transition the actuator from its "Enabled" state back to the "Disabled" state. FIGS. 20A-B shows four of many possible state change events that could be polled periodically by the system on a reasonable time schedule, or monitored continuously as interrupts, to ensure reliable and timely detection. Event monitoring Steps 518, 520, 522, and 524 are ostensibly the same as Steps 411, 412, 414, and 416 respectively discussed in detail above. They will not be repeated here for the sake of brevity.

If any of the foregoing status change events are detected, control passes to 526 and the system disabled the firing mechanism by transitioned the magnetic actuator 100 from the enabled state/position to the disabled state/position. In Step 528, the system may then attempt to confirm via a test that the actuator has physically transitioned to the "disabled" state via the same a feedback sensor (e.g. motion/displacement, proximity, or other type sensor, hall-effect sensor, sensing coil, or other). If the system cannot immediately confirm that the actuator is in the disabled state (i.e. negative response to the test), the system executes Step 530 to implement a return control loop that polls the system a preprogrammed period of time to find the presence of a control signal from the feedback sensor confirming that the actuator is in fact disabled. If in Step 530 the feedback sensor fails to identify that the actuator 100 transitioned to the disabled state after a predefined time-out duration, the system will log an error and report the condition to the operator/user. Control passes back to Step 502.

As soon as the actuator state-change is detected and confirmed by the system (i.e. positive response either immediately in Step 528 or after a period of time less than the time-out duration), the control signal may be removed by the system to conserve power. Control passes back to Step 502.

Options and Enhancements

Various features may be included in certain embodiments to increase the manufacturability of the actuator. These could include the design of a magnetic hinge. One such concept is shown in FIGS. 1, 8A-C, and 15 as described elsewhere herein. Approaches to attaching the magnets may be important. It is critical that the rare earth magnets be protected from moisture and uneven forces that might crack the material. One preferred embodiment places the magnets away from the air gaps A and B (see, e.g. FIG. 15) so that the moving member will not induce off center forces that could damage the magnetic material.

The entire actuator may be encapsulated in a resin cured plastic to protect critical features from moisture, dirt and grime. The entire actuator may be overmolded into a plastic part in some embodiments. The magnetic material may be coated and/or plated. Ideally, the finished actuator module will represent a complete independent module that is protected from moisture, dirt and grime.

Alternative locations for the actuator could also include the rear area of the firearm (i.e. the grip region) interfacing with the intermediate linkage between the trigger and sear, or directly interfacing with the sear. The actuator could alternatively interface with an existing sear block safety, split trigger safety, trigger bar disconnect, magazine safety, or hammer or striker blocking means.

Another alternative embodiment would have the actuator in the bottom of the ammunition magazine with a blocking linkage extending up into the intermediate trigger transfer bar and blocking movement of the trigger from this location. By either limiting the number of rounds or increasing the size of the magazine baseplate, an electrical module containing an actuator, electronics, and battery could be contained in the bottom of the magazine in the baseplate. A direct or indirect linkage to interface with either a new or existing mechanical blocking safety means such as a sear block, trigger or trigger bar disconnect, magazine safety, manual safety, or striker or hammer blocking means would mate the magazine to the frame.

Another practical embodiment would be to locate the actuator in a axially reciprocating pistol slide and interfacing the actuator directly with a striker blocking means. The actuator could be contained in the slide above the centerline of the striker and interface with a new or existing striker blocking means independent of the firearm frame assembly. If the blocking actuator module is housed in a red-dot sight module, it could extend both down into the slide and above the slide as one module maximizing available space and sharing battery supply with the sight.

Yet another embodiment could place the actuator in the rear grip. A manual grip safety means that utilized the operator to provide the force and displacement of gripping the firearm to manually move a blocking linkage is a known firearm safety means. By combining the blocking actuator invention inside the grip safety, the actuator could be used to engage or disengage the function of the grip safety. Less actuator force and displacement would be required since the primary force and displacement for the safety function is provided by the operator gripping the firearm.

Embodiments of the present invention may be employed with any type of trigger-operated firearms or weapons including without limitation as some examples pistols, revolvers, long guns (e.g. rifles, carbines, shotguns), machine guns, grenade launchers, etc. Accordingly, the present invention is expressly not limited in its applicability. In addition to the foregoing small or light arms applications (i.e. personal weapons), embodiments of the invention may find applicability in certain crew-service large or heavy arms (e.g. infantry support weapons).

Sheathed Actuator Embodiment

FIGS. 23-34 depict another embodiment of a dynamically balanced, dual-acting bistable electromagnetic actuator 600 with a sheathed or shrouded rotating member 610. Actuator 600 is advantageously configured to avoid possible physical interference between the coil windings on the actuator and the rotating member 610. Because the pivot axis of the rotating member 610 is disposed inside the coil windings, this arrangement advantageously prevents impeded movement and response speed of the rotating member when actuated. The actuator 600 may be used in either direct or indirect release applications mechanically interfacing with the firing mechanism to discharge the firearm. Alternatively, the actuator 600 may be used in blocking or enabling type applications, in which the actuator is operable to block the firing mechanism from discharging the firearm, or to enable the firing mechanism to discharge the firearm.

Actuator 600 includes a stationary magnetic yoke assembly 601, movable rotating member 610, and electromagnetic coil 103 which is connected to an electrical power source, as previously described herein. Yoke assembly 601 includes an outer yoke 602 and a central inner yoke 604. The outer yoke 602 has an annular and circumferentially extending body with a generally C-shaped body configuration. Outer yoke 602 circumscribes a central space 603. Inner yoke 604 is nested inside the outer yoke 602 in the central space 603. Outer yoke 602 comprises a common horizontal top section 602A, downwardly extending vertical right and left sections 602B, 602C spaced laterally apart, and inwardly turned bottom sections 602D, 602E. The bottom sections are not joined and horizontally spaced apart to define a bottom gap or opening 605 which communicates with the central space 603 of the outer yoke.

The inner yoke 604 has a generally straight and vertically elongated body. Inner yoke 604 extends from the top portion 602A to the bottom portions 602D, 602E of the outer yoke 602. Inner yoke 604 may have a T-shaped body configuration including a top end portion 604A, bottom end portion 604B, and intermediate portion 604C extending therebetween. The intermediate portion 604C is orientated parallel to the right and left sections 602B, 602C of the outer yoke 602. The inner yoke 604 may have a substantially rectilinear transverse cross-sectional shape. Top end portion 604A of the inner yoke may be laterally/horizontally broadened and wider than the intermediate and bottom end portions. The bottom end portion 604B may define an arcuately convex end surface 606 which faces downwards. Surface 606 slideably engages complementary configured and arcuately concave surface 607-1 formed on the rotating member 610 which is upward facing when the rotating member is rotated.

In one embodiment, inner yoke 604 and outer yoke 602 may be formed as separate pieces which are assembled together. This simplifies fabrication of the yoke and rotating member components, and further allows placement of the rotating member inside the inner yoke. Inner yoke 604 may be split vertically or lengthwise in construction, and includes a front half-section 608 and rear half-section 607. This split casing arrangement of the inner yoke 604 facilitates assembly of the rotating member 610 thereto, as further described herein.

Figure 32:
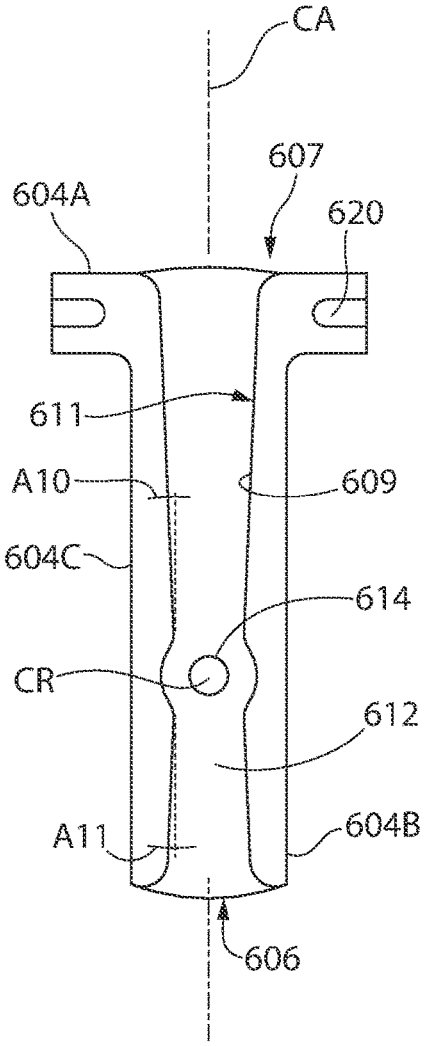
FIG. 32 is a front view of a rear half-section of an inner yoke of the actuator assembly of FIGS. 24A and 24B.

Each half-section 607, 608 of inner yoke 604 defines a portion of a longitudinal cavity 609 configured to pivotably receive rotating member 610 therein. Cavity 609 extends from and penetrates the top and bottom end portions 604A, 604B of the inner yoke. Referring particularly to FIG. 32, cavity 609 defines a pair of opposing inner sidewall surfaces 611 on each side of the cavity and an adjoining inner rear wall surface 612 on rear half-section 607, and correspondingly a front wall surface 613 on front half-section 608. When half-sections 607 and 608 are assembled, cavity 609 has a cumulative depth (measured from front to rear) sufficient to encase at least an intermediate portion of the rotating member 610 therein.

The half-sections 607 and 608 may be coupled together by any suitable mechanical coupling means, including for example without limitation adhesives, welding, soldering, interlocking protrusions and recesses, fasteners including screws and rivets, or other. In one embodiment, half-section 607 and half-section 608 may each include coupling features respectively to couple the half-sections together. The coupling features in one embodiment may comprise a pair of spaced apart tabs 620 formed on one half-section (e.g. rear half-section 607) which engage corresponding slots 621 formed on the other half-section (e.g. front half-section 608) to form an interlocked coupling arrangement. The arrangement of tabs and slots may be reversed on the half-sections and provides the same mechanical fastening capability. In one non-limiting configuration, the tabs 620 and slots 621 may be formed on the laterally widened top portions 604A of each half-section.

Inner yoke 604, when the half-sections 607, 608 are assembled, may be fixedly attached to the outer yoke 602. In one embodiment with general reference to FIGS. 25 and 31, the top end portion 604A of the assembled inner yoke 604 may be configured for attachment to the top section 602A of outer yoke 602. This supports the inner yoke 604 from the top of the outer yoke 602 in a cantilevered manner such that the intermediate portion 604C and bottom end portion 604B of the inner yoke are not attached to the outer yoke 602. The top end portion 604A of inner yoke 604 and the outer yoke 602 include complementary configured coupling features to effect this coupling arrangement. In one embodiment, an axially open receptacle 640 (i.e. upwardly and downwardly open) is formed in top section 602A of outer yoke 602 that receives top end portion 604A of inner yoke 604 therein. Top section 602A may include a pair of opposing key protrusions 641 arranged on opposite sides of the receptacle. Protrusions 641 project inwardly into the receptacle and are horizontally elongated. Each protrusion 641 is insertably received in a corresponding outward facing horizontal key slot 642 formed in the top end portion 604A of each inner yoke half-section 607 and 608. The key protrusion 641 and slot 642 may be rectilinear in configuration in one embodiment; however, other shaped protrusions and slots or holes may be used such as circular protrusions and holes. In some embodiments, the protrusion and slot 641, 642 may be reversed and located on the other of the inner and outer yokes 604, 602 thereby providing same effective coupling. Other suitable types of mechanical coupling arrangements and methods for coupling the inner yoke to the outer yoke may be used, such as for example without limitation adhesives, fasteners such as screws or rivets, welding or soldering, etc. The type of coupling features used does not limit the invention.

In one embodiment, outer yoke 602 may also have a split casing similar to inner yoke 604. Outer yoke 602 may therefore be formed of two vertically split front and rear half-sections 650A and 650B which are coupled together by any suitable mechanical means, such as for example without limitation adhesives, fasteners such as screws or rivets, welding or soldering, etc. In one embodiment, front half-section 650A includes a plurality of tabs 651 which are inserted into a corresponding plurality of slots 652 formed in rear half-section 650B (see, e.g. FIG. 30). This split casing arrangement of outer yoke 602 facilitates attaching the inner yoke 604 to the outer yoke 602 at the receptacle 640, as described above. Inner yoke 604 becomes trapped between the front and rear half-sections of the outer yoke 602 at the top receptacle 640 to lock the inner yoke in place. In other possible embodiments contemplated, however, the outer yoke 602 may instead be formed as a monolithic unitary structure.

Rotating member 610 has a vertically elongated body including a top operating end protrusion 630, bottom actuating end protrusion 631, and intermediate portion 632 extending therebetween. Both top operating end protrusion 630 and bottom actuating end protrusion 631 may be laterally/horizontally broadened relative to the intermediate portion 632 in one embodiment. In one embodiment, intermediate portion 632 may have parallel sides and be rectilinear in configuration and cross-sectional shape. Operating end protrusion 630 is configured to interface with the firing mechanism of the firearm. When the electromagnetic actuator 600 is fully assembled, the operating end protrusion projects upwards beyond the outer yoke 602 to engage a firing mechanism component or mechanical linkage that interfaces with the firing mechanism.

The actuating end protrusion 631 of rotating member 610 may have a generally double-faced hammer configuration that includes two opposite and outwardly facing side actuation surfaces 633. When the actuator 600 is cycled between its two actuation positions, the actuation surfaces 633 are arranged to alternatingly engage permanent magnets 105, 107 which are affixed to the outer yoke 602. Magnets 105, 107 may be deposed on opposite sides of the bottom opening 605 on the outer yoke 602. In other embodiments contemplated, magnets 105, 107 may instead be affixed to the actuation surfaces 633 of the rotating member 610 adjacent bottom opening 605. Alternatively, magnets 105, 107 may be disposed at other locations on the outer yoke 602 with one magnet each within the first magnetic flux circuit A and second magnetic flux circuit B (see also FIG. 30). Preferably, the permanent magnets 105, 107 are disposed proximate to bottom opening 605 of the outer yoke 602 for direct engagement with the rotating member 610 to maximize the magnetic attraction forces therebetween and to simplify fabrication of the actuator 600.

Rotating member 610 may be pivotably mounted to inner yoke 604 via a pivot protuberance such as pin 614 that defines a pivot axis. Pivot pin 614 defines a center of rotation CR about which the rotating member 610 pivots or rotates. In one embodiment, rotating member 610 is movably disposed inside longitudinal cavity 609 of the inner yoke 604, and may be almost completely enclosed therein except for the operating and actuating end protrusions 630, 631 located outside the cavity. In one embodiment, pivot pin 614 may have a fixed end coupled to rear half-section 607 in cavity 609 and extends horizontally therefrom. The free end of pin 614 is received in a socket 615 formed in the front half-section 608 having a complementary configuration to the cross sectional shape of the pin. In one embodiment, the pin and socket may have a circular cross section; however, other cross-sectional shapes such as polygonal may be used. In an alternative possible embodiment, the rotating member 610 may instead comprise a pin which extends forward and rearward therefrom and the two ends of the pins are received in sockets 615 formed in both the front and rear half-sections 608, 607 of the inner yoke 604. This arrangement provides the same pivotable coupling and action of the rotating member 610.

Pivot pin 614 defines a third coupling feature which couples the front and rear half-sections 607, 608 together in addition to pivotably mounting the rotating member 610 in the inner yoke 604. It bears noting that the inner yoke 604 defines a vertical central axis CA of the actuator 600 about which rotating member 610 rotates or pivots. The pivot pin 614 is received through a mounting hole 635 formed in the intermediate portion 632 of the rotating member 610 to mount it to the inner yoke 604. A pair of arcuate convex lateral surfaces 634A may be formed on opposite side portions of the intermediate portion 632 surrounding hole 635 which rotatably and slideably engage corresponding arcuate concave surfaces 634B formed around pin 614 on inner yoke half-section 607 in cavity 609 (see, e.g. FIG. 25). This provides smooth pivoting action of the rotating member 610 about the pivot.

In one embodiment, the center of rotation CR of the rotating member 610 preferably is sufficiently close to a center of mass CM of the rotating member such that random linear acceleration forces acting on the actuator 600 from any direction will not generate sufficient force to overcome the static holding torque of the permanent magnets 105, 107 in a plane perpendicular to the axis of rotation. Advantageously, this provides a fast acting and dynamically stable design which is resistant to changing position due to imposed external acceleration forces or impacts such as experienced in firearm drop tests and normal operation. Determination of such an arrangement and positioning of the CR and CM with respect to what is considered "sufficiently close" can be calculated according to the method already described herein discussing drop compliance design of an electromagnetic actuator. In one embodiment, the centers of rotation CR and mass CM may be coaxial. For the configuration of rotating member 610 shown, the center of mass CM and rotation CR are located more proximately and closer to the larger heavier bottom actuating end protrusion 631 of the rotating member than the smaller lighter top operating end protrusion 630 in order to dynamically balance the rotating member.

Longitudinal cavity 609 of the inner yoke 604 is configured to allow full pivotable actuation movement of the rotating member 610 about pivot pin 614. To achieve this with reference to FIG. 32, inner sidewall surfaces 611 of cavity 609 above and below pivot pin 614 are non-parallel and have a divergent configuration. The inner sidewall surfaces 611 are obliquely angled at angles A10 and A11 to the vertical central axis CA of the actuator 600. Each pair of inward facing sidewall surfaces 611 diverge going from the pivot pin 614 to the top end portion 604A and to the bottom end portion 604B of the inner yoke 604, and concomitantly converge going in a direction towards the pivot pin. This imparts a somewhat hour-glass shape to longitudinal cavity 609 as shown forming a cavity configuration including a pair of diverging end portions and a converging central portion adjacent the pivot pin 614. The upper and lower portions of cavity 609 near the top and bottom end portions 604A and 604B are thus wider than the intermediate portions of the cavity near the pivot pin 614. This configuration allows full pivotable motion of the rotating member 610 about the pivot axis since the end portions of the rotating member will have the greatest angular movement and displacement when the actuator 600 is cycled.

Figure 30:
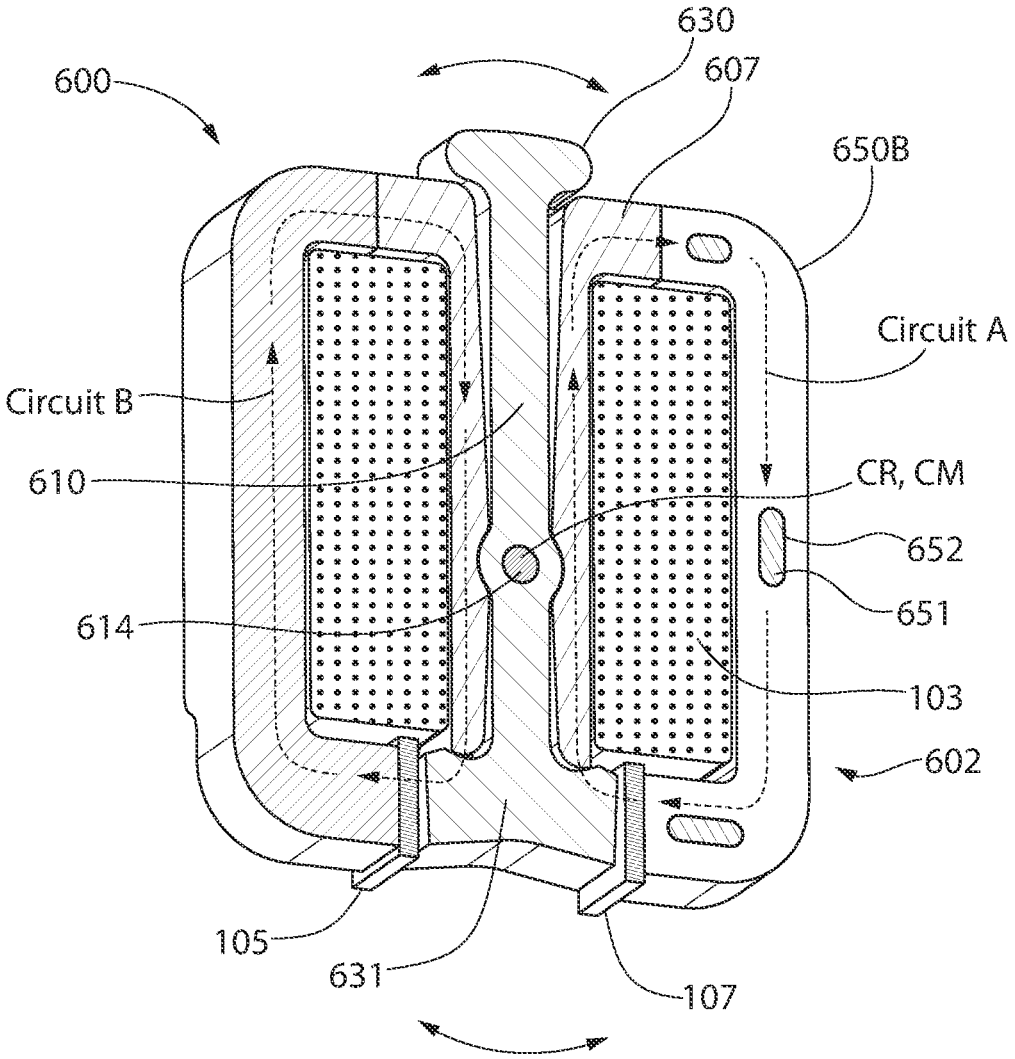
FIG. 30 is a perspective cross-sectional view thereof.

Actuator 600 operates in a similar manner to that previously described herein for dynamically balanced and symmetric bistable electromagnetic actuators. Accordingly, its operation will not be described in detail for sake of brevity. Generally, applying an electric current to coil 103 wound around inner yoke 604 creates a first magnetic flux circuit A and a second magnetic flux circuit B with lines of flux as shown in FIG. 30. A third magnetic flux circuit C is also created as seen in FIG. 14B; however, the effects of this circuit are minimal in magnitude with respect to operation of and influence on the actuator in comparison to flux circuits A and B. The lines of flux created by flux circuits A and B act in opposite directions in the central inner yoke 604, such that when a current is applied to the coil 103 it decreases the flux on the closed side of the actuator while increasing the flux on the open side of the actuator. At the moment the actuator starts to move, the reluctance of the loops changes and causes a rapid re-direction of flux toward the closing side and away from the opening side. This rapid re-direction advantageously amplifies the opening force to create a very rapid snap-like motion of the actuator 600 suitable for firearm firing mechanism and other non-firearm related applications Applying electric current to the coil 103 and changing/reversing polarity causes the rotating member 610 of actuator 600 to alternatingly pivot or tilt back and forth from side to side in a rocking motion. Rotating member 610 is pivotably movable between a first actuation position (see, e.g. FIG. 33) and a second actuation position (see, e.g. FIG. 34). Each position alternatingly forms a closed air gap A or B on one side of the actuator 600 between the actuating end protrusion 631 of rotating member 610 and outer yoke 602, and concomitantly an open air gap A or B on the other side during the pivoting action of rotating member depending on the direction of tilt. The top operating end protrusion 630 of the rotating member 610 moves in an opposite direction to the bottom actuating end protrusion 631 for either disabling or enabling the trigger-operated firing mechanism of a firearm in a blocking application of the actuator 600, or to release a firing mechanism component or linkage in a release application of the actuator; examples of each being previously described herein. Actuator 600 may therefore be substituted for the actuators and applications shown in FIGS. 2, 3, 22, and 23. In the first actuation position, the actuating end protrusion 631 of rotating member 610 engages permanent magnet 107. In the second actuation position, the actuating end protrusion 631 engages opposing magnet 105. As previously described herein, the permanent magnets create a static magnetic holding force or torque which resists changes in position of the actuator due to dynamic external forces that might be applied to actuator such as via firearm drop tests.

Figure 33:
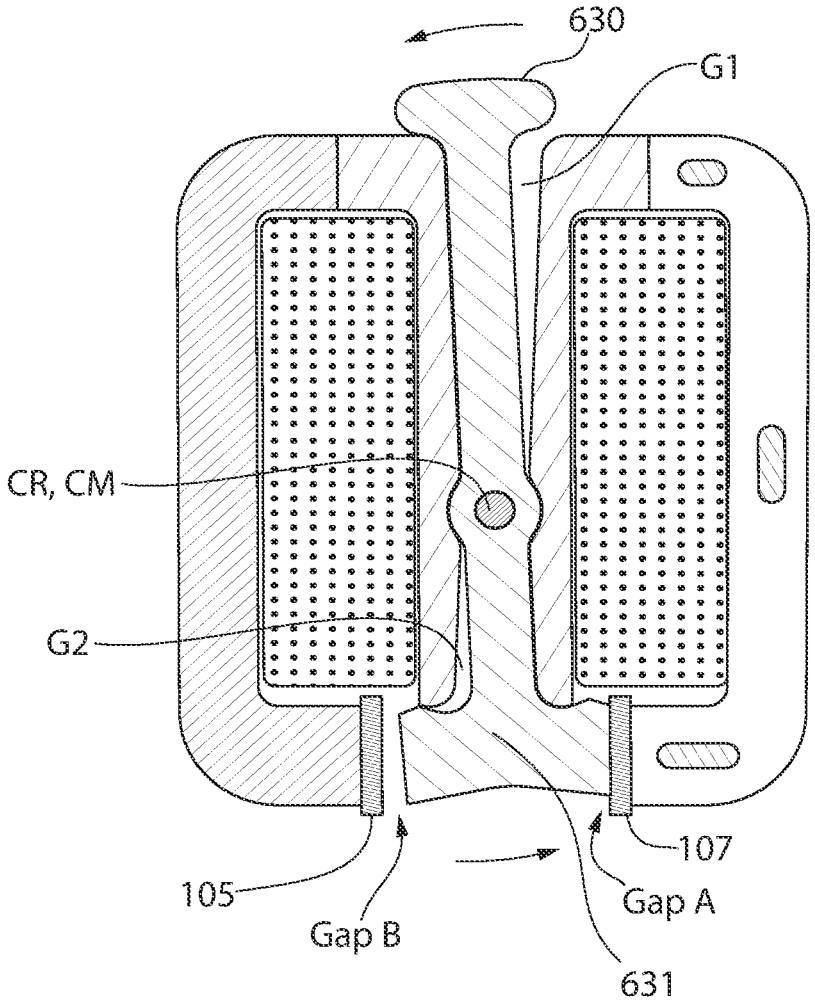
FIG. 33 is cross-sectional front view showing the actuator of FIGS. 24A and 24B in a first actuation position.
Figure 34:
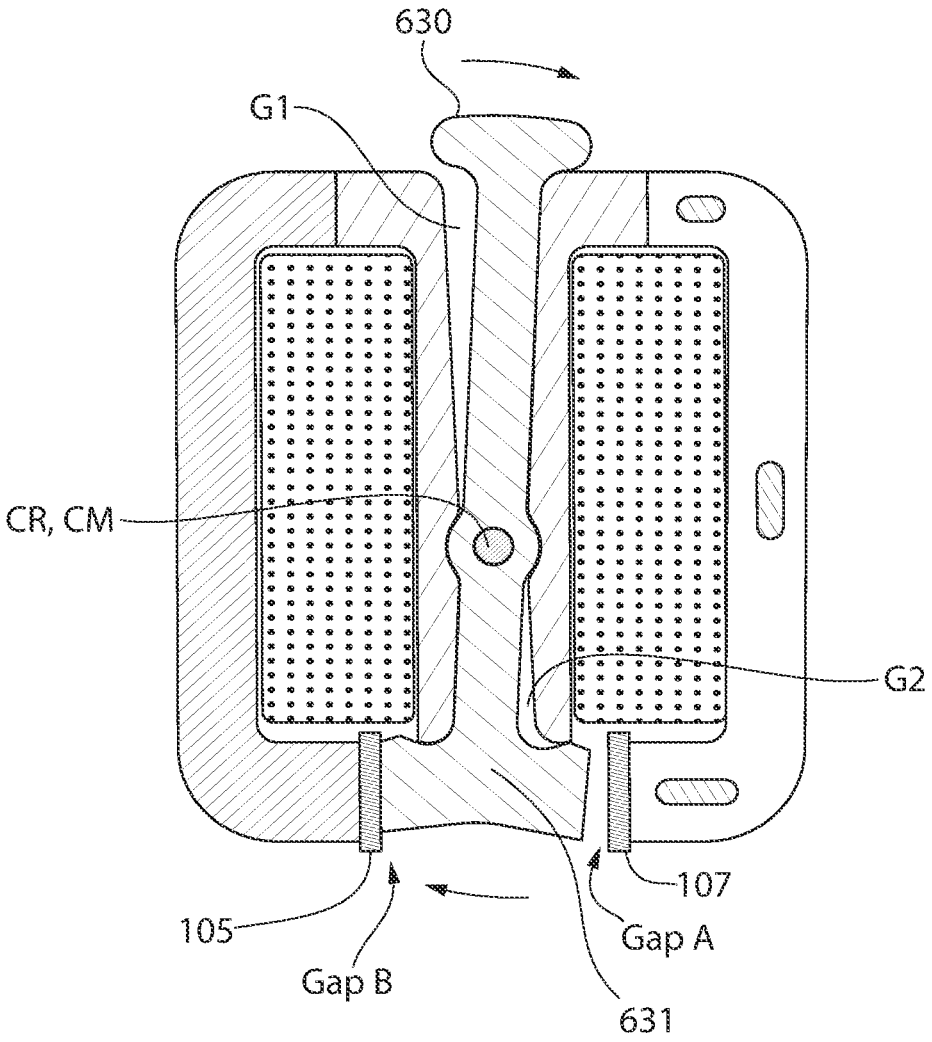
FIG. 34 is a cross-sectional front view showing the actuator of FIGS. 24A and 24B in a second actuation position.

When actuator 600 is in the first actuation position shown in FIG. 33, an upper interspace G1 is formed in longitudinal cavity 609 above pivot pin 614 between the rotating member 610 and inner yoke 604 on the upper right side of the rotating member, and a lower interspace G2 is formed on the left side of the rotating member below the pivot pin. When actuator 600 is in the second actuation position shown in FIG. 34, the opposite locations of the upper and lower interspaces G1, G2 are present resulting from the pivotable movement of the rotating member. Interspaces G1 and G2, comprised of air, are relatively narrow and shielded inside the inner yoke 604, thereby advantageously minimizing any accumulation of dust and/or debris from the firearm therein that might adversely impact motion and actuation of the rotating member 610. The actuator 600 may therefore be less susceptible to contamination and corresponding operating malfunctions or decrease in speed of actuation than unsheathed actuator embodiments particularly when the firearm is exposed to harsh operating environments (e.g. dust, mud, etc.).

The stationary yoke 601, including outer and inner yokes 602, 604, and the rotating member 104 may be formed of any suitable ferromagnetic metal capable of being magnetized, such as without limitation iron, steel, nickel, etc. In one embodiment, these parts may be formed by metal injection molding. However, other suitable fabrication methods may be used including casting, forging, machining, extrusions, etc.

Figure 25:
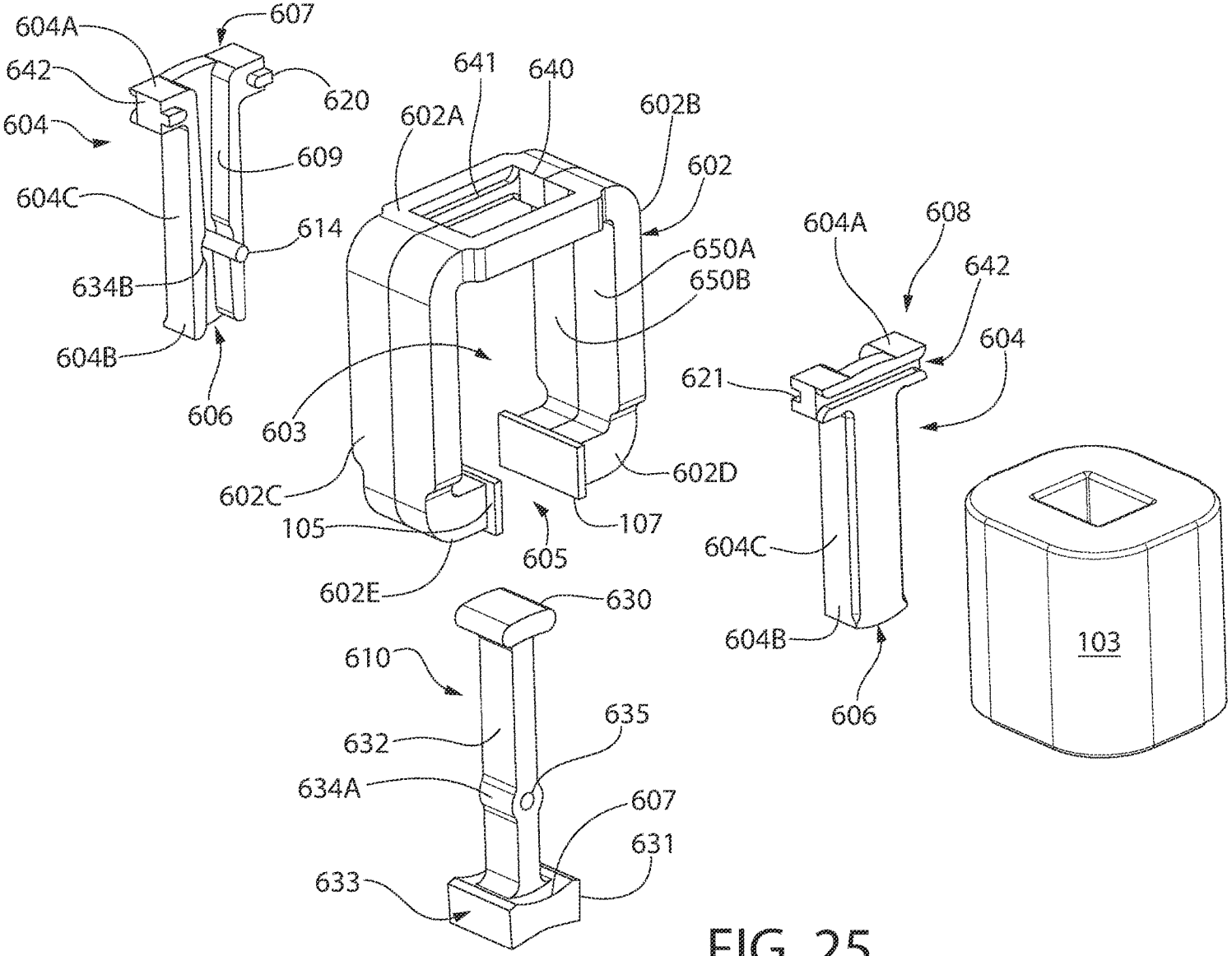
FIG. 25 is an exploded view thereof.
Figure 27:
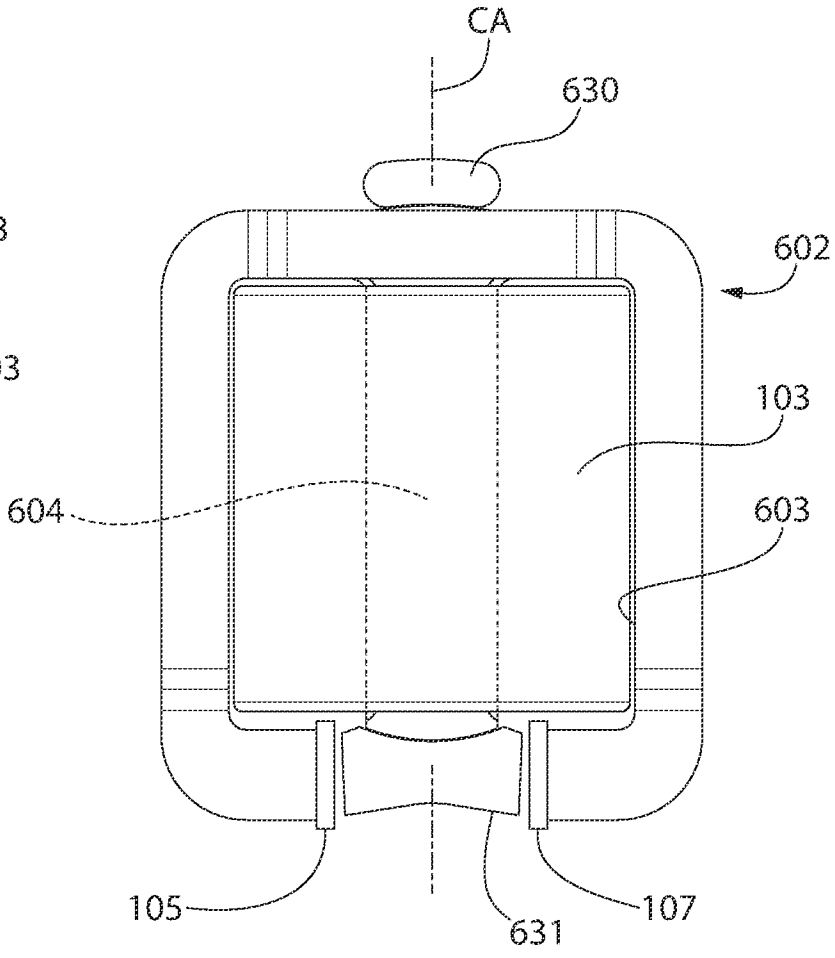
FIG. 27 is a front view thereof.
Figure 26:
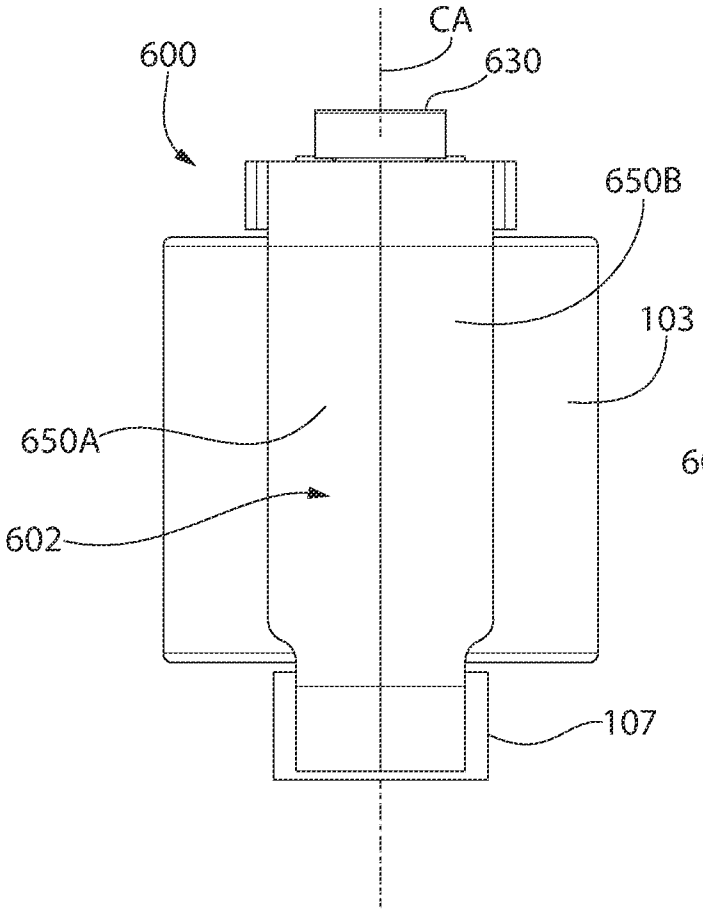
FIG. 26 is a side view thereof.
Figure 28:
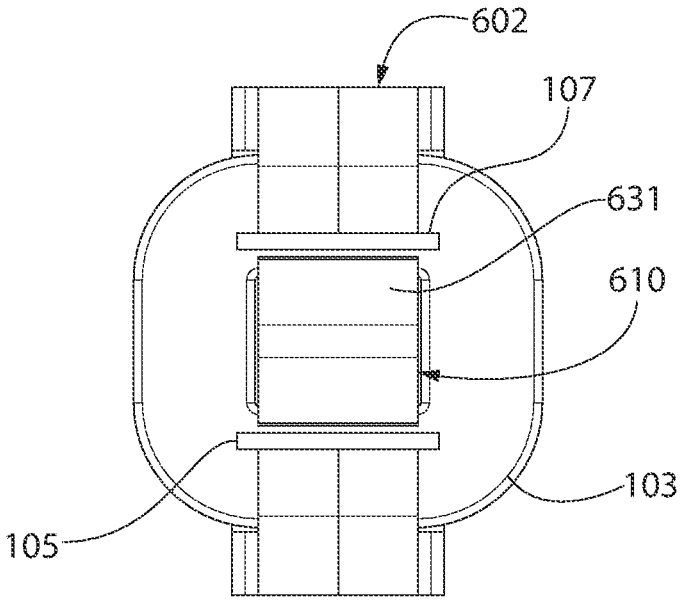
FIG. 28 is a bottom view thereof.
Figure 29:
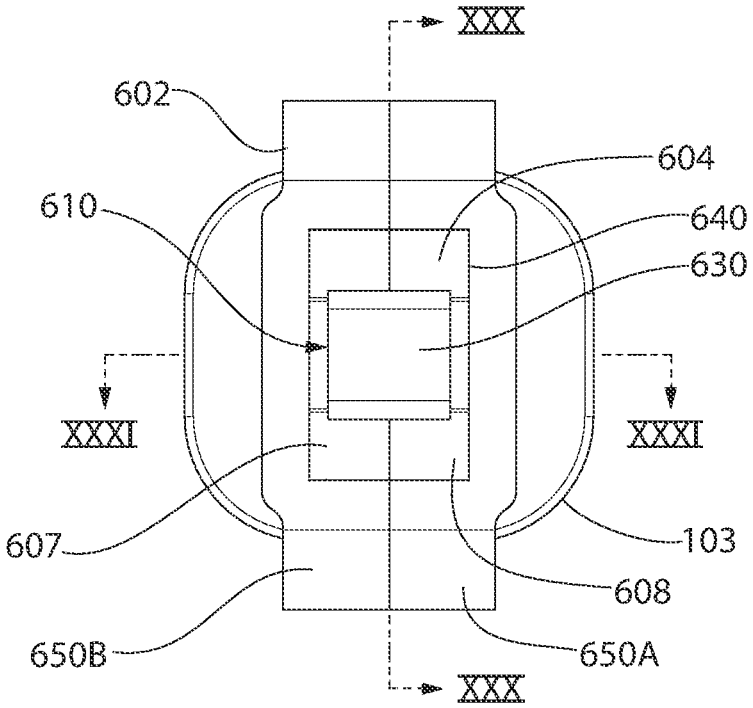
FIG. 29 is a top view thereof.
Figure 31:
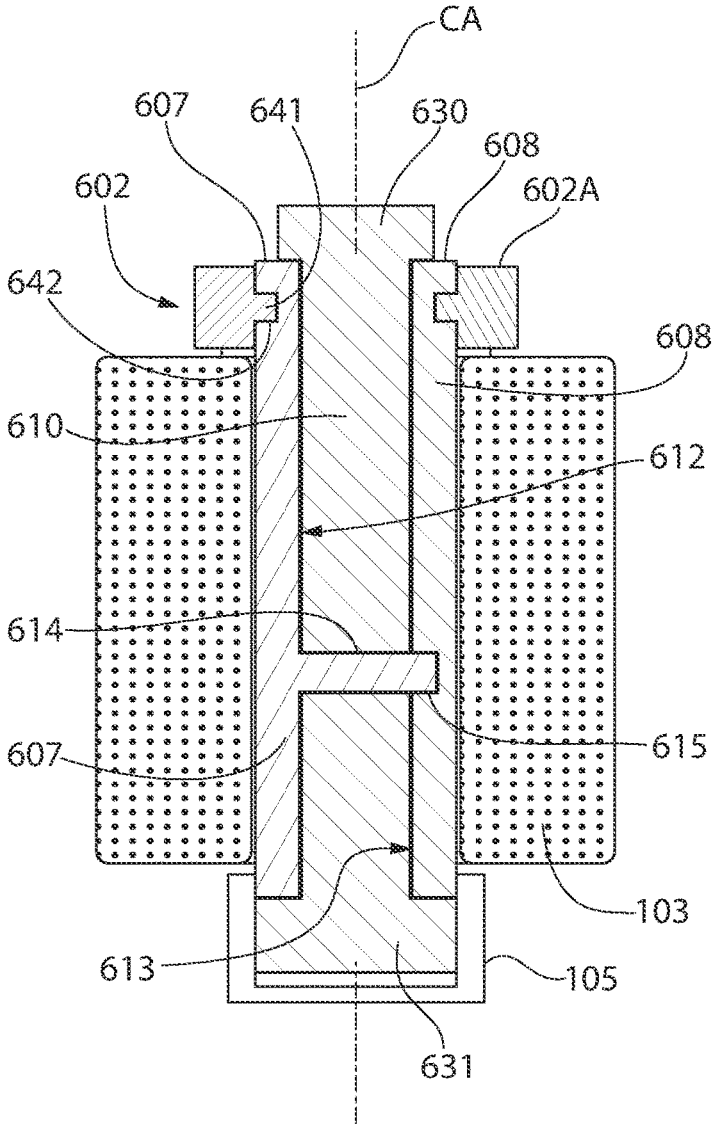
FIG. 31 is a cross-sectional side view taken from FIG. 30.

A method for assembling actuator 600 will now be summarized. Referring generally to FIGS. 25 and 31, rotating member 610 is first mounted on pivot pin 614 on half-section 607 of the inner yoke 604. The other half-section 608 is then attached to half-section 607 by inserting pin 614 into socket 615 of half-section 608, and tabs 620 into slots 621. The electrical coil 103 may next be wound around the inner yoke 604 and rotating member 610 assembly. This assembly of the inner yoke 604, rotating member 610, and coil 103 may then be positioned and sandwiched between the front and rear half-sections 650A and 650B of outer yoke 602, which are coupled together via interlocking tabs 651 and slots 652. Inner yoke 604 is mounted in a cantilevered manner to the outer yoke 602 at the top receptacle 640 of the outer yoke, as previously described herein. The actuator may then be mounted in the firearm (or other non-firearm apparatus in which the actuator 600 might be deployed) in any desired orientation necessary to interface directly or indirectly with the trigger-actuated firing mechanism of the firearm. Coil 103 may then be electrically connected to the on-board power source.

It bears noting that because the rotating member 610 is movably disposed inside the central inner yoke 604 (which remains stationary during movement of the rotating member), the coil 103 wound around the inner yoke does not bind or interfere with the movement of the rotating member whatsoever to ensure fast snap-like action between the two actuation positions.

Although the inner yoke 604 is disclosed and shown as a discrete or separate part from the outer yoke 602, the invention is not so limited. In other possible embodiments, the rear half-section 607 of inner yoke 604 may be formed as an integral unitary and monolithic structural part of the rear half-section 650B of outer yoke 602. The same may be done for the front half-sections 608 and 650A of the inner and outer yokes 604 and 602, respectively. The rotating member 610 may still be installed in the same manner described above in cavity 609 of the inner yoke 604, and the half-sections of the monolithic inner yoke and outer yoke may be coupled together in a single step. Coil 103 may then be wound around the completed yoke assembly 601.

It will be appreciated that aspects of electromagnetic actuator 600 have been described with respect to vertical or horizontal orientation of various components for ease of description only. The actuator 600 may be mounted and used in any orientation necessary which is dictated by the specific application without any adverse effect on the actuators performance and operations. Accordingly, these orientations are not limiting of the actuator or invention.

Coil Assembly Mounted Rotating Member Embodiments

Figure 35:
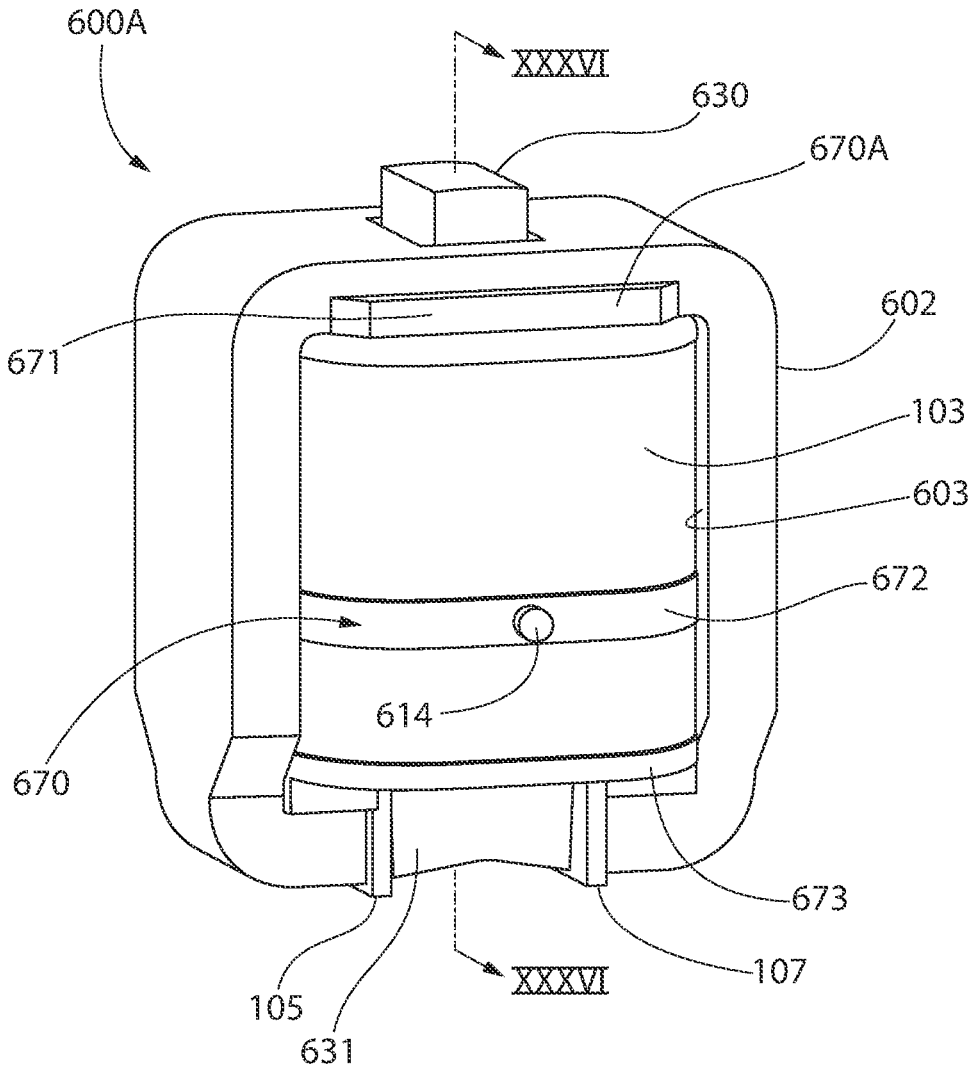
FIG. 35 shows a second alternative embodiment of an electromagnetic actuator with a coil assembly mounted rotating member.
Figure 36:
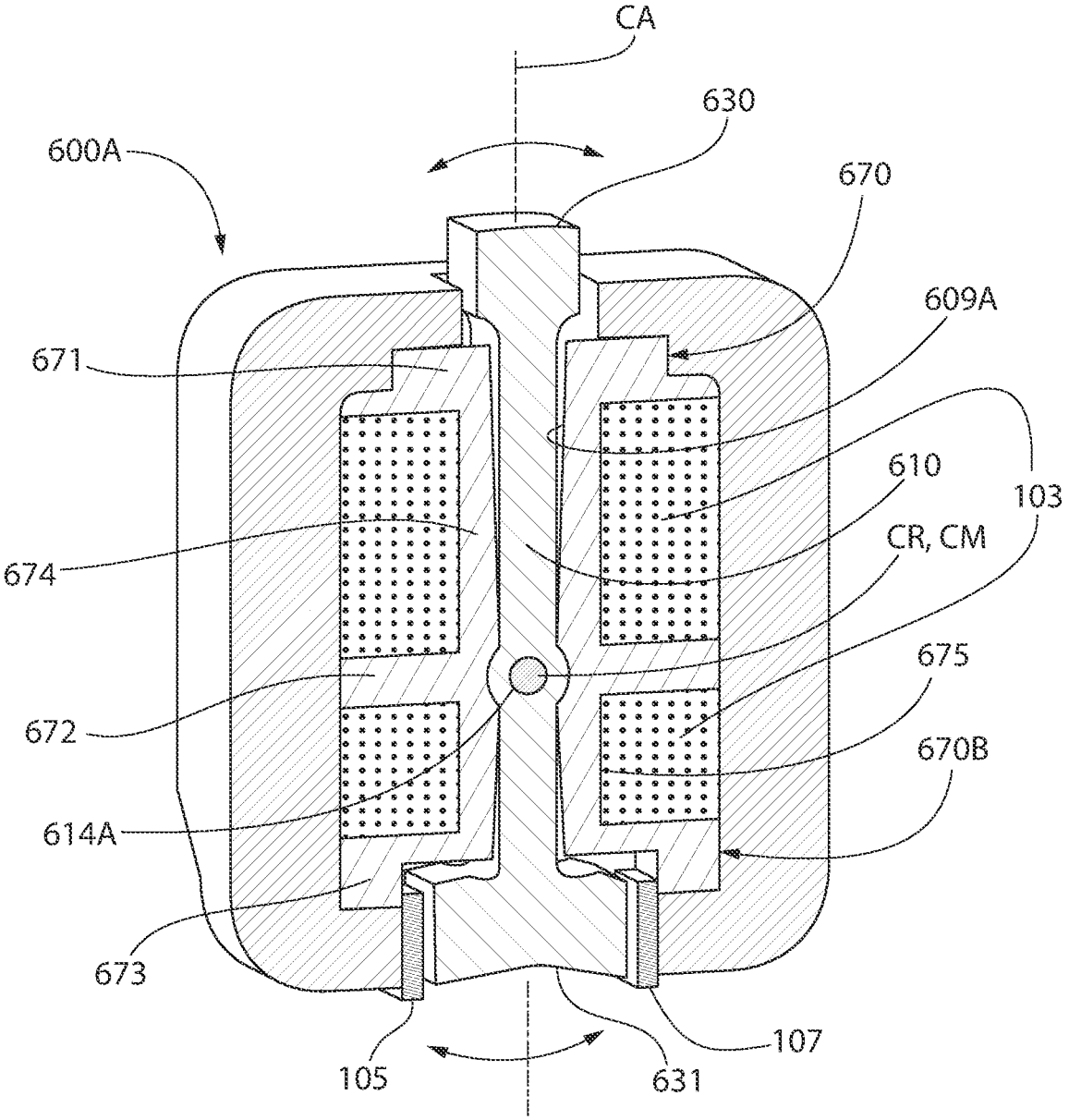
FIG. 36 is cross-sectional view thereof.

FIGS. 35 and 36 depict another embodiment of the dynamically balanced, dual-acting bistable electromagnetic actuator 600A. FIG. 35 is a front view of the actuator and FIG. 36 is a cross-sectional view thereof. In this alternate construction of actuator 600, actuator 600A has no central inner yoke 604 and only the generally annular shaped outer yoke 602. Rotating member 610 is instead pivotably mounted about pivot pin 614 to a bobbin or spool 670 on which the windings of coil 103 are wound around. This configuration simplifies fabrication of the actuator yoke assembly 601. In addition, the rotating member 610 is advantageously protected from physical interference from the coil windings when wound around the actuator that might possibly impede movement and response speed of the rotating member when actuated.

Coil spool 670 may include a top flange 671, intermediate flange 672, and bottom flange 673. The flanges 671-673 are engaged with and supported by the outer yoke 602 as shown to provide a stable coil mounting. A vertically elongated longitudinal central section 674 extends from the top flange 671 to the bottom flange 673 along central axis CA. Central section 671 may have a lateral width less than the flanges 671-673 and defines outwardly open receptacles for receiving and retaining the coil windings which are wound around the central section. Flanges 671-673 may have a lateral width at least the same or larger than the coil 103 to protect the windings.

Coil spool 670 in one embodiment may be made of a non-metal material such as a suitable plastic. Spool 670 may therefore not be a magnetic material like outer yoke 602 and rotating member 610. The opposing lines of magnetic flux in actuator 610A will flow through the rotating member 610 alone, unlike actuator 600 in which the lines of flux flow through both the rotating member and inner yoke 604.

Central section 671 defines longitudinal cavity 609A which is configured the same in all aspects as cavity 609 defined by the inner yoke 604 in the embodiment of actuator 600 shown in FIGS. 30-34. Vertically elongated rotating member 610 is pivotably mounted in central space 603 defined by the outer yoke 602 about the center of rotation CR defined by pivot pin 614A. Specifically, rotating member 610 is movably disposed in longitudinal cavity 609A defined by longitudinal central section 674 of the coil spool 670. Pin 614A is perpendicularly oriented to central axis CA and similar in all respects to pin 614 described above, which may have numerous mounting variations. In this case, however, pivot pin 614A is supported by the central section 674 of the coil spool 670.

As shown and described herein, the laterally elongated top operating end protrusion 630 and bottom actuating end protrusion 631 may be laterally wider than the vertically elongated intermediate portion 632 of the rotating member 610. To allow mounting and placement of the rotating member 610 inside cavity 609A, the coil spool 670 may be formed in a front half-section 670A and rear half-section 670B in a similar manner to inner yoke 604. The half-sections 670A, 670B may be joined together by any suitable mechanical means after the rotating member 610 is mounted in cavity 609A, such as for example by adhesives, fasteners, pins, rivets, sonic welding, etc.

It bears noting that the intermediate flange 672 provides additional lateral support for the pivot pin 614. However, in some embodiments, the intermediate flange 672 may be omitted. The center of mass CM is sufficiently close to the center of rotation CR of the rotating member such that random linear acceleration forces acting on the actuator from any direction will not generate sufficient force to overcome the static holding torque of the permanent magnets in a plane perpendicular to the axis of rotation and change position of the actuator. CM may therefore be substantially coaxial with CR.

Actuator 600A is the same as actuator 600 in all other aspects, features, and functionality as previously described. Accordingly, it will not be repeated here for the sake of brevity.

FIGS. 38-48B depict an alternative embodiment of a dynamically balanced, dual-acting bistable electromagnetic actuator in which the rotating member is instead pivotably mounted about a pivot axis defined by a non-magnetic bobbin or spool 870 on which the windings of coil 103 are wound. In this embodiment, the design and function of spool 870 and the rotating member 810 is similar to spool 670 and rotating member 610 previously described herein above, but different in some notable aspects which advantageously provides a compact actuator and simplifies assembly of the actuator. The present rotating member 810 is still protected from physical interference from the coil windings when wound around the actuator that might possibly impede movement and response speed of the rotating member when actuated.

The present outer yoke 802 may be similar in design and construction to yoke 602 previously described herein in FIGS. 23-36 and also includes two vertically split front and rear half-sections 850A and 8650B. Yoke 802 collectively formed by the half-sections when joined together thus may also comprise a common horizontal top section 702A, downwardly extending vertical right and left sections 802B, 802C spaced laterally apart, and inwardly turned bottom sections 802D, 802E at the bottom of the right and left sections. The horizontal top section 802A defines axially open receptacle 840 (i.e. upwardly and downwardly open) configured to movably received the top operating end 830 of rotating member 810 therein. The bottom sections 802D, 802E of the yoke are not joined and horizontally/laterally spaced apart to define bottom operating air opening or gap 805 which communicates with the central space 803 of the outer yoke configured for mounting spool 870 therein. The air gap is configured to receive the actuating end protrusion 831 of rotating member 810 as further described herein. The two half-sections 850A, 850B of the yoke 802 may be coupled together by any suitable mechanical means, such as for example without limitation adhesives, fasteners such as screws or rivets, welding or soldering, etc. The manner of coupling is not limiting of the invention.

Rotating member 810 may be similar in design and construction to rotating member 610 previously described herein. Accordingly, rotating member 810 also has a vertically elongated body including a top operating end protrusion 830, bottom actuating end protrusion 831, and intermediate portion 832 extending therebetween. Both top operating end protrusion 730 and bottom actuating end protrusion 831 may be laterally/horizontally broadened relative to the intermediate portion 832 in one embodiment. In one embodiment, intermediate portion 832 of actuator 800 may have non-parallel lateral sides 832A, 832B above and below the pivot axis PA. The lateral sides diverge and may be spaced apart the broadest at the pivot axis PA, and converge and narrow moving towards each of the top and bottom ends of the rotating member. The non-parallel sides 832A-B provide space for the rotating member 810 to pivot from side to side inside the spool to allow full movement and actuation of the actuator. The intermediate portion 832 of rotating member 810 may be rectilinear in transverse cross-sectional shape. Operating end protrusion 830 is configured to interface with a mechanical linkage of the firearm. When the electromagnetic actuator 800 is fully assembled, the operating end protrusion projects upwards beyond the outer yoke 802 to engage the mechanical linkage.

Operating end protrusion 830 of electromagnetic actuator 800 may interface with any type of mechanical linkage which may be a single component or interconnected assembly of components in the firearm intended to be operably controlled at least in part by the actuator 800 or any of the other actuators disclosed herein. Some examples include without limitation a component of the trigger or firing mechanism in either a firing mechanism release application to discharge the firearm, or an enabling/disabling function as described herein (see, e.g. FIGS. 1-3, 21-22, and 37). In another application, the mechanical linkage may be the trigger linkage to provide selective control of trigger pull such as hard double-action trigger pull for first round and lighter single action trigger pull for subsequent rounds selectable by the user. In another application, the mechanical linkage may be part of the firing control system to allow electronic control and selection for single shot, 2-3 round bursts, or full-auto firing modes. In another application, the mechanical linkage may be part of the trigger mechanism to allow the user to increase the trigger pull force, or to vibrate the trigger thereby providing a tactile sensory signal to the user to indicate they are approaching last round in the ammunition magazine.

In another application, the mechanical linkage may be part of the over/under shotgun fire control selector means. In another embodiment, the mechanical linkage may be static or dynamic control of unlock timing of the bolt of the firearm for unlocking and opening the breech, which would allow adjustment of the bolt lockup and unlock timing during cycling the action when discharging the firearm. In another application, the mechanical linkage may be static or dynamic control or regulation of the gas port in a gas-operated firearm to adjust the pressure of combustion gas bled off the barrel which available for cycling the action of the firearm. This gas regulator application allows the gas pressure to be adjusted to compensate for firing different type ammunition cartridges having different powder charges. In another application, the mechanical linkage may be application of an electro-mechanical trigger to allow interruption of the timing of a trigger pull event and subsequent firing event, such as found in fire-by-wire precision-guided tracking and fire control systems used to override the timing between the trigger pull event and the fire event based on external electronic sensing and authorization control received from a targeting imaging system that indicates the firearm has acquired and is on target. In another application, the mechanical linkage may be part of a recoil adjustment mechanism using the electronically controlled actuators described herein to selectively switch in/out resistive elements such as springs or engagement arms that contact elastomeric components to provide a means to change the distribution of recoil resistance. For example, a selectable engagement arm could be allowed to engage with an elastomeric damper just prior to the bolt end of travel under one condition, but moved out of alignment to not engage the damper in a second condition. Thus providing two different selectable energy transfer timings for the bolt travel when cycling the action of the firearm. Accordingly, there are numerous applications of electromagnetic actuator 800 or any of the other actuators disclosed herein to interface with many different mechanical linkages that may be found in the firearm.

In other possible implementations, the mechanical linkage interfacing with the electromagnetic actuator 800 or any of the other actuators disclosed herein may be a non-firearm related application such as for example power tools, transport vehicles (e.g. automotive, aviation/aeronautics, nautical/maritime, agricultural, etc.), and numerous other fields and mechanical/electro-mechanical devices which may benefit from the fast-acting compact actuators disclosed herein. Accordingly, there are virtually limitless applications for the disclosed electromagnetic actuators.

The actuating end protrusion 831 of rotating member 810 may have a generally double-faced hammer configuration similar to rotating member 610 and includes two opposite and outwardly facing side actuation surfaces 833. When the rotating member 810 of actuator 800 is cycled between its two actuation positions, the actuation surfaces 833 are arranged to alternatingly engage permanent magnets 105, 107 on either side of air gap 805 in the outer yoke 702. Magnets 105, 107 may be deposed on opposite sides of the bottom opening 805 on outer yoke bottom portions 802D, 802E as shown. In other possible embodiments contemplated, magnets 105, 107 may instead be affixed to the actuation surfaces 833 of the rotating member 610 adjacent bottom opening 605. Alternatively, magnets 105, 107 may be disposed at other locations on the outer yoke 802 with one magnet each within the first magnetic flux circuit A and second magnetic flux circuit B (see, e.g. FIG. 48A). Preferably, however, the permanent magnets 105, 107 are disposed proximate to bottom opening 805 of the outer yoke 802 for direct engagement with the rotating member 810 to maximize the magnetic attraction forces therebetween and to simplify fabrication of the actuator 800.

In one embodiment, the opposite outwardly facing side actuation surfaces 833 of actuating end protrusion 831 may be radiused and arcuately convexly curved to alternatingly engage one or the other of the permanent magnets when the rotating member 810 moves between the first and second actuation positions. One advantage of the radius surface is to ensure contact is made with the permanent magnets 105, 107 in approximately the center of the well supported area at the center of the magnet surface. The magnets may be intentionally oversized relative to the adjoining area of the outer yoke 810 (i.e. bottom sections 802D-E) to minimize any flux redirection at the magnet-yoke interface. The unsupported overhanging area of the magnet could be cracked if force is applied to the unsupported magnet surface. Another advantage of the radius design is that it provides a natural self-cleaning function. As the actuator moves back and forth, the radiused surface provides a sweeping action that will tend to displace any debris or contamination out of the air gap 805 area. A third advantage is that the radius provides a more deterministic location for parts tolerance stack-up where the rotating arms motion interacts with the preferably flat plate-type permanent magnets. The amount of the radius should be selected to be relatively small, just off planar, to ensure the center of the surface of the rotating member makes contact with the central area of the magnet surface but with a maximum of surface area contact between them. The convexly curved actuation surfaces may also be applied to all other embodiments of the rotating members disclosed herein such as rotating member 610.

With continuing reference to FIGS. 38-48B, the present embodiment of coil spool 870 may include radially-protruding annular top flange 871 and bottom flange 873 with the intermediate flange 672 of spool 670 being omitted. The present double-flanged spool allows for one continuous coil winding around the spool. Spool 870 in other constructions however may include the intermediate flange if desired. The flanges 871, 873 are engaged and supported by inwardly turned and facing bottom sections 802D, 802EA of the outer yoke 802 as shown to provide a stable coil mounting. When placed inside the central space 803 of yoke 802, the top and bottom flanges of the spool 870 are trapped between by bottom sections 802D, 802E and top section 802A of the yoke, thereby securing spool 870 in the yoke.

Vertically elongated longitudinal central section 874 of spool 870 extends from the top flange 871 to the bottom flange 873 along central axis CA. Central section 871 may have a lateral width less than the flanges 871, 873 and defines outwardly laterally open receptacles for receiving and retaining the coil windings which are wound around the central section. Flanges 871, 873 may have a lateral width at least the same or larger than the coil 103 to protect the windings.

Coil spool 870 in one embodiment may be made of a non-magnetic material such as plastic, aluminum, or others. Spool 870 may therefore not be a magnetic material unlike outer yoke 802 and rotating member 810. Similarly to actuator 600A, the opposing lines of magnetic flux formed by flux circuits A and B in actuator 800 will therefore flow through the centrally-located rotating member 810 alone (see, e.g. FIGS. 48A), unlike actuator 600 in which the lines of flux flow through both the rotating member and magnetic inner yoke 604.

Central section 871 defines longitudinal cavity 809 which is configured the same in all aspects as cavity 609 defined by the inner yoke 604 in the embodiment of actuator 600 shown in FIGS. 30-34. Vertically elongated rotating member 810 is pivotably mounted in central space 803 defined by the outer yoke 802 about the center of rotation CR and pivot axis PA defined by pivot pin 814. Specifically, rotating member 810 is movably disposed in longitudinal cavity 809 defined by longitudinal central section 874 of coil spool 870. Pin 814 is perpendicularly oriented to central axis CA of actuator 800 and similar in all respects to pin 614 described above, which may have numerous mounting variations. In this case, however, pivot pin 814 is extends through holes in and supported by the central section 874 of the coil spool 870. The pivot pin 614 may be held in place using an interference fit with the pin mounting hole in spool 870. Other attachment means of coupling the pin to spool may be uses such as without limitation adhesives, epoxy, swedging, or mechanical fastening techniques.

The center of mass CM of the actuator 800 may be designed to be sufficiently close to the center of rotation CR of the rotating member 810 such that random linear acceleration forces acting on the actuator from any direction will not generate sufficient force to overcome the static holding torque of the permanent magnets 105, 107 in a plane perpendicular to the axis of rotation and change position of the actuator. CM may therefore be substantially coaxial with CR and pivot axis PA.

In the embodiment shown in FIGS. 38-48B, coil spool 870 may have a generally tubular body with opposing top and bottom open ends to access longitudinal cavity 809 formed therebetween. The spool may have a monolithic unitary structure in some embodiment (best shown in FIGS. 48A-B). This allows the spool 870 to be molded or cast as a single piece with all features and appurtenances integrally formed therewith (e.g. flanges 871, 873, longitudinal cavity 809, etc.) to reduce fabrication costs and actuator assembly time. To accommodate use of a unitary spool, the rotating member 810 may be concomitantly configured to allow insertion into cavity 809 from at least one or a top of bottom direction. In the illustrated embodiment, the operating end protrusion 830 of rotating member 810 may not be laterally wider than the intermediate portion 832. This allows the operating protrusion end of the rotating member to be inserted completely through cavity 809 of coil spool 870 since operating end protrusion 830 has a lateral width smaller than the corresponding side-to-side lateral width of longitudinal cavity 809. The front to rear depth of operating end protrusion 830 is also smaller than the corresponding depth of the cavity. By contrast, the opposite actuating end protrusion 831 may have a lateral width larger than cavity 809 and cannot be inserted therein (see, e.g. FIG. 48A).

Figure 40:
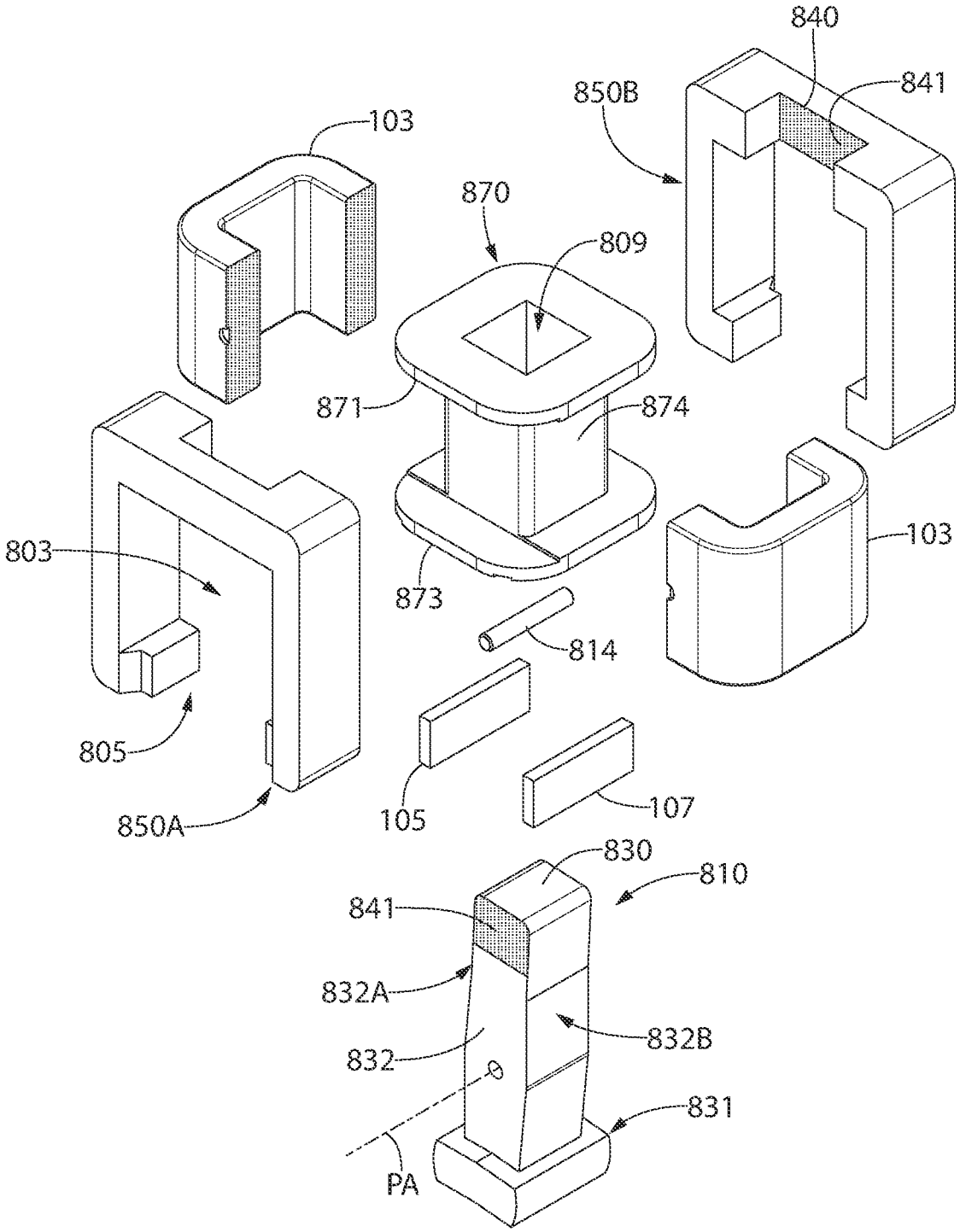
FIG. 40 is a top exploded view thereof.
Figure 41:
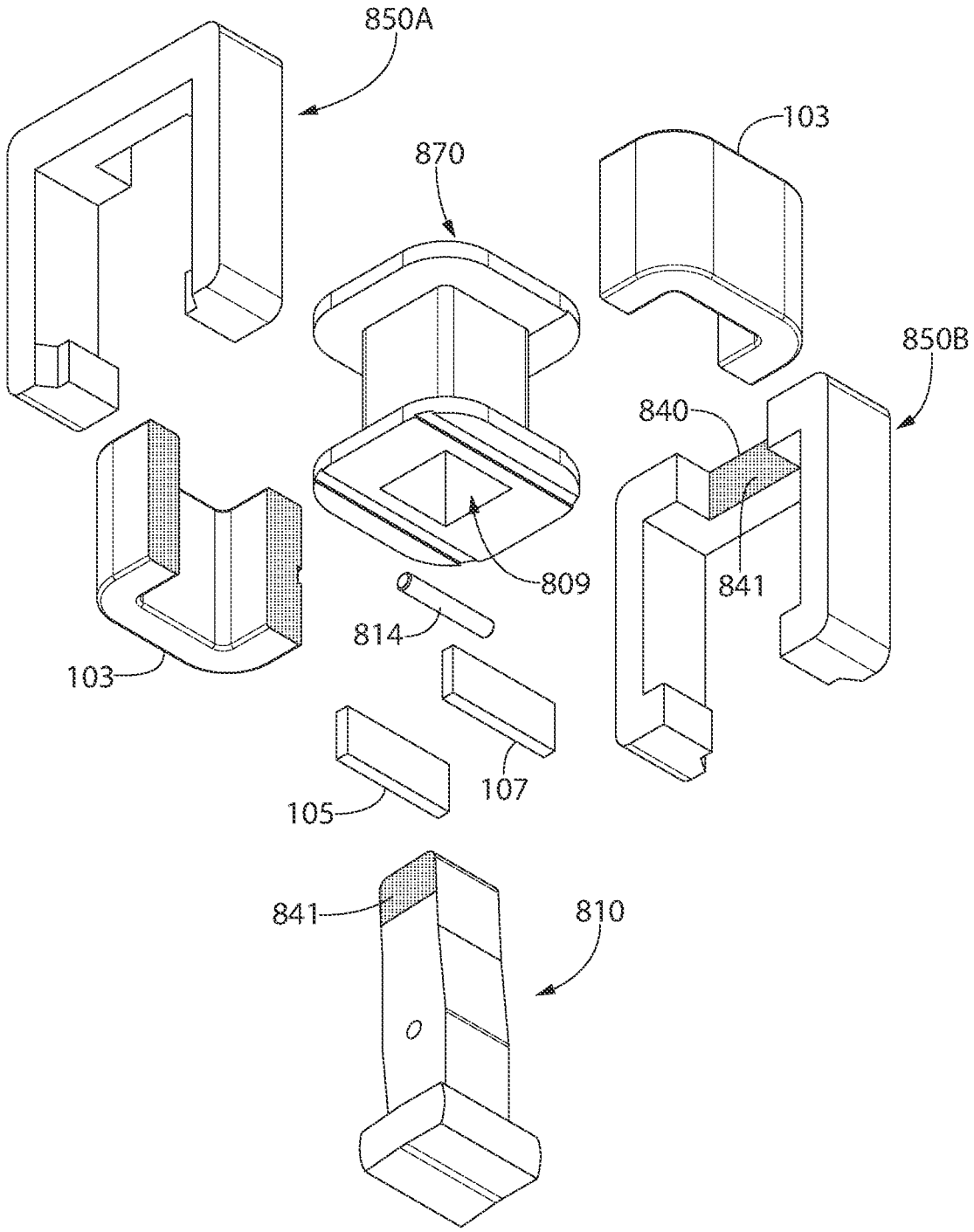
FIG. 41 is a bottom exploded view thereof.
Figure 42:
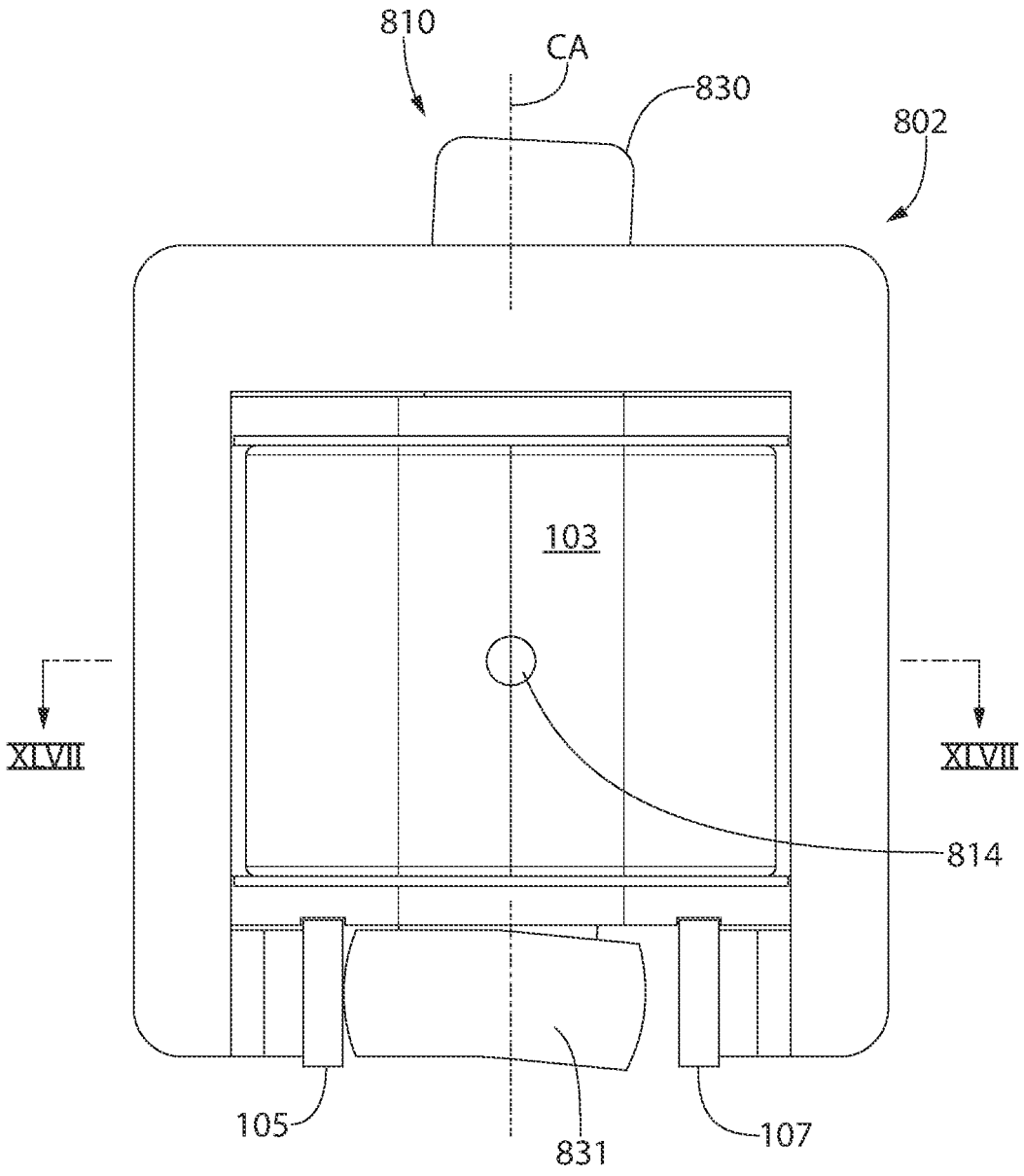
FIG. 42 is a front view thereof.
Figure 43:
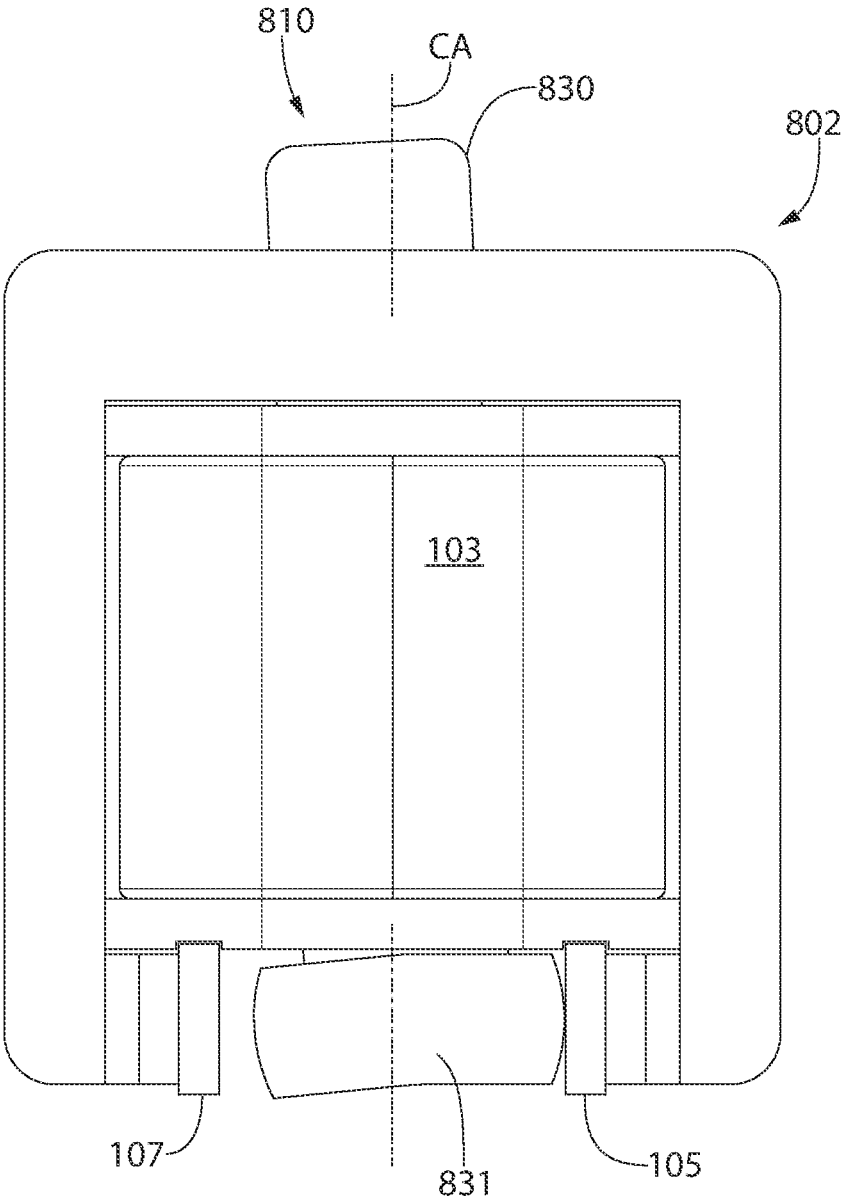
FIG. 43 is a rear view thereof.
Figure 44:
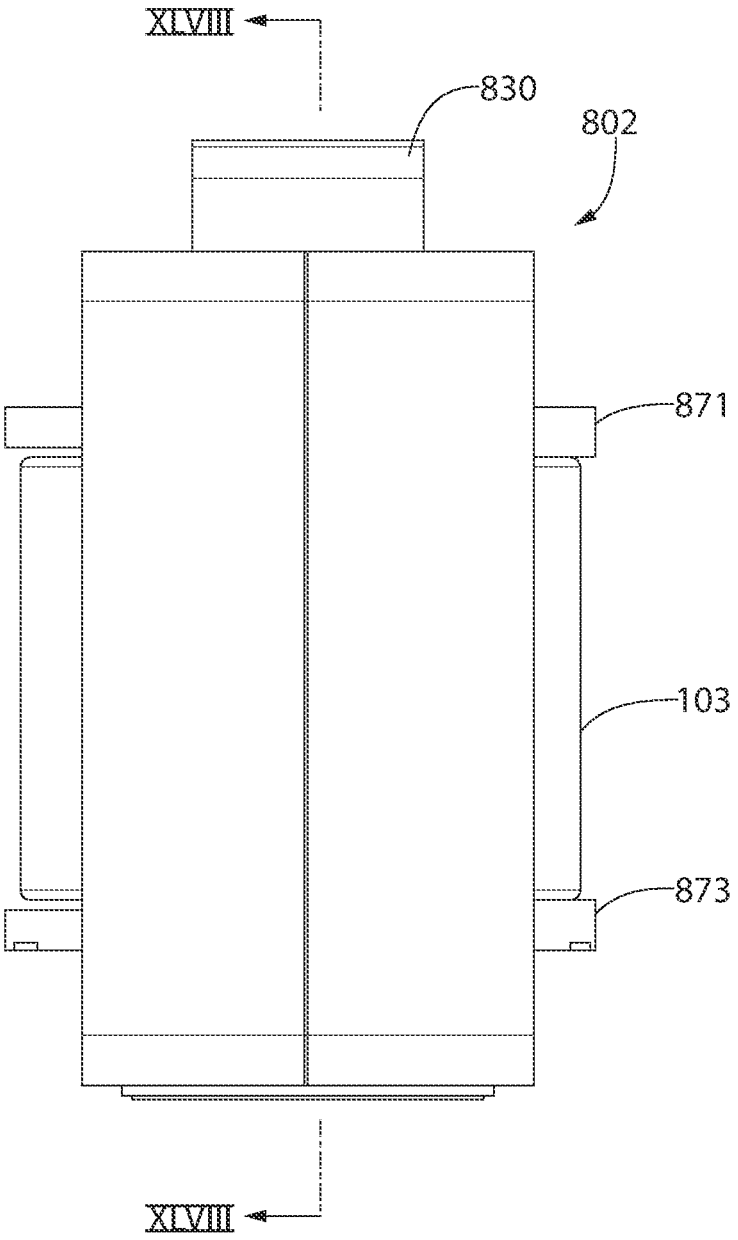
FIG. 44 is a side view thereof.
Figure 45:
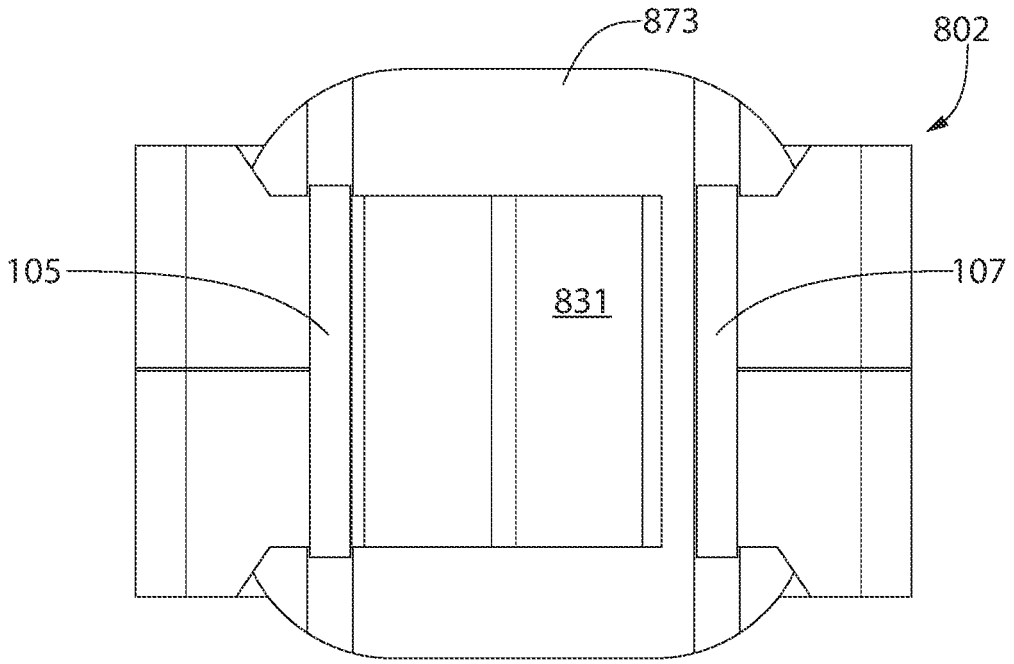
FIG. 45 is a bottom view thereof.
Figure 46:
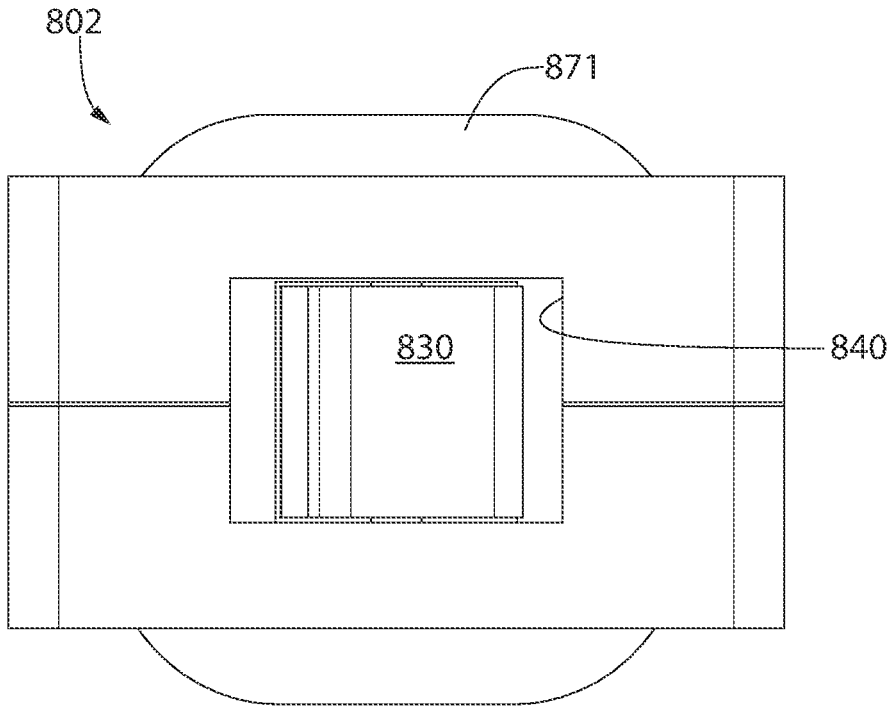
FIG. 46 is a top view thereof.
Figure 47:
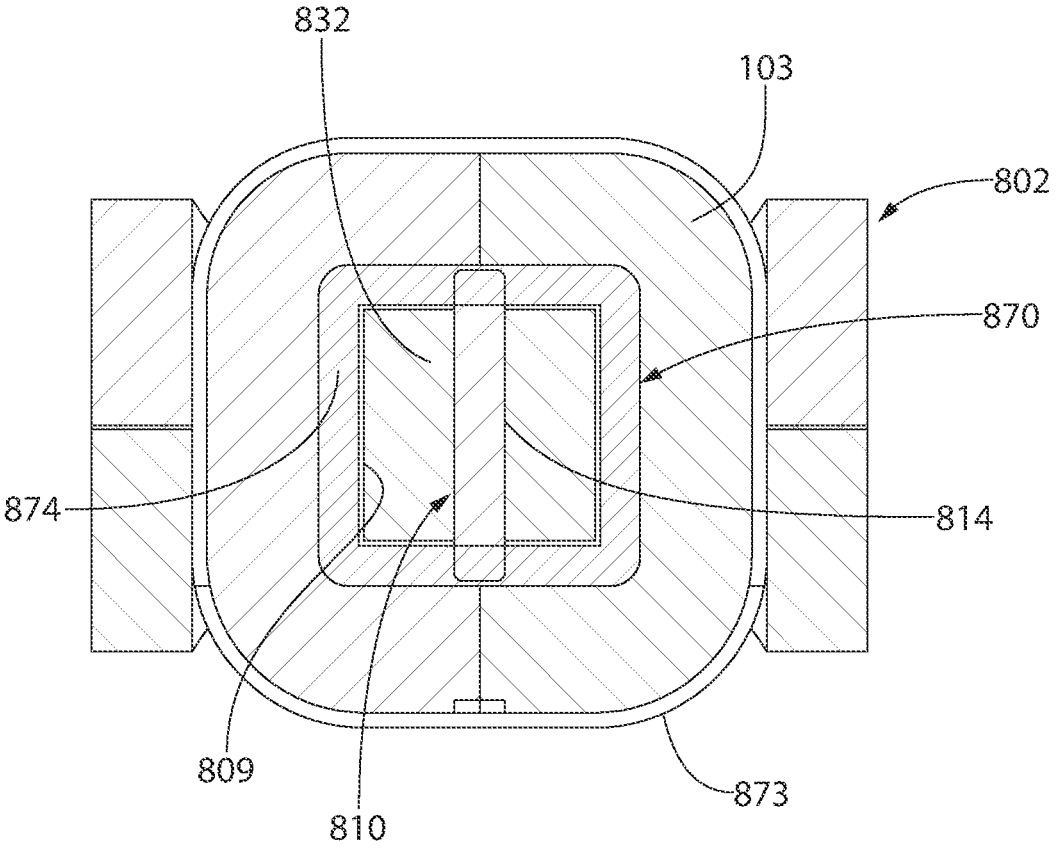
FIG. 47 is a transverse cross sectional view thereof.

It bears noting that although shown cut apart in the exploded parts views of FIGS. 40 and 41 for clarity of illustration, the coil 103 is one circumferentially continuous winding.

According to another aspect, the rotating member 810 and yoke 802 assembly may include friction reduction features for smooth pivotable movement of the rotating member. The transfer of magnetic flux into the rotating member 810 from the outer yoke 802 in the front to rear plane or direction is primarily through the front and rear sides of the top opening or receptacle 840 in the outer yoke and into the corresponding front and rear sides of the top operating end protrusion 830 of the rotating member. For freedom of rotation for the rotating member, some small space must be provided in the receptacle between the mating front and rear sides the yoke and rotating member to allow nonbinding freedom of motion. The magnetic flux entering the front and rear sides of the rotating member should ideally be evenly or uniformly distributed front to rear to keep the rotating member magnetically centered in the receptacle 840 for smooth actuator operation. In reality, however, small differences in the strength of the magazine flux lines will allow the rotating member to wander and be magnetically biased more towards either the front or rear side. The magnetic flux forces present with the smallest air gap at front or rear will create a magnetic sticking force to hold the rotating member against one of the front or rear sides. This creates drag on the rotating member 810 due to frictional surface forces that must be overcome by the rotating member when it pivots and rotates as the actuator 800 is actuated.

To alleviate the foregoing rotating member sticking issue, a barrier layer comprising a low friction material 841 may be disposed between each of a front and rear sides of the rotating member operating end protrusion 830 and the yoke 802 in the receptacle 840 between the rotating member and the outer yoke, as shown in FIGS. 40 and 41. The low friction material defines the barrier layer which eliminates the direct ferrous metal to metal interface between the rotating member and yoke within the confines of the yoke receptacle 840. This eliminates the rotating member drag issue advantageously providing smoother operation and motion of rotating member without sticking which could otherwise slow the responsiveness of the actuator. Accordingly, the low friction material 841 forming the barrier layer provides a bearing surface to minimize frictional forces. The low friction material 841 further beneficially keeps the rotating member operating end protrusion 830 centered in the receptacle 840 front to rear, thereby providing a more even balance of the magnetic flux entering the rotating member from the front and rear sides of the yoke 802.

The low friction material 841 may take several forms. For example, a simple flat element or shim of low friction material 841 could be used which is disposed at each of the front-to-front interface and rear-to-rear interface between the rotating member operating end protrusion 830 and front and rear sides of the yoke 802 within the receptacle 840. The front and rear low friction shims (2 total) may be fixedly attached to either the rotating member or the yoke. In some embodiments, low friction shims may be to each of the front and rear sides of both rotating member and yoke within the receptacle for ultra smooth operation. Alternatively, the low friction material 840 in other embodiments may comprise a low friction coating applied directly onto both front and rear side mating surfaces of the rotating member and yoke, or only one or the other of the rotating member or yoke. Many polymers have characteristics and properties which make good low friction bearing surfaces as well as being corrosive and chemically resistant, and self-lubricating. Accordingly, the low friction material 841 may be a polymeric coating such as for example without limitation phenolics, acetals, Teflon™ (PTFE-Polytetrafluoroethylene), nylon, and ultra high molecular weight polyethylene (UHMWPE), or similar. The low friction material 841 may also be used and applies to rotating member and yoke embodiments previously described herein such as actuators 600 and 600A.

Actuator 800 is generally the same as actuator 600 in all other aspects, features, and functionality as previously described. Accordingly, these details will not be repeated in detail here for the sake of brevity. Operation of actuator 800 will therefore only be briefly summarized for convenience of reference below.

Actuator 800 operates in a similar manner to that previously described herein for dynamically balanced and symmetric bistable electromagnetic actuators. Generally, applying an electric current to coil 103 wound around spool 870 creates a first magnetic flux circuit A and a second magnetic flux circuit B with lines of flux as shown in FIG. 30. The lines of flux created by flux circuits A and B act in opposite directions in the central rotating member 810, such that when a current is applied to the coil 103 it decreases the flux on the closed side of the actuator at air gap 805 while increasing the flux on the open side of the actuator. At the moment the actuator starts to move, the reluctance of the loops changes and causes a rapid re-direction of flux toward the closing side and away from the opening side. This rapid re-direction advantageously amplifies the opening force to create a very rapid snap-like motion of the actuator 800 suitable for firearm firing mechanism and other non-firearm related applications.

Figure 48A:
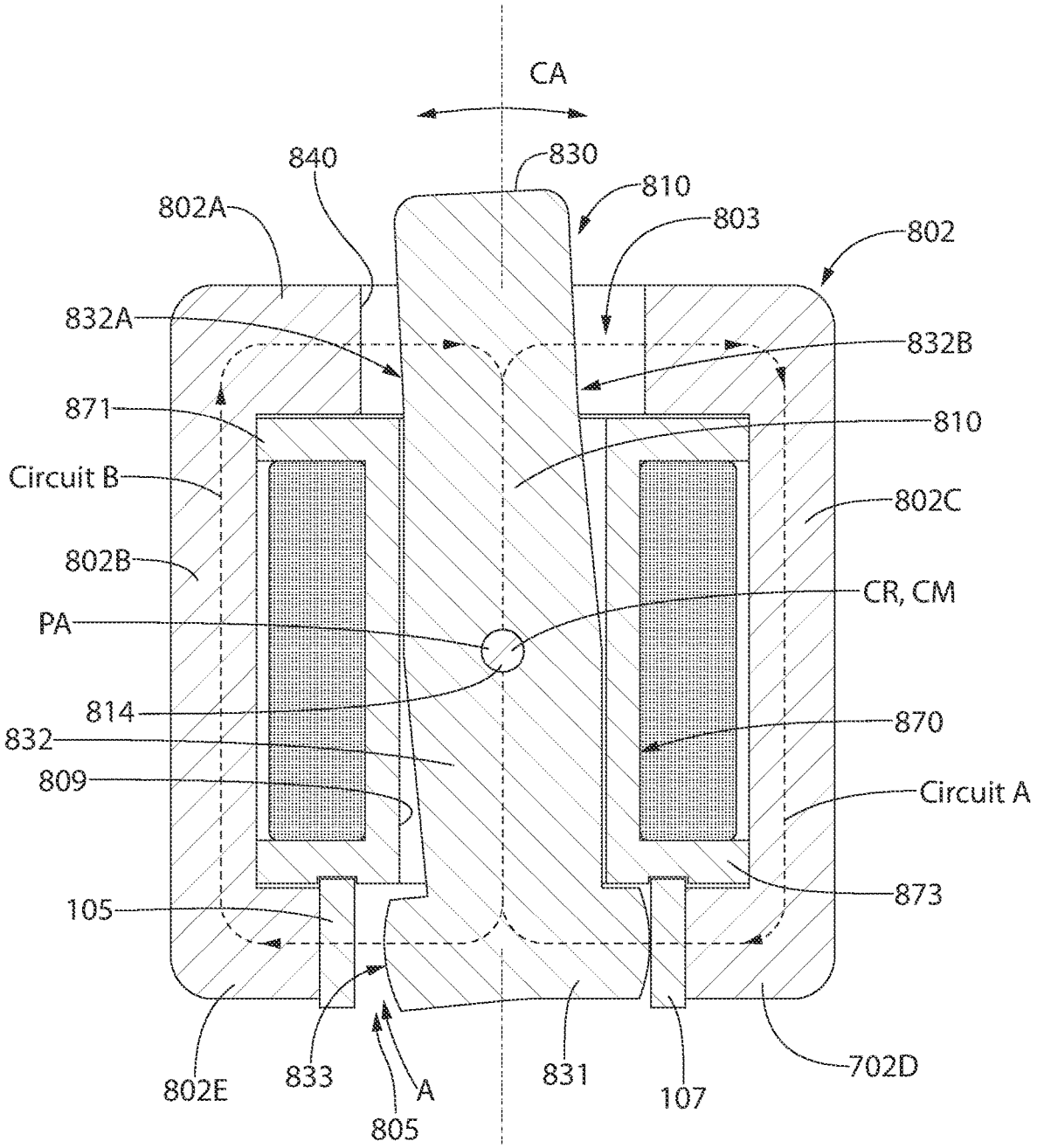
FIG. 48A is a front cross sectional view thereof showing the actuator in a first operating position.
Figure 48B:
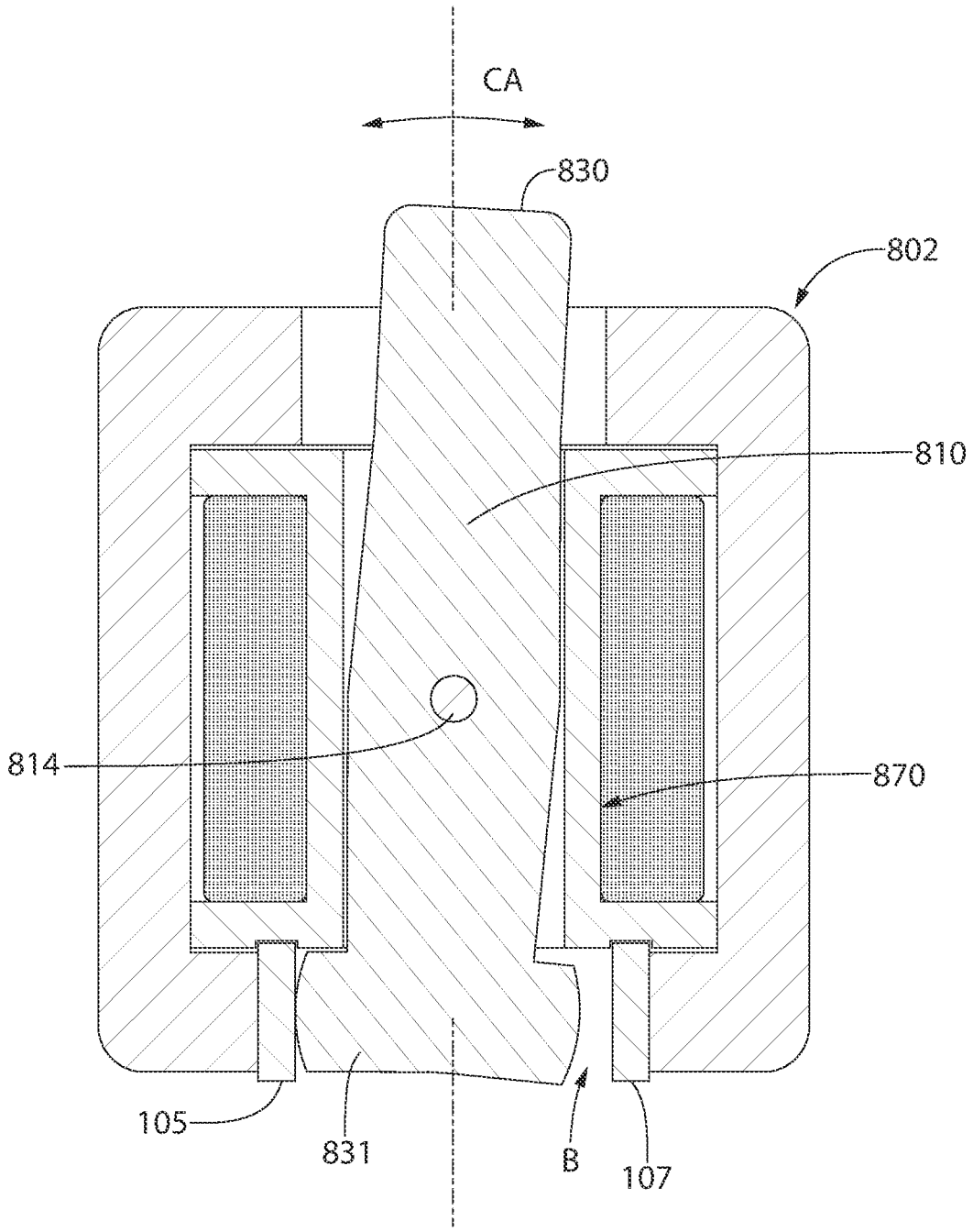
FIG. 48B is a front cross sectional view thereof showing the actuator in a second operating position.
Figure 50:
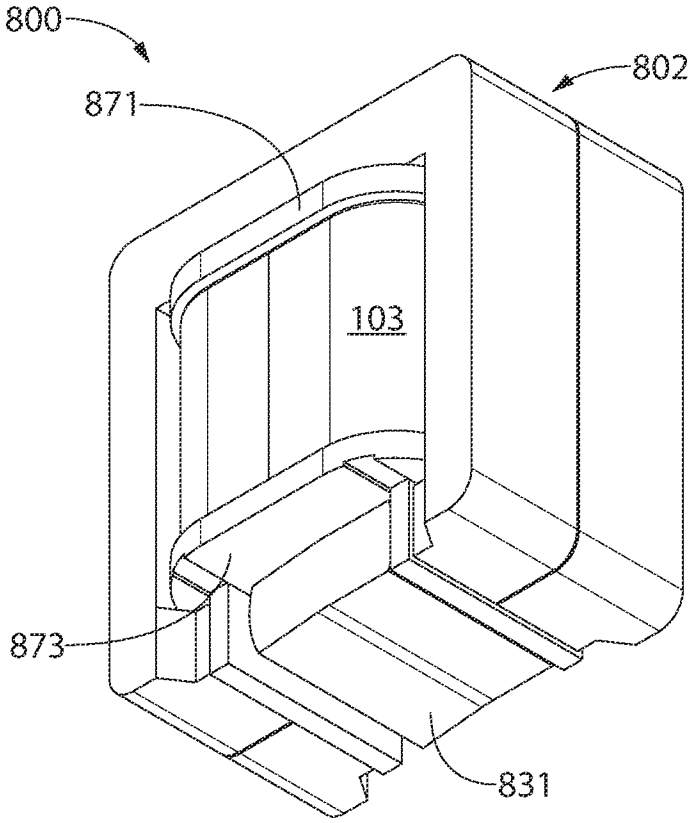
FIGS. 49 and 50 are top and bottom perspective views respectively of a fourth alternative embodiment of an electromagnetic actuator with a coil assembly mounted rotating member.
Figure 49:
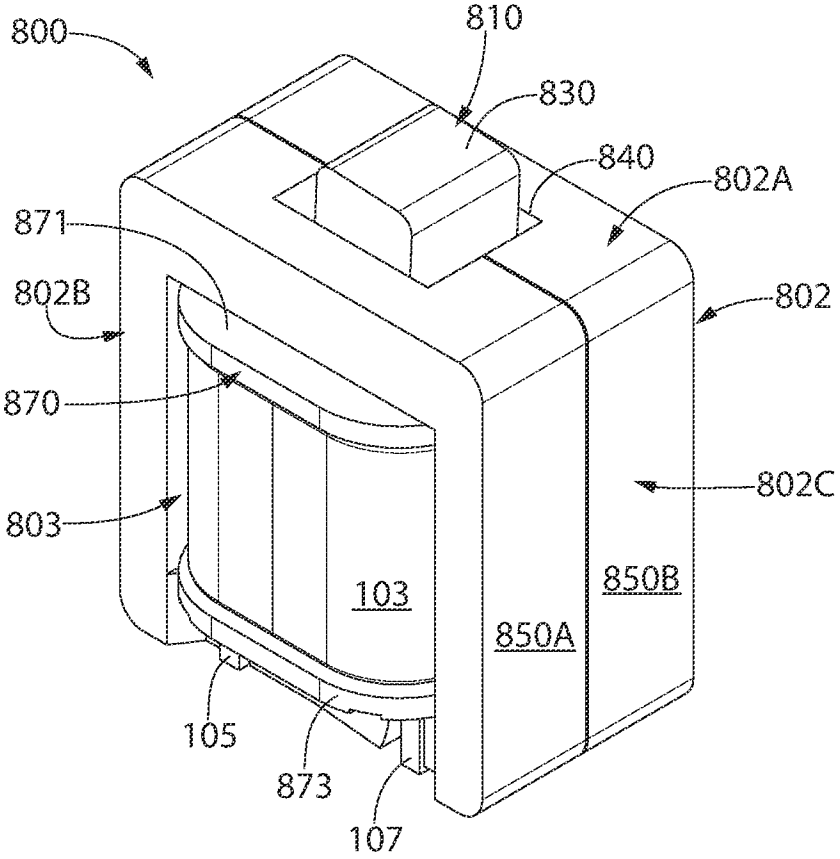

Applying electric current to the coil 103 and changing/reversing polarity causes the rotating member 810 of actuator 800 to alternatingly pivot or tilt back and forth from side to side in a toggle or rocking motion. Rotating member 810 is pivotably movable between a first actuation position (see, e.g. FIG. 48A) and a second actuation position (see, e.g. FIG. 48B). Each position alternatingly forms a closed air gap A or B on one side of the actuator 800 between the actuating end protrusion 831 of rotating member 810 and outer yoke 802 at magnets 105, 107, and concomitantly an open air gap A or B on the other side during the pivoting action of rotating member depending on the direction of tilt. The top operating end protrusion 830 of the rotating member 810 moves in an opposite direction to the bottom actuating end protrusion 831 for interfacing with the mechanical linkage of the firearm. In some non-limiting embodiments, the operating end protrusion 830 may act for either disabling or enabling the trigger-operated firing mechanism of a firearm in a blocking type application of the actuator 800, or to release a firing mechanism component or linkage in a release application of the actuator; examples of each being previously described herein. Actuator 800 may therefore be substituted for the actuators and applications previously shown and described herein. In the first actuation position, the actuating end protrusion 831 of rotating member 810 engages permanent magnet 107 (FIG. 48A). In the second actuation position, the actuating end protrusion 831 engages opposing magnet 105 (FIG. 48B). The arcuately rounded or curved-to-flat interface between outwardly facing side actuation surfaces 833 on each side of actuating end protrusion 831 and the planar permanent magnets 105, 107 can be seen in these figures. It bears noting that in other embodiments, a flat-to-flat rotating member to magnet interface may be used in other possible embodiment instead if suitable by providing the actuation surfaces 833 with a flat or planar profile. As previously described herein, the permanent magnets create a static magnetic holding force or torque which resists changes in position of the actuator due to dynamic external forces that might be applied to actuator such as via firearm drop tests.

FIGS. 49-56 depict an alternative embodiment of actuator 800 in which a pinless pivot connection is formed between rotating member 810 and coil spool 870. In lieu of using pivot pin 814, it bears noting that the rotating member 810 is naturally held in place or position within cavity 809 of coil spool 870 by the magnetic flux forces or field acting within the outer yoke 802. Accordingly, a simple pinless positioning and alignment feature to help define the pivot point or axis PA of the rotating member 810 is all that is necessary to hold the position of the rotating member in the spool and yoke assembly while allowing free motion of the rotating member.

In some embodiments, therefore, a pinless pivot axis may be defined by a fulcrum feature 880 formed on either the rotating member 810 or coil spool 870, and the remaining other one of the rotating member or spool comprises a complementary configured fulcrum engagement feature 881. In the illustrated embodiment seen in FIGS. 51-52 and 55A-B, the fulcrum feature 880 comprises a raised wedge-shaped fulcrum protrusion 882 formed on each lateral side 832A-B of intermediate portion 832 of the rotating member 810. The outwardly and laterally extending protrusions 882 are preferably arranged directly opposite each other. The fulcrum engagement feature 881 may comprise complementary-configured V-shaped notches or recesses 883 formed on the interior surface of coil spool 870 within the longitudinal cavity 809 at the same elevation as the rotating member 810 when fully seated and positioned in the spool. The recesses 883 receive the wedge-shaped protrusions 882, thereby allowing a right to left rocking motion when the actuator 800 is actuated (see, e.g. FIGS. 55A and 55B).

Figure 56:
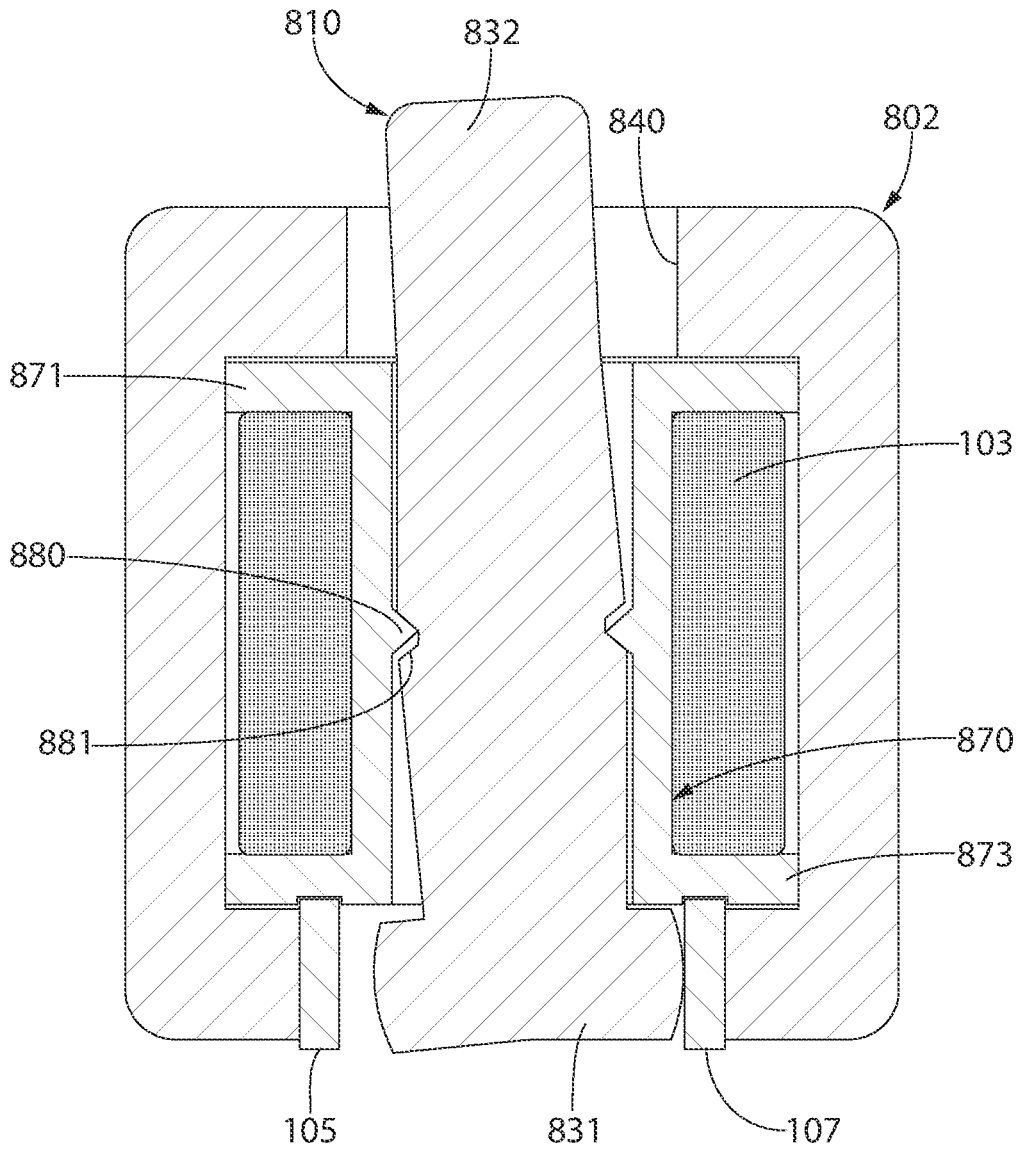
FIG. 56 is a front cross sectional view of a fifth alternative embodiment of an electromagnetic actuator with a coil assembly mounted rotating member.

FIG. 56 shows an opposite construction where the protrusions 882 are formed on the interior surface of the spool 870 within the longitudinal cavity 809 and the recesses 883 are formed in the lateral sides of the rotating member 810.

Other shaped protrusions 882 and recesses 883 may be used for the fulcrum features and fulcrum engagement features. In some embodiments as opposed to the triangular wedge-shaped protrusions and V-shaped recesses, the protrusions 882 may be rounded and semi-circular in shape and the corresponding complementary configured recesses 883 may have a concave arcuately curved shape. Numerous other shape configurations may be used and does not limit the invention.

Advantageously, the pinless rotating member 810 and spool 870 assembly allows for less parts and complexity of assembly. This reduces parts and fabrication costs. Furthermore, the space between the coil winding and rotating member can be minimized which increases efficiency of magnetic flux transfer and allows smaller scaling of parts for a proportional amount of force and displacement of the actuator.

Figure 51:
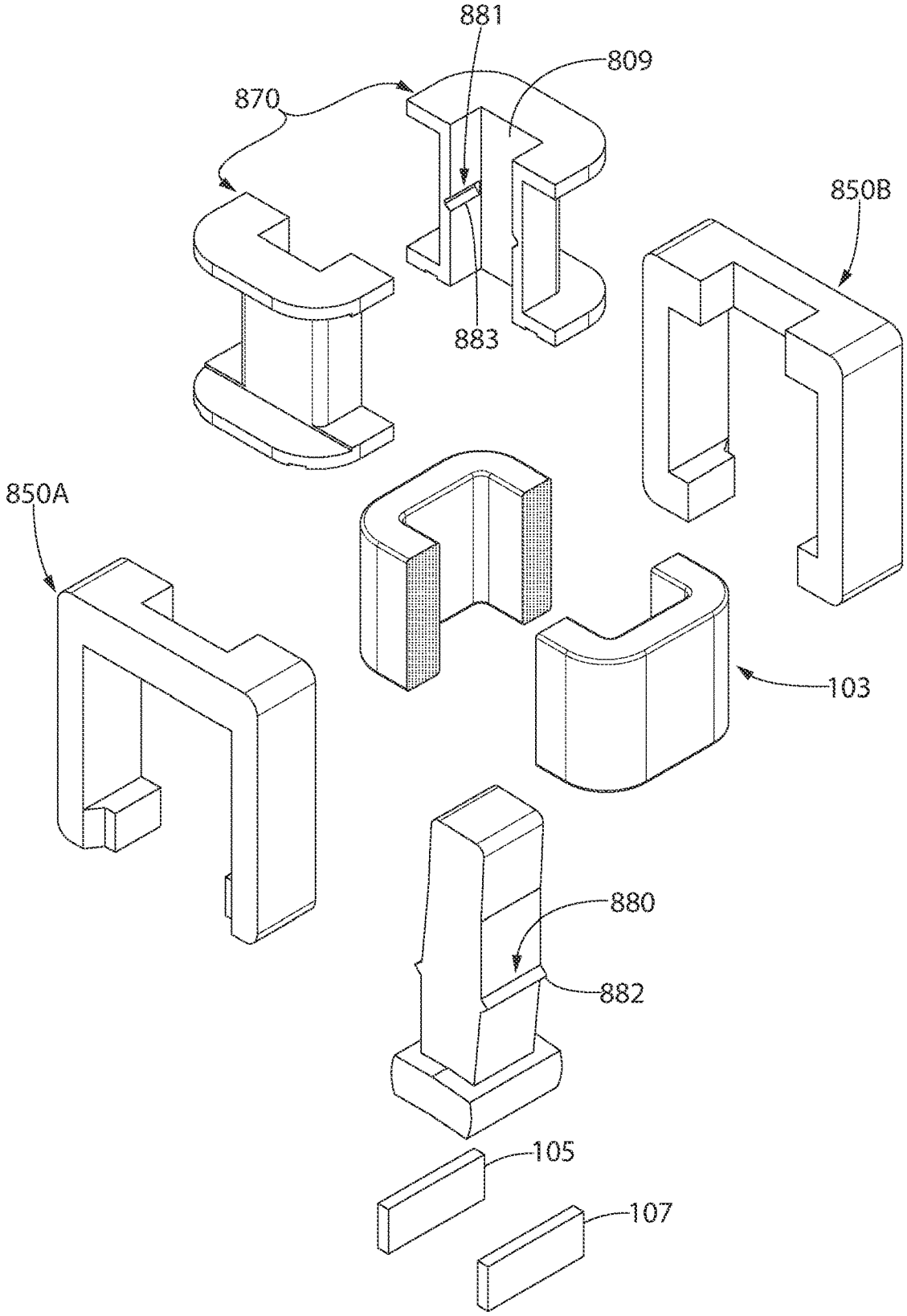
FIG. 51 is a top exploded view thereof.
Figure 52:
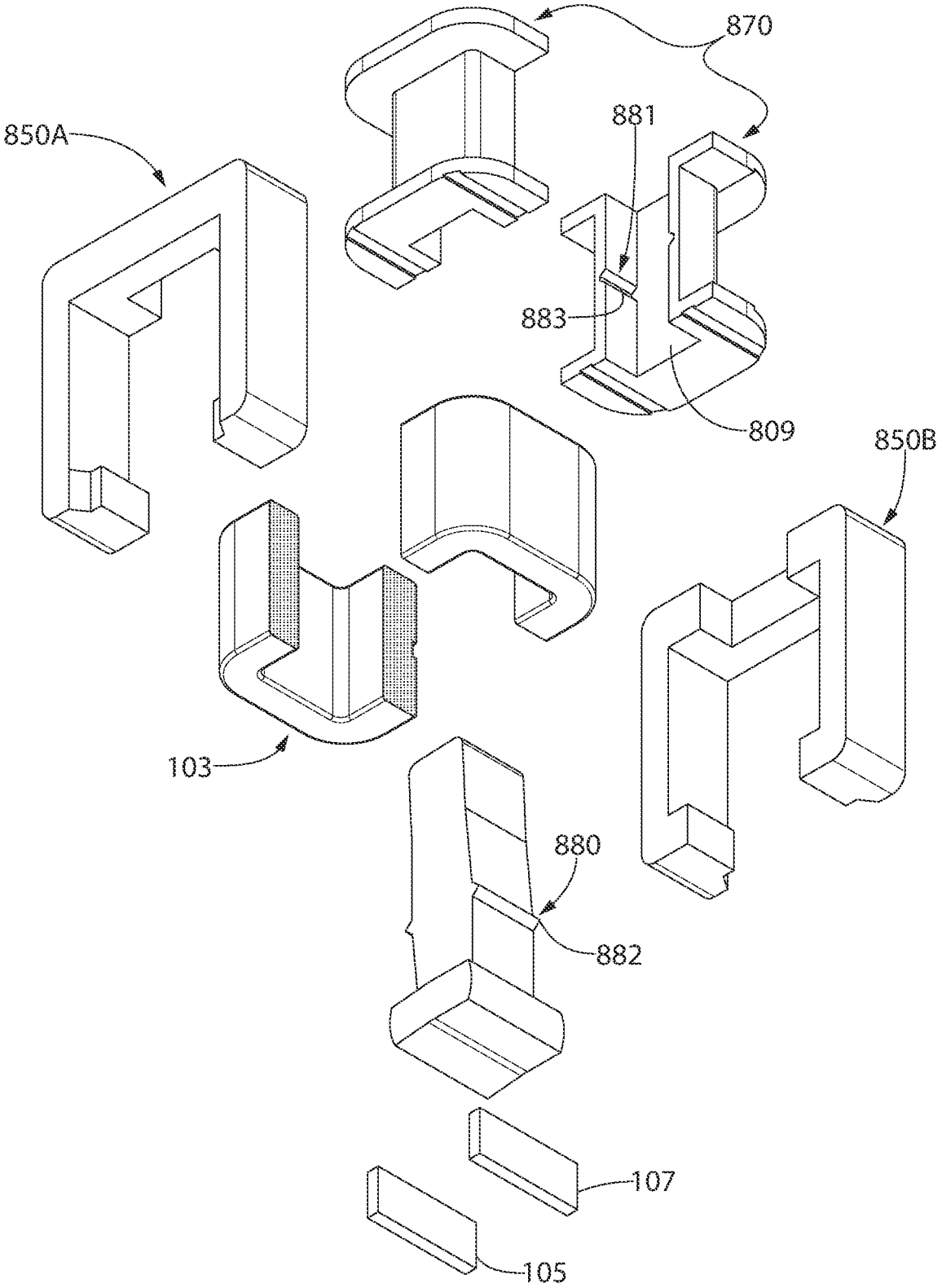
FIG. 52 is a bottom exploded view thereof.
Figure 54:
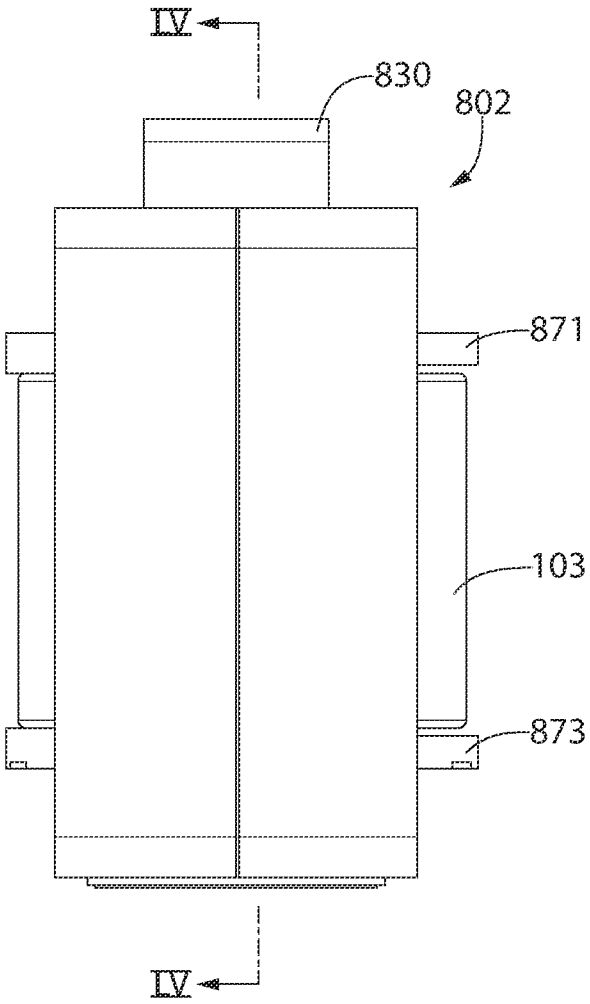
FIG. 54 is a side view thereof.
Figure 53:
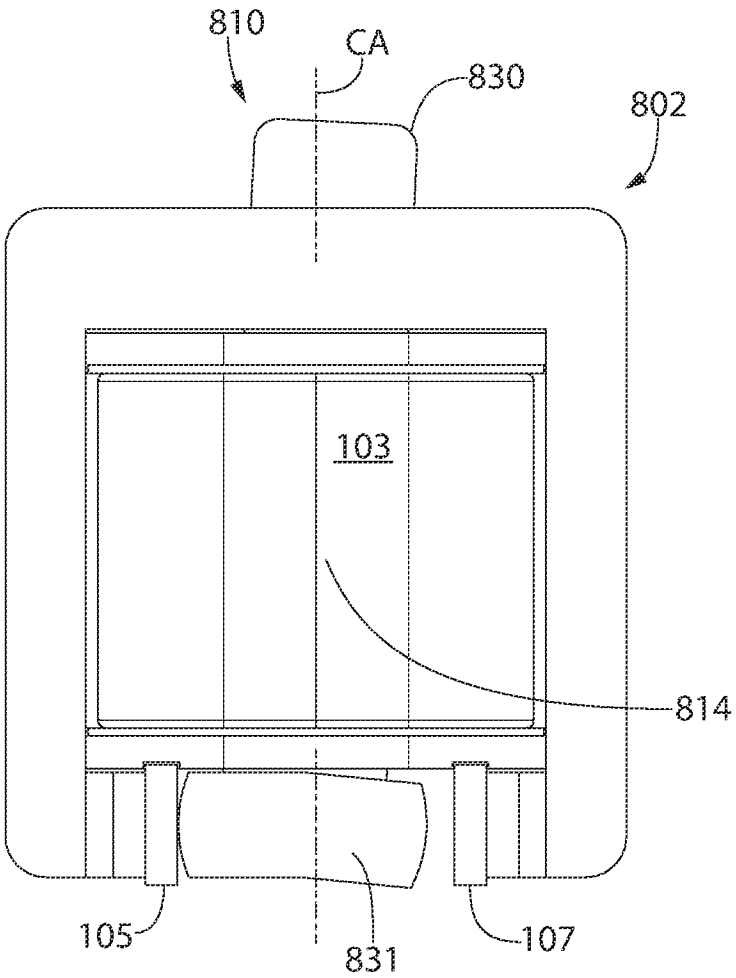
FIG. 53 is a front view thereof.
Figure 55A:
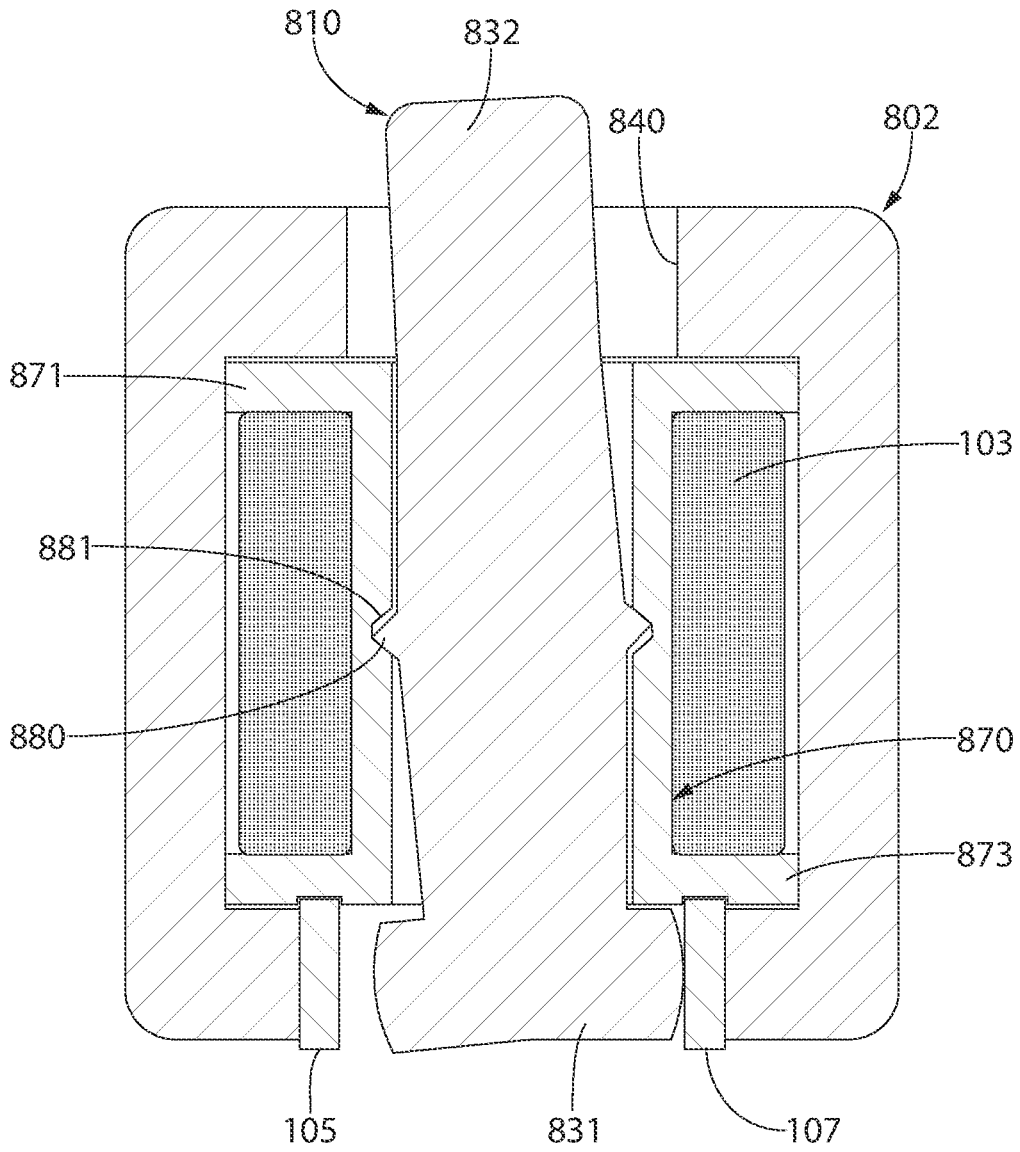
FIG. 55A is a front cross sectional view thereof showing the actuator in a first operating position.
Figure 55B:
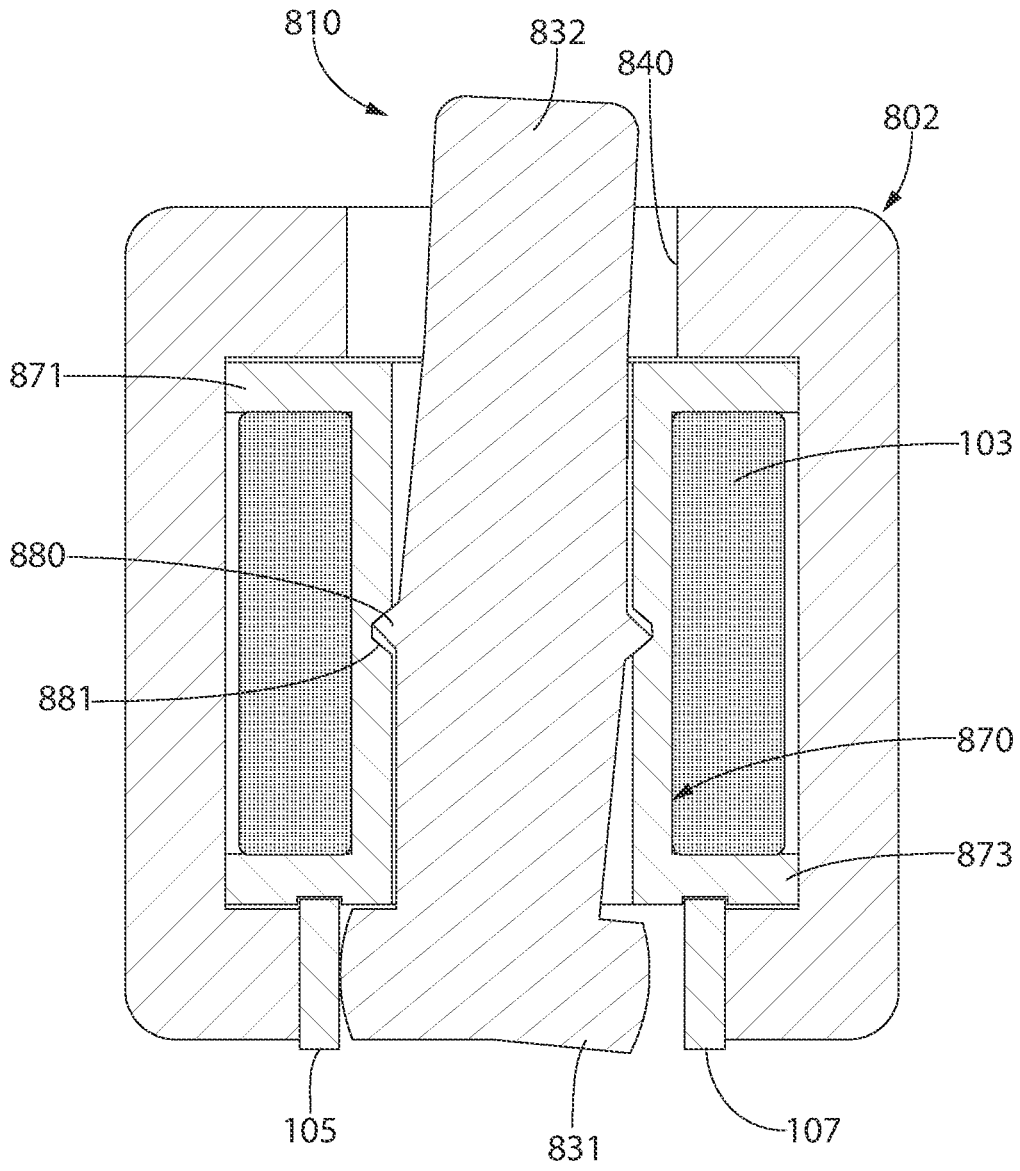
FIG. 55B is a front cross sectional view thereof showing the actuator in a second operating position.

To facilitate assembly of the pinless rotating member 810 to spool 870, the spool may be formed in two half-sections as shown in FIGS. 51-52 which are joined together via any of the suitable means previously identified herein for yoke half-sections 850A-B. In other embodiments, however, the pinless spool 870 may be a single piece having a monolithic unitary structure. By making the spool from at least a moderately flexible polymer such as nylon or another, an interference snap-fit may be formed between the mating fulcrum and fulcrum engagement features. The longitudinal cavity 809 of the spool has lateral or transverse dimensions selected to be just large enough to allow the rotating member 810 to be inserted and slid therein. Accordingly, the rotating member is captured within the longitudinal cavity of the spool 870 by sliding the rotating member into and through the longitudinal cavity, slightly deflecting and laterally/transversely expanding the flexible polymeric spool until the fulcrum protrusions 882 defining the rotating member pivot point reach the fulcrum recesses 883, and snap into place thereby lockingly but pivotably coupling the rotating member and spool together.

Figure 37:
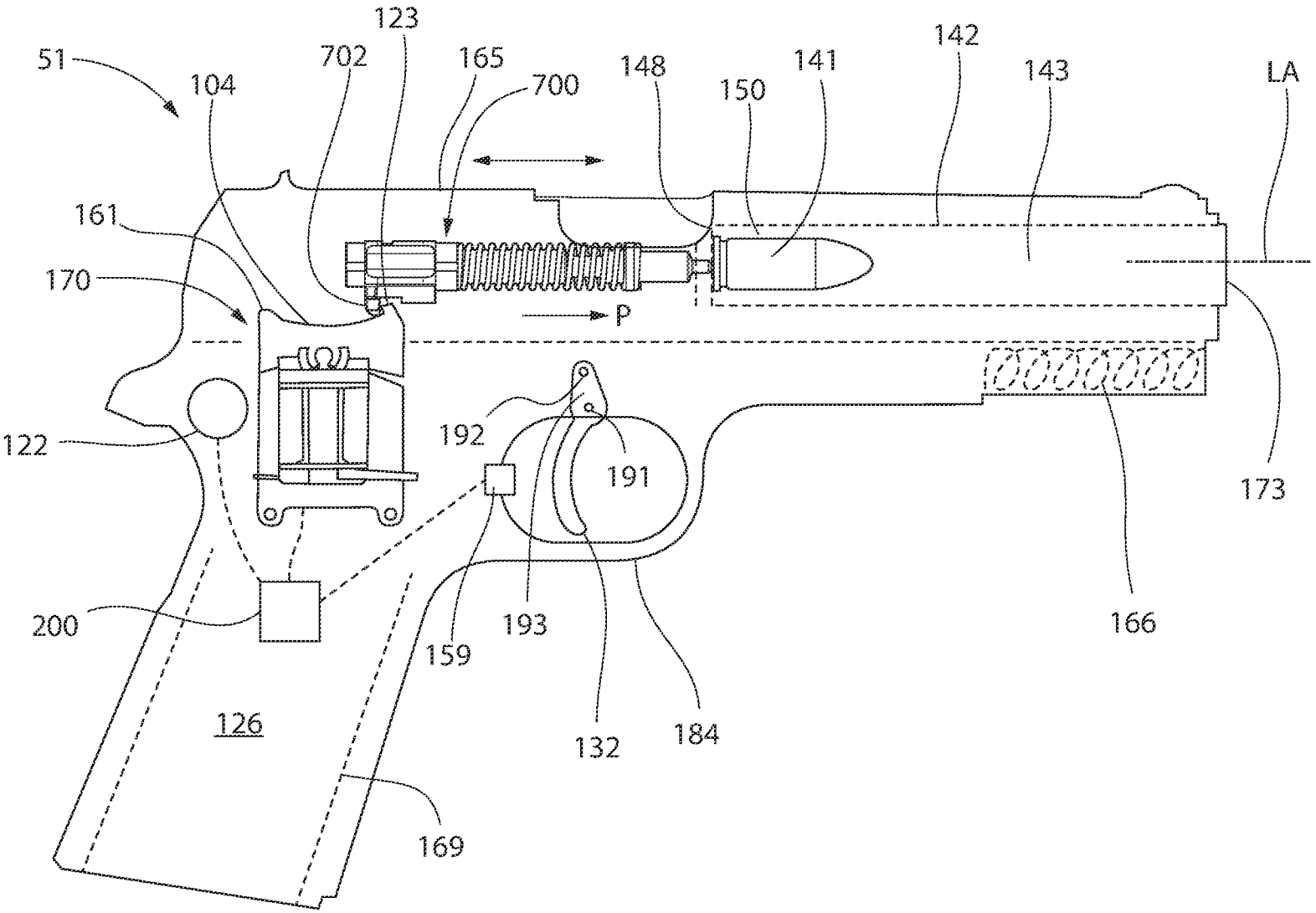
FIG. 37 is a schematic side view of the release type actuator shown in FIG. 15 in a firearm with an electronic trigger-operated firing mechanism.
Figure 38:
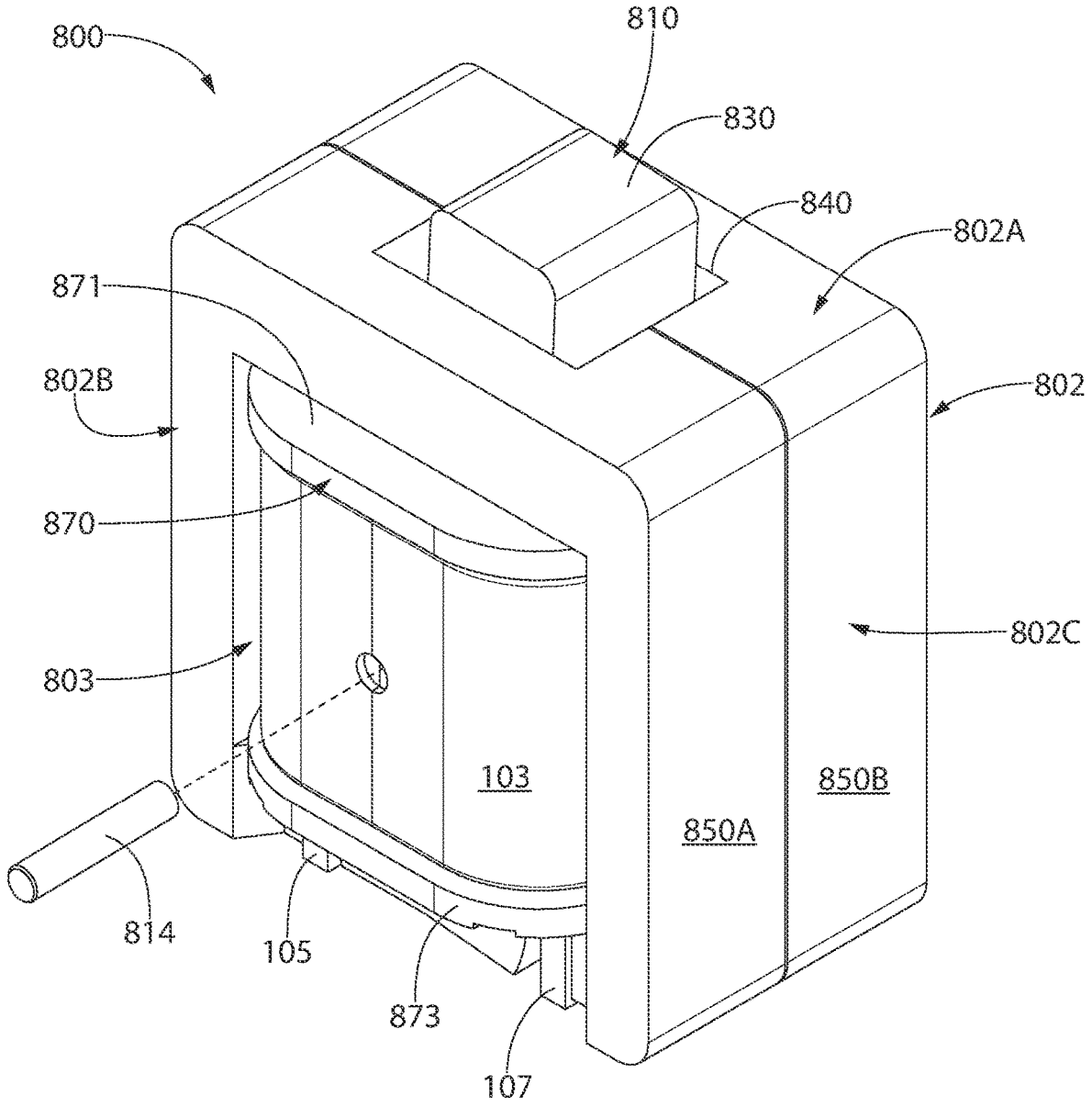
FIGS. 38 and 39 are top and bottom perspective views respectively of a third alternative embodiment of an electromagnetic actuator with a coil assembly mounted rotating member.
Figure 39:
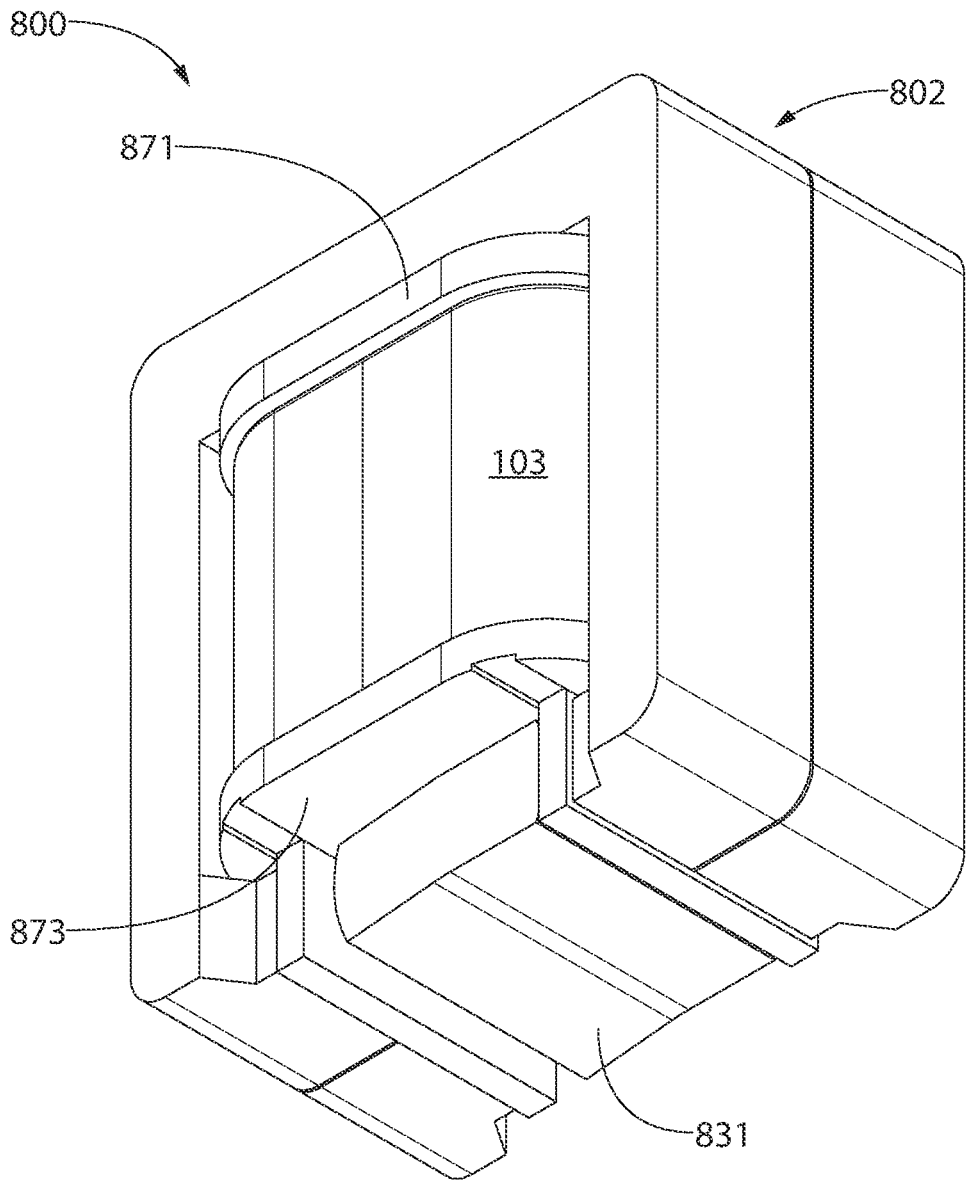

FIG. 37 shows another application of the single acting actuator 170 shown in FIGS. 1, 8A-C, and 15 which may benefit from an asymmetric design. In this embodiment, the actuator which incorporates a rotating member 104 configured as a sear is embodied in a firearm 50 that includes a forwardly spring-biased linearly movable striker 700 in lieu of a hammer for the striking member. Striker 700 has a horizontally elongated body including a downwardly depending catch protrusion 702 which is engageable with sear protrusion 123 of the actuator rotating member 104. Sear protrusion 123 may be formed on one end 162 of sear 124 and a rounded reset protrusion 161 may be formed on the opposite end 163 (best shown in FIG. 15); both of operate as previously described herein. Arcuately and concavely curved actuator reset surface 125 extends between protrusions 123 and 161 as previously described. Striker 700 is movable in a forward path P via a trigger pull between a rearward cocked position and a forwarding firing position contacting and detonating a chambered cartridge 150 to discharge the firearm.

In operation, a trigger sensor 159 operates in a manner previously described herein and communicates a trigger pull action to the microcontroller 200, which in turn activates and changes position of the actuator 170 form a first position to a second position. The sear protrusion 123 disengages the striker catch protrusion 702 and releases the striker 700 from the cocked position. The forward end of the striker 700 strikes and detonates the cartridge as the strike moves forward. The reciprocating slide 165 or another moving part of the firearm action having a reset surface (not shown) travels rearward under recoil engaging the reset protrusion 161. This toggles the actuator (i.e. rotating member 104) from the second position back to the first position. The striker catch protrusion 702 re-engages the sear protrusion 123 to restrain the striker 700 in the rearward cocked and ready-to-fire position again. In other embodiments, the actuator may be reset by the microcontroller 200 from the second to first position in lieu of a physical moving part of the firearm action. In this case, the microcontroller 200 implements a timer or relies on an actuator position sensor previously described herein to detect when the rotating member 104 should be reset to the starting actuation position.

While the embodiments and the examples of control flow for the fast action shock invariant magnetic actuator discussed here all relate to the application in firearms, it is apparent to those skilled in the art that a fast action shock invariant magnetic actuator is directly applicable to other applications that need a small, battery powered fast acting actuation means that must survive in a high shock environment. The actuator trigger event signal can be considered as the stimulus of any number of access control problems. One apparent application would be a fast action actuator and authentication control scheme for use securing a firearm in a lock box application or locking holster. Other applications as introduced early include application to less-lethal weapons (stun guns, pellet guns, tear gas launchers, paintball guns), power tools (drills staple guns, nail guns, pneumatic tools), military applications (small arms, crew served weapons, machine guns), as well as the actuator for access control such as gun holsters, door locks, storage boxes and containers, and any number of replacement applications where other mechanical or electromechanical actuators are used.

It bears noting that any of the various actuator embodiments disclosed herein may be interchangeably used or combined in any of the potential applications described herein. Accordingly, although one embodiment of an actuator may be shown in a particular application as applied to the firing mechanism of a firearm, it will be understood than any of the other configuration and type of actuators disclosed may be substituted unless expressly stated otherwise. The invention is therefore not limited by the particular actuator shown in the figures, which merely represent non-limiting examples for convenience of description only.

It further bears noting that any of the various actuator embodiments disclosed herein may be configured and operated under control of microcontroller 200 as appropriately programmed in any of the ways or operating modes described herein (e.g. direct acting or indirect acting, asynchronous or synchronous, asymmetric or symmetric, fixed timed event or momentary event, single acting or dual acting, etc.). The operating mode may be selected based on the intended application.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An electromagnetic actuator comprising:

a central axis;

an annular stationary outer yoke circumscribing an interior central space;

a spool arranged in the central space and defining a longitudinal cavity extending along the central axis;

an electromagnetic coil wound around the spool;

an axially elongated rotating member disposed in the cavity of the spool about a pivot axis defining a center of rotation, the rotating member pivotably movable relative to the yoke between first and second actuation positions;

the rotating member configured to interface with a component of an external apparatus to which the actuator is mountable;

a pair of spaced apart first and second permanent magnets attached to the outer yoke or the rotating member and creating a static holding torque on the rotating member for maintaining the first or second actuation positions;

the yoke, permanent magnets, and rotating member collectively forming a first magnetic flux circuit and a second magnetic flux circuit;

wherein the rotating member is rotatable between the first and second actuation positions by changing a polarity of an electric current applied to the electromagnet coil.

2. The electromagnetic actuator according to claim 1, wherein the actuator is configured to create opposing lines of magnetic flux in the rotating member.

3. The electromagnetic actuator according to claim 1, wherein the pivot axis is defined by a pivot pin extending through the rotating member and spool.

4. The electromagnetic actuator according to claim 1, wherein the pivot axis is defined by a raised fulcrum feature formed on the rotating member or spool, and the other one of the rotating member or spool comprises a complementary configured fulcrum engagement feature to form a pinless pivot axis.

5. The electromagnetic actuator according to claim 4, wherein the fulcrum feature comprises a wedge-shaped protrusion and the fulcrum engagement feature comprises a V-shaped recess.

6. The electromagnetic actuator according to claim 1, wherein the rotating member comprises a first end defining an operating end protrusion configured to interface with the component of the external apparatus, and an opposite second end defining an actuating end protrusion which defines an openable and closeable first air gap between the yoke and a first side of rotating member, and an openable and closeable second air gap on a second side between the yoke and a second side of the rotating member.

7. The electromagnetic actuator according to claim 6, wherein the operating end protrusion is configured to (i) block movement of the component when the rotating member is in the first actuation position, and (ii) allow movement of the component when the rotating member is in the second actuation position.

8. The electromagnetic actuator according to claim 6, wherein the external apparatus is selected from the group consisting of a power tool, a military weapon, a firearm, a door lock, a storage container, and a gun holster.

9. The electromagnetic actuator according to claim 8, wherein the component of the external apparatus is an energy storage device.

10. The electromagnetic actuator according to claim 6, wherein one of the pair of permanent magnets is disposed in each of the first and second air gaps.

11. The electromagnetic actuator according to claim 10, wherein the permanent magnets are attached to the yoke in each of the first and second air gaps.

12. The electromagnetic actuator according to claim 11, wherein the actuating end protrusion has a generally elongated double-sided hammer configuration including a pair of opposite outwardly facing side actuation surfaces, each actuation surface arranged to alternatingly engage one or the other of the permanent magnets when the rotating member moves between the first and second actuation positions.

13. The electromagnetic actuator according to claim 12, wherein each of the side actuation surfaces is arcuately curved.

14. The electromagnetic actuator according to claim 6, wherein the yoke comprises an open receptacle on one end, the operating end of the rotating member positioned and laterally movable in the receptacle when the rotating member moves between the first and second actuation positions.

15. The electromagnetic actuator according to claim 6, wherein the operating end protrusion projects outwards from an open top receptacle formed in the yoke to interface with the component of the external apparatus.

16. The electromagnetic actuator according to claim 15, further comprising a low friction material disposed between each of a front and rear side of the operating end protrusion and the yoke in the receptacle.

17. The electromagnetic actuator according to claim 16, wherein the low friction material comprises a polymeric coating applied to the front and rear side of the operating end protrusion and the yoke in the receptacle.

18. The electromagnetic actuator according to claim 1, wherein the spool comprises a generally tubular body having opposing open ends to access the cavity, the rotating member extending outwards from each end of the spool.

19. The electromagnetic actuator according to claim 18, wherein the body of the spool has a monolithic unitary structure.

20. The electromagnetic actuator according to claim 18, wherein the body of the spool comprises a first half-section and a second half-section coupled together.

21. The electromagnetic actuator according to claim 1, wherein the body of the spool is formed of a non-magnetic metallic or non-magnetic non-metallic material.

22. The electromagnetic actuator according to claim 1, wherein the yoke comprises a front half-section and a rear half-section coupled to the front half-section which traps the spool in the yoke, and wherein the front and rear half-sections are each generally C-shaped.

23. The electromagnetic actuator according to claim 1, wherein the spool comprises an outwardly protruding annular flange on opposite ends which engage the yoke and retains the electromagnetic coil on the spool.

24. The electromagnetic actuator according to claim 1, wherein the permanent magnets are arranged to form first and second magnetic flux paths circulating through the yoke and rotating member such that the first and second magnetic flux paths act in opposing directions in a common return flux path located in the rotating member.

25. The electromagnetic actuator according to claim 1, wherein the center of rotation of the rotating member is sufficiently close to a center of mass of the rotating member such that random linear acceleration forces acting on the actuator from any direction will not generate sufficient force to overcome the static holding torque of the permanent magnets in a plane perpendicular to the axis of rotation.

26. The electromagnetic actuator according to claim 1, wherein the center of mass of the rotating member is located a maximum distance from the axis of rotation given by the holding torque divided by the product of the mass of the rotating member, a gravitational acceleration constant (g), and 100.

27. The electromagnetic actuator according to claim 26, wherein the center of mass of the rotating member is coaxial with the center of rotation.

28. The electromagnetic actuator according to claim 1, further comprising a programmable microcontroller operably and communicably coupled to the actuator and a power source via a control circuit, the microcontroller configured to change position of the rotating member between the first and second actuation positions via transmitting the electrical current pulse to the electromagnetic coil.

29. The electromagnetic actuator according to claim 28, further comprising an actuator sensor configured and operable to sense movement of the actuator between the first and second actuation positions which is detected by the microcontroller.

30. The electromagnetic actuator according to claim 29, wherein the microcontroller terminates the electrical current pulse to the electromagnetic coil upon detecting a change in position of the actuator.

* * * * *